US012241648B2

(12) United States Patent
Mowris

(10) Patent No.: US 12,241,648 B2
(45) Date of Patent: Mar. 4, 2025

(54) NON-INVASIVE TEMPERATURE-BASED DIAGNOSTIC METHOD

(71) Applicant: Robert J. Mowris, Olympic Valley, CA (US)

(72) Inventor: Robert J. Mowris, Olympic Valley, CA (US)

( * ) Notice: Subject to any disclaimer, the term of this patent is extended or adjusted under 35 U.S.C. 154(b) by 0 days.

(21) Appl. No.: 18/367,887

(22) Filed: Sep. 13, 2023

(65) Prior Publication Data

US 2024/0392989 A1 Nov. 28, 2024

Related U.S. Application Data

(60) Provisional application No. 63/406,518, filed on Sep. 14, 2022.

(51) Int. Cl.
*F24F 11/49* (2018.01)

(52) U.S. Cl.
CPC ..... *F24F 11/49* (2018.01)

(58) Field of Classification Search
CPC ..... F25B 2700/04; F25B 2500/23; F25B 2500/24; F24F 11/38
See application file for complete search history.

(56) References Cited

U.S. PATENT DOCUMENTS 6,223,544 B1 5/2001 Seem
6,701,725 B2 3/2004 Rossi
7,079,967 B2 7/2006 Rossi
7,500,368 B2 3/2009 Mowris
7,712,319 B2 * 5/2010 Braun, II ..... F25B 49/005 62/149

(Continued)

OTHER PUBLICATIONS

California Air Resources Board (CARB). High-GWP Refrigerants. Date: Dec. 2, 2018. pp. 10. https://ww2.arb.ca.gov/resources/documents/high-gwp-refrigerants. Sacramento. CA. USA.

(Continued)

*Primary Examiner* — Lam S Nguyen
(74) *Attorney, Agent, or Firm* — CIONCA IP Law P.C.

(57) ABSTRACT

A Non-invasive Temperature-based Diagnostic (NTD) method for evaluating Air Conditioning (AC) system faults based on Return-air Drybulb Temperature (RDT), Return-air Wetbulb Temperature (RWT), Supply-air Drybulb Temperature (SDT), Suction Temperature (ST), Liquid Temperature (LT), Outdoor-Air Temperature (OAT), Delta Temperature Split (DTS) equal to Actual Temperature Split (ATS) minus Required Temperature Split (RTS), and Liquid Over Ambient Temperature (LOA) equal to LT minus OAT. The method diagnoses proper Refrigerant Charge and Airflow (RCA) based on DTS and LOA or at least one AC system fault based on DTS, ST, and LOA. The processing order comprises at least one diagnostic selected from the group consisting of: low cooling capacity, condenser heat exchanger, refrigerant restriction, evaporator heat exchanger, proper RCA, refrigerant undercharge, overcharge, non-condensables, and low airflow. DTS is used to determine an undercharge amount. The ratio of ATS measured before and after correcting AC system faults is used to calculate an energy-efficiency improvement.

20 Claims, 23 Drawing Sheets

(56) References Cited

U.S. PATENT DOCUMENTS

| | | | | |
|---|---|---|---|---|
| 8,024,938 | B2 * | 9/2011 | Rossi | F25B 49/00 62/127 |
| 2011/0082651 | A1 * | 4/2011 | Mowris | F24F 11/62 702/45 |
| 2017/0343227 | A1 * | 11/2017 | Mowris | F24F 11/62 |

OTHER PUBLICATIONS

United States Environmental Protection Agency (USEPA). 2016. Stationary Refrigeration and Air Conditioning. Date: Jan. 25, 2016. pp. 4. https://www.epa.gov/section608. Washington, DC. USA.

Carrier Corporation. HVAC Servicing Procedures. SK29-01A, 020-040. Date: 1995. pp. 8 (Cover, preface, and pp. 145-150). Published by Carrier Corporation, 13995 Pasteur Blvd., Palm Beach Gardens, Florida 33418 USA.

California Energy Commission (CEC). 2008. 2008 Residential Appendices for the Building Energy Efficiency Standards for Residential and Nonresidential Buildings. CEC-400-2008-004-CMF. Date: Dec. 2008, pp. 363, Published by the California Energy Commission, 1516 9th Street, Sacramento, CA 95814 USA. https://ww2.energy.ca.gov/2008publications/CEC-400-2008-004/CEC-400-2008-004-CMF.PDF.

Yuill, David P., Braun, James E., Evaluating Fault Detection and Diagnostics Protocols Applied to Air-Cooled Vapor Compression Air-Conditioners. Date: Jul. 16, 2012, pp. 11, International Refrigeration and Air Conditioning Conference. Paper 1307. Published by Ray W. Herrick Laboratories, Purdue University, 177 S Russell St,, West Lafayette, IN 47907 USA (Yuill 2012). http://docs.lib.purdue.edu/iracc/1307.

California Energy Commission (CEC). 2012. Reference Appendices The Building Energy Efficiency Standards for Residential and Nonresidential Buildings. CEC-400-2012-005-CMF-REV3. Date: May 2012, pp. 10, 146/001 476, Published by the California Energy Commission, 1516 9th St, Sacramento, CA 95814 USA (CEC 2012). https://ww2.energy.ca.gov/2012publications/CEC-400-2012-005/CEC-400-2012-005-CMF-REV3.pdf.

Bergman, James. NIST testing in measureQuick. Date: Mar. 5, 2021. pp. 15. Published by Youtube.com. San Bruno, CA: USA. https://www.youtube.com/watch?v=gOzep_Ayyr0&t=3s.

Marchsese, Joseph. Checking For Noncondensables. Date: Jan. 8, 2007. Published by ACHR News. 2401 W Big Beaver Road, Suite 700, Troy, Michigan 48084, USA. https://www.achrnews.com/articles/102428-checking-for-noncondensables.

Patent Cooperation Treaty, International Search Report, Nov. 1, 2024, PCT/US/2024/046567.

Patent Cooperation Treaty, Written Opinion of the International Searching Authority, Nov. 1, 2024, PCT/ US/2024/046567.

* cited by examiner

| # | Laboratory Tests | NTD Method | OAT | LT | LOA | ST | RDB | SDB | DTS |
|---|---|---|---|---|---|---|---|---|---|
| 301 | NT Base FC | Verified RCA | 96.5 | 103.1 | 6.6 | 58.6 | 79.9 | 62.3 | -0.7 |
| 302 | NT +5% | OK Airflow: Detect OC | 95.0 | 99.4 | 4.4 | 50.3 | 80.1 | 62.1 | -0.2 |
| 303 | NT +10% | OK Airflow: Detect OC | 95.0 | 98.5 | 3.5 | 49.9 | 80.1 | 62.0 | -0.3 |
| 304 | NT +20% | OK Airflow: Detect OC | 95.0 | 98.2 | 3.1 | 50.2 | 80.1 | 61.9 | -0.1 |
| 305 | NT +30% | OK Airflow: Detect OC | 95.0 | 98.0 | 2.9 | 50.1 | 79.9 | 62.0 | -0.5 |
| 306 | NT +40% | OK Airflow: Detect OC | 95.0 | 97.5 | 2.4 | 50.4 | 79.9 | 62.2 | -0.6 |
| 307 | NT Base FC | Verified RCA | 95.8 | 103.1 | 7.3 | 58.6 | 79.9 | 62.2 | -0.6 |
| 308 | NT -5% | MIN – Verified RCA (4%) | 95.0 | 104.2 | 9.2 | 72.1 | 80.0 | 64.7 | -3.0 |
| 309 | NT -10% | Detect UC: 12% | 95.0 | 104.6 | 9.6 | 79.9 | 80.0 | 68.7 | -7.0 |
| 310 | NT -20% | Detect UC: 18% | 95.0 | 103.4 | 8.4 | 81.5 | 80.0 | 70.6 | -8.9 |
| 311 | NT -30% | Detect UC: 32% | 95.0 | 100.4 | 5.4 | 81.2 | 80.0 | 74.4 | -12.7 |
| 312 | NT -40% | Detect UC: 38% | 95.0 | 98.7 | 3.7 | 80.9 | 80.0 | 75.8 | -14.1 |
| 313 | NT 10.1% low airflow | Low Airflow | 95.0 | 101.4 | 6.3 | 62.4 | 81.9 | 60.4 | 2.8 |
| 314 | NT 22.8% low airflow | Low Airflow | 95.0 | 100.7 | 5.8 | 59.1 | 81.9 | 58.8 | 4.3 |
| 315 | NT 36.1% low airflow | Low Airflow | 95.0 | 101.1 | 6.1 | 53.0 | 82.3 | 59.5 | 3.8 |
| 316 | TXV Base FC | Verified RCA | 95.0 | 103.5 | 8.5 | 50.1 | 80.1 | 62.1 | -1.0 |
| 317 | TXV +5% | OK Airflow: Detect OC | 95.0 | 105.8 | 10.8 | 50.4 | 79.9 | 62.0 | -0.4 |
| 318 | TXV +10% | OK Airflow: Detect OC | 95.0 | 97.7 | 2.7 | 51.9 | 79.9 | 61.9 | -0.3 |
| 319 | TXV +20% | OK Airflow: Detect OC | 95.0 | 96.9 | 1.8 | 50.9 | 80.1 | 61.9 | -0.1 |
| 320 | TXV +30% | OK Airflow: Detect OC | 95.7 | 97.2 | 1.5 | 50.1 | 80.0 | 61.8 | -0.2 |
| 321 | TXV +40% | OK Airflow: Detect OC | 95.0 | 96.5 | 1.5 | 49.4 | 80.1 | 61.9 | -0.9 |
| 322 | TXV Base FC | Verified RCA | 95.0 | 103.5 | 8.5 | 50.1 | 80.1 | 62.1 | -1.0 |
| 323 | TXV -5% | MIN – Verified RCA (4%) | 95.0 | 106.6 | 11.6 | 61.0 | 79.9 | 62.7 | -1.1 |
| 324 | TXV -10% | Detect UC: 8% | 95.0 | 105.9 | 10.9 | 69.1 | 80.0 | 64.0 | -2.4 |
| 325 | TXV -20% | Detect UC: 19% | 95.0 | 104.4 | 9.3 | 77.2 | 80.0 | 67.4 | -5.7 |
| 326 | TXV -30% | Detect UC: 28% | 95.0 | 102.2 | 7.2 | 81.1 | 80.0 | 70.3 | -8.6 |
| 327 | TXV -40% | Detect UC: 42% | 95.0 | 98.3 | 3.3 | 81.0 | 80.0 | 74.6 | -12.9 |
| 328 | NT Base FC | Verified RCA | 95.0 | 102.6 | 7.6 | 55.9 | 80.7 | 59.0 | 2.0 |
| 329 | NT 35% Evap. Block | Low Airflow | 95.0 | 102.3 | 7.3 | 48.0 | 80.2 | 59.1 | 2.0 |
| 330 | NT 50% Evap. Block | Low Airflow | 95.0 | 102.4 | 7.4 | 47.1 | 80.4 | 58.9 | 2.4 |
| 331 | NT Base FC | Verified RCA | 95.0 | 100.8 | 5.8 | 61.0 | 80.0 | 62.8 | -1.1 |
| 332 | NT RR 95F | Detect RR, EHX, UC | 95.0 | 96.9 | 1.9 | 81.8 | 79.8 | 69.3 | -7.8 |
| 333 | NT RR 115F | Detect RR, EHX, UC | 115.0 | 120.2 | 5.1 | 80.1 | 79.8 | 68.1 | -6.6 |
| 334 | NT RR 75F | Detect RR, EHX, UC | 75.0 | 76.6 | 1.6 | 78.4 | 79.9 | 71.3 | -9.7 |
| 335 | NT RR 55F | Detect RR, EHX, UC | 55.0 | 55.5 | 0.5 | 73.0 | 79.9 | 71.3 | -9.7 |
| 336 | NT NC Dirty Oil 95F | Detect NC | 94.8 | 99.9 | 5.0 | 65.8 | 80.0 | 70.6 | -8.9 |
| 337 | NT NC 0.3% 95F | Detect NC | 95.0 | 98.6 | 3.6 | 71.4 | 79.8 | 64.5 | -3.0 |
| 338 | NT NC 0.3% 115F | Detect NC | 115.3 | 120.0 | 4.6 | 52.5 | 79.8 | 63.7 | -2.1 |
| 339 | NT NC 0.3% 75F | Detect NC | 74.9 | 76.3 | 1.3 | 74.6 | 79.8 | 65.2 | -3.7 |
| 340 | NT NC 0.3% 55F | Detect NC | 55.0 | 55.7 | 0.7 | 72.6 | 79.8 | 64.6 | -3.1 |
| 341 | TXV Base FC 95F | Verified RCA | 95.0 | 104.5 | 9.5 | 49.9 | 80.0 | 61.8 | -0.1 |
| 342 | TXV NC 0.3% 95F | Detect NC | 95.0 | 98.9 | 3.9 | 59.5 | 79.9 | 63.3 | -1.7 |
| 343 | TXV NC 0.3% 115F | Detect NC | 114.9 | 120.6 | 5.7 | 61.4 | 79.9 | 64.2 | -2.6 |
| 344 | TXV NC 0.3% 75F | Detect NC | 75.0 | 76.7 | 1.7 | 56.7 | 79.9 | 61.2 | 0.3 |
| 345 | TXV NC 0.3% 55F | Detect NC | 55.1 | 55.8 | 0.7 | 66.5 | 79.9 | 61.2 | 0.4 |

Figure 4

| # | Laboratory Tests | NTD Method | OAT | LT | LOA | ST | RDB | SDB | DTS |
|---|---|---|---|---|---|---|---|---|---|
| 346 | TXV RR 95F | Detect RR, EHX, UC, TXV | 94.8 | 97.4 | 2.5 | 83.0 | 79.8 | 70.5 | -9.0 |
| 347 | TXV RR 115F | Detect RR, EHX, UC, TXV | 114.8 | 119.3 | 4.5 | 82.1 | 79.9 | 69.3 | -7.8 |
| 348 | TXV RR 75F | Detect RR, EHX, UC, TXV | 75.0 | 76.5 | 1.5 | 78.5 | 79.9 | 71.9 | -10.3 |
| 349 | TXV RR 55F | Detect RR, EHX, UC, TXV | 55.0 | 55.6 | 0.6 | 73.6 | 79.8 | 71.3 | -9.8 |
| 350 | NT Base no NC | Verified RCA | 95.0 | 101.2 | 6.2 | 63.0 | 80.0 | 62.7 | -1.1 |
| 351 | NT NC 0.3% | Detect NC | 95.0 | 97.6 | 2.6 | 57.9 | 80.1 | 62.0 | -0.2 |
| 352 | NT NC 0.3% | Detect NC | 95.0 | 97.8 | 2.8 | 60.8 | 80.0 | 62.3 | -0.6 |
| 353 | NT NC 1% | Detect NC | 95.0 | 96.2 | 1.2 | 63.2 | 80.1 | 62.7 | -0.9 |
| 354 | NT Base Cond | Verified RCA | 95.0 | 101.2 | 6.2 | 60.8 | 80.0 | 62.3 | -0.6 |
| 355 | NT 30% Cond Blk | Detect CHX | 95.1 | 104.1 | 9.1 | 54.6 | 80.0 | 62.3 | -0.6 |
| 356 | NT 50% Cond Blk | Detect CHX | 95.0 | 108.7 | 13.6 | 50.7 | 80.0 | 62.5 | -0.8 |
| 357 | NT 80% Cond Blk | Detect CHX | 95.0 | 129.9 | 34.9 | 52.2 | 80.0 | 63.3 | -1.6 |
| 358 | NT FC Base 30% Cond Blk | Detect CHX | 95.0 | 105.4 | 10.4 | 57.3 | 80.0 | 60.3 | 1.3 |
| 359 | NT -10% chg 30% CB | Detect CHX and UC: 4% | 95.0 | 108.1 | 13.1 | 76.1 | 79.9 | 64.7 | -3.1 |
| 360 | NT -20% chg 30% CB | Detect CHX and UC: 10% | 95.0 | 106.4 | 11.4 | 80.4 | 80.0 | 67.8 | -6.1 |
| 361 | NT Fact chg 82F | Verified RCA | 82.0 | 84.8 | 2.8 | 67.7 | 79.9 | 63.4 | -1.8 |
| 362 | NT -5% 82F | MIN – Verified RCA (4%) | 82.0 | 86.3 | 4.3 | 73.0 | 80.0 | 64.9 | -3.2 |
| 363 | NT -10% 82F | Detect UC: 7% | 82.1 | 88.0 | 5.9 | 76.4 | 80.0 | 66.7 | -4.9 |
| 364 | NT -20% 82F | Detect UC: 21% | 82.0 | 88.6 | 6.6 | 81.8 | 80.0 | 71.6 | -9.9 |
| 365 | NT -30% 82F | Detect UC: 29% | 82.0 | 88.3 | 6.3 | 78.8 | 80.0 | 73.6 | -11.9 |
| 366 | NT -40% 82F | Detect UC: 38% | 82.0 | 86.8 | 4.7 | 83.3 | 80.0 | 75.8 | -14.1 |
| 367 | NT +10% 82F | OK Airflow: Detect OC | 82.0 | 83.2 | 1.2 | 48.6 | 79.9 | 61.9 | -0.2 |
| 368 | NT +20% 82F | OK Airflow: Detect OC | 82.0 | 83.2 | 1.1 | 48.7 | 80.1 | 61.9 | -0.1 |
| 369 | NT +30% 82F | OK Airflow: Detect OC | 82.0 | 83.6 | 1.6 | 49.4 | 80.0 | 61.9 | -0.2 |
| 370 | NT +40% 82F | OK Airflow: Detect OC | 82.0 | 83.3 | 1.3 | 49.4 | 80.0 | 62.5 | -0.7 |
| 371 | NT Pkg 1C Base FC | Low capacity | 95.0 | 103.5 | 8.6 | 65.1 | 75.0 | 59.1 | -3.4 |
| 372 | NT Pkg 1C +20% EB 20% | Detect low airflow and OC | 95.0 | 100.6 | 5.6 | 50.8 | 75.0 | 59.7 | -4.0 |
| 373 | NT Pkg 1C -20% | Detect UC: 20% | 95.0 | 106.2 | 11.2 | 72.0 | 75.0 | 60.2 | -4.6 |
| 374 | NT Pkg 1C -30% | Detect UC: 26% | 95.0 | 108.9 | 13.9 | 72.8 | 75.0 | 61.8 | -6.1 |
| 375 | NT Pkg 1C -40% | Detect UC: 34% | 95.0 | 108.8 | 13.8 | 73.7 | 75.0 | 63.7 | -8.0 |
| 376 | TXV Pkg 1C Base FC | Verified RCA | 95.0 | 100.0 | 5.0 | 63.3 | 75.0 | 57.9 | -2.2 |
| 377 | TXV Pkg 1C -10% | MIN – Verified RCA (10%) | 95.0 | 103.0 | 8.0 | 64.2 | 75.0 | 58.5 | -2.8 |
| 378 | TXV Pkg 1C -20% | Detect UC: 16% | 95.0 | 103.6 | 8.6 | 68.7 | 75.0 | 59.1 | -3.4 |
| 379 | TXV Pkg 1C -30% | Detect UC: 25% | 95.0 | 102.6 | 7.5 | 71.2 | 75.0 | 60.9 | -5.1 |
| 380 | TXV Pkg 1C -40% | Detect UC: 40% | 95.0 | 101.1 | 6.1 | 73.5 | 75.0 | 64.2 | -8.5 |
| 381 | TXV Pkg 2C FC C1 | Verified RCA | 95.1 | 107.2 | 12.1 | 55.1 | 75.0 | 55.9 | -0.2 |
| 382 | TXV Pkg 2C FC C2 | Verified RCA | 95.1 | 101.4 | 6.3 | 56.2 | 75.0 | 55.9 | -0.2 |
| 383 | TXV Pkg 2C -10% | MIN – Verified RCA (6%) | 95.1 | 105.9 | 10.9 | 59.8 | 75.0 | 56.3 | -0.6 |
| 384 | TXV Pkg 2C -10% | MIN – Verified RCA (6%) | 95.1 | 107.1 | 12.0 | 59.8 | 75.0 | 56.3 | -0.6 |
| 385 | TXV Pkg 2C -20% | Detect UC: 10% | 95.0 | 104.8 | 9.7 | 70.9 | 75.0 | 56.8 | -1.1 |
| 386 | TXV Pkg 2C -20% | Detect UC: 10% | 95.0 | 105.7 | 10.6 | 70.9 | 75.0 | 56.8 | -1.1 |
| 387 | TXV Pkg 2C -30% | Detect UC: 22% | 95.0 | 103.1 | 8.1 | 73.9 | 75.0 | 58.1 | -2.4 |
| 388 | TXV Pkg 2C -30% | Detect UC: 22% | 95.0 | 103.5 | 8.5 | 74.6 | 75.0 | 58.1 | -2.4 |
| 389 | TXV Pkg 2C -40% | Detect UC: 40% | 95.0 | 100.1 | 5.1 | 71.3 | 75.0 | 60.7 | -5.0 |
| 390 | TXV Pkg 2C -40% | Detect UC: 40% | 95.0 | 100.4 | 5.4 | 78.2 | 75.0 | 60.7 | -5.0 |

Figure 5

| # | Intertek Lab Test | RSD Method | OAT | COA | EST | DSH | ASC | DSC | DTS |
|---|---|---|---|---|---|---|---|---|---|
| 401 | NT 100% Charge | Verified RCA | 96.5 | 16.2 | 48.2 | -0.5 | 9.6 | 2.6 | -0.7 |
| 402 | NT +5% Charge | MIN - Verified RCA (5%) | 95.0 | 18.6 | 48.8 | -10.5 | 14.3 | 7.3 | -0.2 |
| 403 | NT +10% Charge | Detect OC: 10% | 95.0 | 20.1 | 48.2 | -10.3 | 16.6 | 9.6 | -0.3 |
| 404 | NT +20% Charge | Detect OC: 12% | 95.0 | 20.4 | 48.8 | -10.7 | 17.2 | 10.2 | -0.1 |
| 405 | NT +30% Charge | Detect OC: 14% | 95.0 | 21.0 | 48.2 | -10.1 | 18.0 | 11.0 | -0.5 |
| 406 | NT +40% Charge | Detect OC: 18% | 95.0 | 21.9 | 48.8 | -10.5 | 19.4 | 12.4 | -0.6 |
| 407 | NT 100% Charge | Verified RCA | 95.8 | 16.9 | 48.2 | -1.0 | 9.6 | 2.6 | -0.6 |
| 408 | NT -5% Charge | MIN - Verified RCA (3%) | 95.0 | 12.7 | 44.3 | 15.8 | 3.5 | -3.5 | -3.0 |
| 409 | NT -10% Charge | Detect UC: 12% | 95.0 | 10.1 | 35.4 | 32.5 | 0.5 | -6.5 | -7.0 |
| 410 | NT -20% Charge | Detect UC: 19% | 95.0 | 8.4 | 28.5 | 41.0 | 0.0 | -7.0 | -8.9 |
| 411 | NT -30% Charge | Detect UC: 31% | 95.0 | 4.7 | 15.3 | 53.9 | -0.7 | -7.7 | -12.7 |
| 412 | NT -40% Charge | Detect UC: 39% | 95.0 | 2.9 | 8.1 | 60.8 | -0.8 | -7.8 | -14.1 |
| 413 | NT 10.1% low airflow | Low airflow | 95.0 | 15.5 | 46.9 | 3.6 | 9.2 | 1.2 | 2.8 |
| 414 | NT 22.8% low airflow | Low airflow | 95.0 | 15.2 | 46.3 | 1.9 | 9.5 | 0.5 | 4.3 |
| 415 | NT 36.1% low airflow | Low airflow | 95.0 | 14.6 | 45.6 | -4.5 | 8.5 | 0.5 | 3.8 |
| 416 | TXV Base | Verified RCA | 95.0 | 14.6 | 48.2 | -8.1 | 6.1 | -0.9 | -1.0 |
| 417 | TXV +5% Charge | MIN - Verified RCA (1%) | 95.0 | 12.7 | 48.8 | -10.4 | 1.9 | -5.1 | -0.4 |
| 418 | TXV +10% Charge | Detect OC: 8% | 95.0 | 22.4 | 48.2 | -8.3 | 19.7 | 12.7 | -0.3 |
| 419 | TXV +20% Charge | Detect OC: 16% | 95.0 | 27.8 | 48.2 | -9.3 | 26.0 | 19.0 | -0.1 |
| 420 | TXV +30% Charge | Detect OC: 30% | 95.7 | 35.4 | 48.8 | -10.1 | 33.9 | 26.9 | -0.2 |
| 421 | TXV +40% Charge | Detect OC: 25% | 95.0 | 33.0 | 48.2 | -8.9 | 31.5 | 24.5 | -0.9 |
| 422 | TXV Base | Verified RCA | 95.0 | 14.6 | 48.2 | -8.1 | 6.1 | -0.9 | -1.0 |
| 423 | TXV -5% Charge | MIN - Verified RCA (1%) | 95.0 | 11.7 | 48.0 | 1.0 | 0.1 | -6.9 | -1.1 |
| 424 | TXV -10% Charge | Detect UC: 9% | 95.0 | 10.7 | 46.0 | 11.1 | -0.2 | -7.2 | -2.4 |
| 425 | TXV -20% Charge | Detect UC: 20% | 95.0 | 9.1 | 40.3 | 24.9 | -0.3 | -7.3 | -5.7 |
| 426 | TXV -30% Charge | Detect UC: 28% | 95.0 | 6.7 | 33.2 | 35.9 | -0.5 | -7.5 | -8.6 |
| 427 | TXV -40% Charge | Detect UC: 40% | 95.0 | 2.6 | 16.3 | 52.7 | -0.7 | -7.7 | -12.9 |
| 428 | NT Base | Verified RCA | 95.0 | 24.2 | 46.3 | 1.6 | 16.6 | 5.6 | 2.0 |
| 429 | NT 35% Evap Block | Chk EHX, EA | 95.0 | 22.7 | 43.7 | -3.7 | 15.4 | 4.4 | 2.0 |
| 430 | NT 50% Evap Block | Chk EHX, EA | 95.0 | 22.4 | 43.0 | -3.9 | 15.0 | 4.0 | 2.4 |
| 431 | NT Base | Verified RCA | 95.0 | 16.1 | 48.0 | 1.0 | 10.3 | 3.3 | -1.1 |
| 432 | NT RR 95F | EST < 35F: RR or EHX | 95.0 | 18.3 | 33.2 | 36.6 | 16.4 | 9.4 | -7.8 |
| 433 | NT RR 115F | EST < 44F: RR or EHX | 115.0 | 17.4 | 41.0 | 39.1 | 12.3 | 5.3 | -6.6 |
| 434 | NT RR 75F | EST < 19F: RR or EHX | 75.0 | 12.1 | 18.1 | 37.6 | 10.5 | 3.5 | -9.7 |
| 435 | NT RR 55F | EST < 6F: RR or EHX | 55.0 | 10.4 | 5.9 | 33.3 | 9.9 | 2.9 | -9.7 |
| 436 | NT NC Dirty Oil 95F | COA > 25F: NC or CHX | 94.8 | 47.0 | 49.4 | 4.4 | 41.9 | 34.9 | -8.9 |
| 437 | NT NC 0.3% 95F | COA > 25F: NC or CHX | 95.0 | 28.9 | 46.3 | 13.1 | 25.4 | 18.4 | -3.0 |
| 438 | NT NC 0.3% 115F | COA > 21F: NC or CHX | 115.3 | 24.6 | 51.2 | 1.3 | 19.9 | 12.9 | -2.1 |
| 439 | NT NC 0.3% 75F | COA > 25F: NC or CHX | 74.9 | 29.5 | 38.3 | 13.6 | 28.1 | 21.1 | -3.7 |
| 440 | NT NC 0.3% 55F | COA > 28F: NC or CHX | 55.0 | 32.1 | 30.8 | 8.0 | 31.4 | 24.4 | -3.1 |
| 441 | TXV 95F Base | Verified RCA | 95.0 | 13.6 | 48.2 | -10.3 | 4.1 | -2.9 | -0.1 |
| 442 | TXV NC 0.3% 95F | COA > 25F: NC or CHX | 95.0 | 25.9 | 48.2 | -0.7 | 22.0 | 15.0 | -1.7 |
| 443 | TXV NC 0.3% 115F | COA > 23F: NC or CHX | 114.9 | 23.8 | 50.0 | 11.4 | 18.1 | 11.1 | -2.6 |
| 444 | TXV NC 0.3% 75F | COA > 26F: NC or CHX | 75.0 | 26.4 | 45.0 | -11.0 | 24.7 | 17.7 | 0.3 |
| 445 | TXV NC 0.3% 55F | COA > 28F: NC or CHX | 55.1 | 28.9 | 40.0 | -7.3 | 28.2 | 21.2 | 0.4 |

Figure 16

| # | Intertek Lab Test | RSD Method | OAT | COA | EST | DSH | ASC | DSC | DTS |
|---|---|---|---|---|---|---|---|---|---|
| 446 | TXV RR 95F | EST < 32F: RR or EHX | 94.8 | 15.4 | 30.1 | 40.9 | 12.8 | 5.8 | -9.0 |
| 447 | TXV RR 115F | EST < 43F: RR or EHX | 114.8 | 16.5 | 38.3 | 43.8 | 12.0 | 5.0 | -7.8 |
| 448 | TXV RR 75F | EST < 16F: RR or EHX | 75.0 | 10.5 | 15.3 | 40.5 | 9.0 | 2.0 | -10.3 |
| 449 | TXV RR 55F | EST < 5F: RR or EHX | 55.0 | 9.9 | 4.8 | 35.0 | 9.3 | 2.3 | -9.8 |
| 450 | NT Base no NC | Verified RCA | 95.0 | 15.5 | 46.9 | 4.1 | 9.3 | 2.3 | -1.1 |
| 451 | NT NC 0.3% | COA > 25F: NC or CHX | 95.0 | 27.0 | 49.4 | -3.5 | 24.4 | 17.4 | -0.2 |
| 452 | NT NC 0.3% | COA > 25F: NC or CHX | 95.0 | 25.6 | 48.2 | 0.6 | 22.8 | 15.8 | -0.6 |
| 453 | NT NC 1% | COA > 25F: NC or CHX | 95.0 | 41.6 | 50.6 | 0.6 | 40.4 | 33.4 | -0.9 |
| 454 | NT Base Cond | Verified RCA | 95.0 | 15.8 | 47.5 | 1.3 | 9.6 | 2.6 | -0.6 |
| 455 | NT 30% Cond Blk | CHX fault | 95.1 | 19.1 | 48.2 | -5.6 | 10.1 | 3.1 | -0.6 |
| 456 | NT 50% Cond Blk | CHX fault | 95.0 | 23.3 | 48.8 | -10.1 | 9.6 | 2.6 | -0.8 |
| 457 | NT 80% Cond Blk | CHX fault | 95.0 | 40.6 | 50.6 | -10.4 | 5.7 | -1.3 | -1.6 |
| 458 | NT base 30% CC Blk | CHX fault | 95.0 | 17.4 | 46.3 | -1.1 | 7.0 | 0.0 | 1.3 |
| 459 | NT -10% chg 30% CB | CHX fault, UC: 8% | 95.0 | 13.0 | 39.0 | 25.1 | -0.1 | -7.1 | -3.1 |
| 460 | NT -20% chg 30% CB | CHX fault, UC: 16% | 95.0 | 11.1 | 30.8 | 37.6 | -0.3 | -7.3 | -6.1 |
| 461 | NT Factory Chg 82F | Verified RCA | 82.0 | 16.3 | 44.3 | 4.5 | 13.5 | 6.5 | -1.8 |
| 462 | NT -5% 82F | MIN - Verified RCA (5%) | 82.0 | 13.8 | 42.0 | 12.1 | 9.5 | 2.5 | -3.2 |
| 463 | NT -10% 82F | Detect UC: 8% | 82.1 | 11.5 | 38.3 | 19.2 | 5.6 | -1.4 | -4.9 |
| 464 | NT -20% 82F | Detect UC: 23% | 82.0 | 7.8 | 23.5 | 39.4 | 1.2 | -5.8 | -9.9 |
| 465 | NT -30% 82F | Detect UC: 28% | 82.0 | 5.5 | 14.0 | 45.9 | -0.8 | -7.8 | -11.9 |
| 466 | NT -40% 82F | Detect UC: 40% | 82.0 | 3.5 | 7.0 | 57.4 | -1.3 | -8.3 | -14.1 |
| 467 | NT +10% 82F | Detect OC: 8% | 82.0 | 23.7 | 47.5 | -17.9 | 22.5 | 15.5 | -0.2 |
| 468 | NT +20% 82F | Detect OC: 10% | 82.0 | 24.4 | 47.5 | -17.8 | 23.3 | 16.3 | -0.1 |
| 469 | NT +30% 82F | Detect OC: 13% | 82.0 | 26.0 | 47.5 | -17.0 | 24.4 | 17.4 | -0.2 |
| 470 | NT +40% 82F | Detect OC: 33% | 82.0 | 32.8 | 47.5 | -17.0 | 31.5 | 24.5 | -0.7 |
| 471 | NT Pkg 1C Base FC | MIN - Verified RCA | 95.0 | 21.0 | 46.0 | 17.1 | 12.5 | 2.5 | -3.4 |
| 472 | NT Pkg 1C +20% EB 20% | Low airflow and OC: 12% | 95.0 | 25.9 | 46.0 | 2.8 | 20.3 | 10.3 | -4.0 |
| 473 | NT Pkg 1C -20% | Detect UC: 18% | 95.0 | 18.0 | 42.3 | 27.7 | 6.8 | -3.2 | -4.6 |
| 474 | NT Pkg 1C -30% | Detect UC: 27% | 95.0 | 15.8 | 39.0 | 31.8 | 1.9 | -8.1 | -6.1 |
| 475 | NT Pkg 1C -40% | Detect UC: 40% | 95.0 | 14.3 | 34.0 | 37.7 | 0.5 | -9.5 | -8.0 |
| 476 | TXV Pkg 1C Base FC | Verified RCA | 95.0 | 11.1 | 44.3 | 17.0 | 6.1 | -0.9 | -2.2 |
| 477 | TXV Pkg 1C -10% | Detect UC: 9% | 95.0 | 10.1 | 44.3 | 17.9 | 2.1 | -4.9 | -2.8 |
| 478 | TXV Pkg 1C -20% | Detect UC: 15% | 95.0 | 9.1 | 44.0 | 22.7 | 0.5 | -6.5 | -3.4 |
| 479 | TXV Pkg 1C -30% | Detect UC: 23% | 95.0 | 7.4 | 41.0 | 28.2 | -0.1 | -7.1 | -5.1 |
| 480 | TXV Pkg 1C -40% | Detect UC: 40% | 95.0 | 5.7 | 34.7 | 36.8 | -0.4 | -7.4 | -8.5 |
| 481 | TXV Pkg 2C FC C1 | Verified RCA | 95.1 | 12.9 | 43.0 | 10.1 | 0.8 | -9.2 | -0.2 |
| 482 | TXV Pkg 2C FC C2 | Verified RCA | 95.1 | 16.3 | 45.0 | 9.2 | 10.0 | 0.0 | -0.2 |
| 483 | TXV Pkg 2C -10% | Detect UC: 7% | 95.1 | 10.6 | 43.0 | 14.8 | -0.2 | -10.2 | -0.6 |
| 484 | TXV Pkg 2C -10% | MIN - Verified RCA (5%) | 95.1 | 13.5 | 45.6 | 12.2 | 1.5 | -8.5 | -0.6 |
| 485 | TXV Pkg 2C -20% | Detect UC: 20% | 95.0 | 9.4 | 41.0 | 27.9 | -0.4 | -10.4 | -1.1 |
| 486 | TXV Pkg 2C -20% | Detect UC: 15% | 95.0 | 11.0 | 45.6 | 23.3 | 0.3 | -9.7 | -1.1 |
| 487 | TXV Pkg 2C -30% | Detect UC: 30% | 95.0 | 7.7 | 36.9 | 35.0 | -0.4 | -10.4 | -2.4 |
| 488 | TXV Pkg 2C -30% | Detect UC: 23% | 95.0 | 8.8 | 42.3 | 30.3 | 0.3 | -9.7 | -2.4 |
| 489 | TXV Pkg 2C -40% | Detect UC: 40% | 95.0 | 4.7 | 28.0 | 41.3 | -0.3 | -10.4 | -5.0 |
| 490 | TXV Pkg 2C -40% | Detect UC: 38% | 95.0 | 5.7 | 36.0 | 40.2 | 0.3 | -9.7 | -5.0 |

Figure 17

| # | Intertek Lab Test | NTD Method | RSD Method | Known TS Method | Known RC Method |
|---|---|---|---|---|---|
| 501 | NT 100% Charge | Verified RCA | Verified RCA | Airflow Correct | Correct Charge |
| 502 | NT +5% Charge | OK Airflow: Detect OC | MIN - Verified RCA (5%) | ***Missed Detection*** | Remove refrigerant |
| 503 | NT +10% Charge | OK Airflow: Detect OC | Detect OC: 10% | ***Missed Detection*** | Remove refrigerant |
| 504 | NT +20% Charge | OK Airflow: Detect OC | Detect OC: 12% | ***Missed Detection*** | Remove refrigerant |
| 505 | NT +30% Charge | OK Airflow: Detect OC | Detect OC: 14% | ***Missed Detection*** | Remove refrigerant |
| 506 | NT +40% Charge | OK Airflow: Detect OC | Detect OC: 18% | ***Missed Detection*** | Remove refrigerant |
| 507 | NT 100% Charge | Verified RCA | Verified RCA | Airflow Correct | Correct Charge |
| 508 | NT -5% Charge | MIN – Verified RCA (4%) | MIN - Verified RCA (3%) | ***Missed Detection*** | Add refrigerant |
| 509 | NT -10% Charge | Detect UC: 12% | Detect UC: 12% | ***Missed Detection*** | Add refrigerant |
| 510 | NT -20% Charge | Detect UC: 18% | Detect UC: 19% | ***Missed Detection*** | Add refrigerant |
| 511 | NT -30% Charge | Detect UC: 32% | Detect UC: 31% | ***Missed Detection*** | Add refrigerant |
| 512 | NT -40% Charge | Detect UC: 38% | Detect UC: 39% | ***Missed Detection*** | Add refrigerant |
| 513 | NT 10.1% low airflow | Low Airflow | Low airflow | ***Missed Detection*** | Correct Charge |
| 514 | NT 22.8% low airflow | Low Airflow | Low airflow | Increase Fan Speed | Correct Charge |
| 515 | NT 36.1% low airflow | Low Airflow | Low airflow | Increase Fan Speed | Correct Charge |
| 516 | TXV Base | Verified RCA | Verified RCA | Airflow Correct | Correct Charge |
| 517 | TXV +5% Charge | OK Airflow: Detect OC | MIN - Verified RCA (1%) | ***Missed Detection*** | ***Misdiagnosis*** |
| 518 | TXV +10% Charge | OK Airflow: Detect OC | Detect OC: 8% | ***Missed Detection*** | Remove refrigerant |
| 519 | TXV +20% Charge | OK Airflow: Detect OC | Detect OC: 16% | ***Missed Detection*** | Remove refrigerant |
| 520 | TXV +30% Charge | OK Airflow: Detect OC | Detect OC: 30% | ***Missed Detection*** | Remove refrigerant |
| 521 | TXV +40% Charge | OK Airflow: Detect OC | Detect OC: 25% | ***Missed Detection*** | Remove refrigerant |
| 522 | TXV Base | Verified RCA | Verified RCA | Airflow Correct | Correct Charge |
| 523 | TXV -5% Charge | MIN – Verified RCA (4%) | MIN - Verified RCA (1%) | ***Missed Detection*** | Add refrigerant |
| 524 | TXV -10% Charge | Detect UC: 8% | Detect UC: 9% | ***Missed Detection*** | Add refrigerant |
| 525 | TXV -20% Charge | Detect UC: 19% | Detect UC: 20% | ***Missed Detection*** | Add refrigerant |
| 526 | TXV -30% Charge | Detect UC: 28% | Detect UC: 28% | ***Missed Detection*** | Add refrigerant |
| 527 | TXV -40% Charge | Detect UC: 42% | Detect UC: 40% | ***Missed Detection*** | Add refrigerant |
| 528 | NT Base | Verified RCA | Verified RCA | Airflow Correct | Correct Charge |
| 529 | NT 35% Evap Block | Low Airflow | Chk EHX, EA | ***Missed Detection*** | ***Misdiagnosis*** |
| 530 | NT 50% Evap Block | Low Airflow | Chk EHX, EA | ***Missed Detection*** | ***Misdiagnosis*** |
| 531 | NT Base | Verified RCA | Verified RCA | Airflow Correct | Correct Charge |
| 532 | NT RR 95F | Detect RR, EHX, UC | EST < 35F: RR or EHX | ***Misdiagnosis*** | ***Misdiagnosis*** |
| 533 | NT RR 115F | Detect RR, EHX, UC | EST < 44F: RR or EHX | ***Misdiagnosis*** | ***Misdiagnosis*** |
| 534 | NT RR 75F | Detect RR, EHX, UC | EST < 19F: RR or EHX | ***Misdiagnosis*** | ***Misdiagnosis*** |
| 535 | NT RR 55F | Detect RR, EHX, UC | EST < 6F: RR or EHX | ***Misdiagnosis*** | ***Misdiagnosis*** |
| 536 | NT NC Dirty Oil 95F | Detect NC | COA > 25F: NC or CHX | ***Misdiagnosis*** | ***Misdiagnosis*** |
| 537 | NT NC 0.3% 95F | Detect NC | COA > 25F: NC or CHX | ***Missed Detection*** | ***Missed Detection*** |
| 538 | NT NC 0.3% 115F | Detect NC | COA > 21F: NC or CHX | ***Missed Detection*** | ***Misdiagnosis*** |
| 539 | NT NC 0.3% 75F | Detect NC | COA > 25F: NC or CHX | ***Misdiagnosis*** | ***Missed Detection*** |
| 540 | NT NC 0.3% 55F | Detect NC | COA > 28F: NC or CHX | ***Misdiagnosis*** | ***Misdiagnosis*** |
| 541 | TXV 95F Base | Verified RCA | Verified RCA | Airflow Correct | Correct Charge |
| 542 | TXV NC 0.3% 95F | Detect NC | COA > 25F: NC or CHX | ***Missed Detection*** | ***Missed Detection*** |
| 543 | TXV NC 0.3% 115F | Detect NC | COA > 23F: NC or CHX | ***Missed Detection*** | ***Misdiagnosis*** |
| 544 | TXV NC 0.3% 75F | Detect NC | COA > 26F: NC or CHX | ***Missed Detection*** | ***Misdiagnosis*** |
| 545 | TXV NC 0.3% 55F | Detect NC | COA > 28F: NC or CHX | ***Missed Detection*** | ***Misdiagnosis*** |

Figure 18

| # | Intertek Lab Test | NTD Method | RSD Method | Known TS Method | Known RC Method |
|---|---|---|---|---|---|
| 546 | TXV RR 95F | Detect RR, EHX, UC, TXV | EST < 32F: RR or EHX | *Misdiagnosis* | *Misdiagnosis* |
| 547 | TXV RR 115F | Detect RR, EHX, UC, TXV | EST < 43F: RR or EHX | *Misdiagnosis* | *Misdiagnosis* |
| 548 | TXV RR 75F | Detect RR, EHX, UC, TXV | EST < 16F: RR or EHX | *Misdiagnosis* | *Misdiagnosis* |
| 549 | TXV RR 55F | Detect RR, EHX, UC, TXV | EST < 5F: RR or EHX | *Misdiagnosis* | *Missed Detection* |
| 550 | NT Base no NC | Verified RCA | Verified RCA | Airflow Correct | *Missed Detection* |
| 551 | NT NC 0.3% | Detect NC | COA > 25F: NC or CHX | *Missed Detection* | *Missed Detection* |
| 552 | NT NC 0.3% | Detect NC | COA > 25F: NC or CHX | *Missed Detection* | *Missed Detection* |
| 553 | NT NC 1% | Detect NC | COA > 25F: NC or CHX | *Missed Detection* | *Missed Detection* |
| 554 | NT Base Cond | Verified RCA | Verified RCA | Airflow Correct | Correct Charge |
| 555 | NT 30% Cond Blk | Clean CC | CHX fault | *Missed Detection* | *Missed Detection* |
| 556 | NT 50% Cond Blk | Clean CC | CHX fault | *Missed Detection* | *Misdiagnosis* |
| 557 | NT 80% Cond Blk | Clean CC | CHX fault | *Missed Detection* | *Misdiagnosis* |
| 558 | NT 30% Cond Blk | Clean CC | CHX fault | *Missed Detection* | *Misdiagnosis* |
| 559 | NT -10% chg 30% CB | Clean CC Detect UC: 4% | CHX fault, UC: 8% | *Misdiagnosis* | *Missed Detection* |
| 560 | NT -20% chg 30% CB | Clean CC Detect UC: 10% | CHX fault, UC: 16% | *Misdiagnosis* | Add refrigerant |
| 561 | NT Fact chg 82F | Verified RCA | Verified RCA | Airflow Correct | *Misdiagnosis* |
| 562 | NT -5% 82F | MIN – Verified RCA (4%) | MIN - Verified RCA (5%) | *Misdiagnosis* | Correct Charge |
| 563 | NT -10% 82F | Detect UC: 7% | Detect UC: 8% | *Misdiagnosis* | Add refrigerant |
| 564 | NT -20% 82F | Detect UC: 21% | Detect UC: 23% | *Misdiagnosis* | Add refrigerant |
| 565 | NT -30% 82F | Detect UC: 29% | Detect UC: 28% | *Misdiagnosis* | Add refrigerant |
| 566 | NT -40% 82F | Detect UC: 38% | Detect UC: 40% | *Misdiagnosis* | Add refrigerant |
| 567 | NT +10% 82F | OK Airflow: Detect OC | Detect OC: 8% | *Missed Detection* | Remove refrigerant |
| 568 | NT +20% 82F | OK Airflow: Detect OC | Detect OC: 10% | *Missed Detection* | Remove refrigerant |
| 569 | NT +30% 82F | OK Airflow: Detect OC | Detect OC: 13% | *Missed Detection* | Remove refrigerant |
| 570 | NT +40% 82F | OK Airflow: Detect OC | Detect OC: 33% | *Missed Detection* | Remove refrigerant |
| 571 | NT Pkg 1C Base FC | Low capacity | MIN - Verified RCA | *Missed Detection* | *Misdiagnosis* |
| 572 | NT Pkg 1C +20% EB 20% | Detect low airflow and OC | Low airflow and OC: 12% | *Misdiagnosis* | *Missed Detection* |
| 573 | NT Pkg 1C -20% | Detect UC: 20% | Detect UC: 18% | *Missed Detection* | Add refrigerant |
| 574 | NT Pkg 1C -30% | Detect UC: 26% | Detect UC: 27% | *Missed Detection* | Add refrigerant |
| 575 | NT Pkg 1C -40% | Detect UC: 34% | Detect UC: 40% | *Missed Detection* | Add refrigerant |
| 576 | TXV Pkg 1C Base FC | Verified RCA | Verified RCA | Airflow Correct | Correct Charge |
| 577 | TXV Pkg 1C -10% | Detect UC: 13% | Detect UC: 9% | *Missed Detection* | Add refrigerant |
| 578 | TXV Pkg 1C -20% | Detect UC: 16% | Detect UC: 15% | *Missed Detection* | Add refrigerant |
| 579 | TXV Pkg 1C -30% | Detect UC: 24% | Detect UC: 23% | *Missed Detection* | Add refrigerant |
| 580 | TXV Pkg 1C -40% | Detect UC: 40% | Detect UC: 40% | *Missed Detection* | Add refrigerant |
| 581 | TXV Pkg 2C FC C1 | Verified RCA | Verified RCA | Airflow Correct | *Misdiagnosis* |
| 582 | TXV Pkg 2C FC C2 | Verified RCA | Verified RCA | Airflow Correct | Correct Charge |
| 583 | TXV Pkg 2C -10% | Detect UC: 6% | Detect UC: 7% | *Missed Detection* | Add refrigerant |
| 584 | TXV Pkg 2C -10% | Detect UC: 6% | MIN - Verified RCA (5%) | *Missed Detection* | Add refrigerant |
| 585 | TXV Pkg 2C -20% | Detect UC: 10% | Detect UC: 20% | *Missed Detection* | Add refrigerant |
| 586 | TXV Pkg 2C -20% | Detect UC: 10% | Detect UC: 15% | *Missed Detection* | Add refrigerant |
| 587 | TXV Pkg 2C -30% | Detect UC: 22% | Detect UC: 30% | *Missed Detection* | Add refrigerant |
| 588 | TXV Pkg 2C -30% | Detect UC: 22% | Detect UC: 23% | *Missed Detection* | Add refrigerant |
| 589 | TXV Pkg 2C -40% | Detect UC: 40% | Detect UC: 40% | *Misdiagnosis* | Add refrigerant |
| 590 | TXV Pkg 2C -40% | Detect UC: 40% | Detect UC: 38% | *Misdiagnosis* | Add refrigerant |

Figure 19

| Return-air Wetbulb Temperature (RWT) (F) | 62 | 63 | 65 | 66 | 67 | 68 | 69 | 70 | 71 | 72 | 73 | 74 | 75 | 76 | 78 | 80 | 82 | 84 | |
|---|---|---|---|---|---|---|---|---|---|---|---|---|---|---|---|---|---|---|---|
| 50 | 16.5 | 17.0 | 18.1 | 18.6 | 19.2 | 19.7 | 20.3 | 20.8 | 21.4 | 22.0 | 22.5 | 23.1 | 23.6 | 24.2 | | | | | 50 |
| 51 | 16.4 | 16.9 | 18.0 | 18.5 | 19.1 | 19.6 | 20.2 | 20.7 | 21.3 | 21.8 | 22.4 | 23.0 | 23.5 | 24.1 | | | | | 51 |
| 52 | 16.2 | 16.7 | 17.8 | 18.4 | 18.9 | 19.5 | 20.0 | 20.6 | 21.1 | 21.7 | 22.2 | 22.8 | 23.3 | 23.9 | | | | | 52 |
| 53 | 16.0 | 16.5 | 17.6 | 18.2 | 18.7 | 19.3 | 19.8 | 20.4 | 20.9 | 21.5 | 22.0 | 22.6 | 23.1 | 23.7 | 24.8 | | | | 53 |
| 54 | 15.8 | 16.3 | 17.4 | 17.9 | 18.5 | 19.0 | 19.6 | 20.1 | 20.7 | 21.2 | 21.8 | 22.3 | 22.9 | 23.4 | 24.5 | | | | 54 |
| 55 | 15.5 | 16.0 | 17.1 | 17.7 | 18.2 | 18.7 | 19.3 | 19.8 | 20.4 | 20.9 | 21.5 | 22.0 | 22.6 | 23.1 | 24.2 | | | | 55 |
| 56 | 15.2 | 15.7 | 16.8 | 17.3 | 17.9 | 18.4 | 19.0 | 19.5 | 20.0 | 20.6 | 21.1 | 21.7 | 22.2 | 22.8 | 23.9 | 25.0 | | | 56 |
| 57 | 14.8 | 15.3 | 16.4 | 16.9 | 17.5 | 18.0 | 18.6 | 19.1 | 19.7 | 20.2 | 20.8 | 21.3 | 21.9 | 22.4 | 23.5 | 24.6 | | | 57 |
| 58 | 14.4 | 14.9 | 16.0 | 16.5 | 17.1 | 17.6 | 18.1 | 18.7 | 19.2 | 19.8 | 20.3 | 20.9 | 21.4 | 22.0 | 23.1 | 24.2 | 25.3 | | 58 |
| 59 | 13.9 | 14.4 | 15.5 | 16.1 | 16.6 | 17.1 | 17.7 | 18.2 | 18.8 | 19.3 | 19.9 | 20.4 | 20.9 | 21.5 | 22.6 | 23.7 | 24.8 | 25.9 | 59 |
| 60 | | 13.9 | 15.0 | 15.5 | 16.1 | 16.6 | 17.2 | 17.7 | 18.2 | 18.8 | 19.3 | 19.9 | 20.4 | 21.0 | 22.1 | 23.2 | 24.3 | 25.4 | 60 |
| 61 | | | 14.5 | 15.0 | 15.5 | 16.1 | 16.6 | 17.1 | 17.7 | 18.2 | 18.8 | 19.3 | 19.9 | 20.4 | 21.5 | 22.6 | 23.7 | 24.8 | 61 |
| 62 | | | 13.9 | 14.4 | 14.9 | 15.5 | 16.0 | 16.5 | 17.1 | 17.6 | 18.2 | 18.7 | 19.2 | 19.8 | 20.9 | 22.0 | 23.1 | 24.2 | 62 |
| 63 | | | | 13.7 | 14.3 | 14.8 | 15.4 | 15.9 | 16.4 | 17.0 | 17.5 | 18.1 | 18.6 | 19.1 | 20.2 | 21.3 | 22.4 | 23.5 | 63 |
| 64 | | | | | 13.6 | 14.1 | 14.7 | 15.2 | 15.7 | 16.3 | 16.8 | 17.4 | 17.9 | 18.4 | 19.5 | 20.6 | 21.7 | 22.8 | 64 |
| 65 | | | | | | 13.4 | 13.9 | 14.5 | 15.0 | 15.5 | 16.1 | 16.6 | 17.2 | 17.7 | 18.8 | 19.9 | 21.0 | 22.1 | 65 |
| 66 | | | | | | | 13.1 | 13.7 | 14.2 | 14.7 | 15.3 | 15.8 | 16.4 | 16.9 | 18.0 | 19.1 | 20.2 | 21.3 | 66 |
| 67 | | | | | | | | 12.8 | 13.4 | 13.9 | 14.5 | 15.0 | 15.5 | 16.1 | 17.2 | 18.2 | 19.3 | 20.4 | 67 |
| 68 | | | | | | | | | 12.5 | 13.0 | 13.6 | 14.1 | 14.7 | 15.2 | 16.3 | 17.4 | 18.4 | 19.5 | 68 |
| 69 | | | | | | | | | | 12.1 | 12.7 | 13.2 | 13.7 | 14.3 | 15.3 | 16.4 | 17.5 | 18.6 | 69 |
| 70 | | | | | | | | | | | 11.7 | 12.2 | 12.8 | 13.3 | 14.4 | 15.5 | 16.5 | 17.6 | 70 |
| 71 | | | | | | | | | | | | 11.2 | 11.8 | 12.3 | 13.4 | 14.4 | 15.5 | 16.6 | 71 |
| 72 | | | | | | | | | | | | | 10.7 | 11.2 | 12.3 | 13.4 | 14.5 | 15.5 | 72 |
| 73 | | | | | | | | | | | | | | 10.1 | 11.2 | 12.3 | 13.3 | 14.4 | 73 |
| 74 | | | | | | | | | | | | | | | 10.0 | 11.1 | 12.2 | 13.3 | 74 |
| 75 | | | | | | | | | | | | | | | 8.9 | 9.9 | 11.0 | 12.1 | 75 |
| 76 | | | | | | | | | | | | | | | | 8.7 | 9.7 | 10.8 | 76 |
| | 62 | 63 | 65 | 66 | 67 | 68 | 69 | 70 | 71 | 72 | 73 | 74 | 75 | 76 | 78 | 80 | 82 | 84 | |

Return-air Drybulb Temperature (RDT) (F)

Figure 21

| Outdoor Air Temperature (OAT) (F) | 50 | 52 | 54 | 56 | 58 | 60 | 62 | 64 | 66 | 68 | 70 | 72 | 74 | 76 | |
|---|---|---|---|---|---|---|---|---|---|---|---|---|---|---|---|
| 55 | 8.8 | 11.5 | 14.2 | 17.1 | 20.0 | 23.1 | 26.2 | 29.4 | 32.4 | 35.1 | 37.7 | 40.2 | 42.7 | 45.0 | 55 |
| 57 | 8.3 | 11.0 | 13.7 | 16.5 | 19.4 | 22.3 | 25.3 | 28.3 | 31.3 | 34.0 | 36.7 | 39.2 | 41.7 | 44.2 | 57 |
| 59 | 7.5 | 10.2 | 13.0 | 15.8 | 18.6 | 21.4 | 24.3 | 27.2 | 30.1 | 32.9 | 35.6 | 38.3 | 40.8 | 43.3 | 59 |
| 61 | 6.5 | 9.3 | 12.1 | 14.9 | 17.7 | 20.5 | 23.3 | 26.1 | 29.0 | 31.8 | 34.6 | 37.3 | 39.9 | 42.4 | 61 |
| 63 | 5.3 | 8.3 | 11.1 | 14.0 | 16.8 | 19.6 | 22.3 | 25.0 | 27.8 | 30.7 | 33.6 | 36.3 | 39.0 | 41.6 | 63 |
| 65 | | 7.0 | 10.0 | 12.9 | 15.8 | 18.5 | 21.2 | 23.8 | 26.7 | 29.7 | 32.5 | 35.3 | 38.1 | 40.8 | 65 |
| 67 | | 5.5 | 8.7 | 11.7 | 14.6 | 17.4 | 20.1 | 22.7 | 25.6 | 28.6 | 31.5 | 34.4 | 37.2 | 39.9 | 67 |
| 69 | | | 7.2 | 10.4 | 13.4 | 16.3 | 19.0 | 21.5 | 24.4 | 27.5 | 30.5 | 33.4 | 36.3 | 39.1 | 69 |
| 71 | | | 5.6 | 8.9 | 12.1 | 15.0 | 17.8 | 20.3 | 23.3 | 26.4 | 29.5 | 32.5 | 35.4 | 38.3 | 71 |
| 73 | | | | 7.3 | 10.7 | 13.7 | 16.6 | 19.2 | 22.2 | 25.4 | 28.5 | 31.5 | 34.6 | 37.5 | 73 |
| 75 | | | | 5.6 | 9.2 | 12.4 | 15.3 | 18.0 | 21.1 | 24.3 | 27.5 | 30.6 | 33.7 | 36.7 | 75 |
| 77 | | | | | 7.5 | 11.0 | 14.0 | 16.8 | 20.0 | 23.2 | 26.5 | 29.7 | 32.8 | 36.0 | 77 |
| 79 | | | | | 5.9 | 9.5 | 12.7 | 15.6 | 18.8 | 22.2 | 25.5 | 28.8 | 32.0 | 35.2 | 79 |
| 81 | | | | | | 7.9 | 11.3 | 14.3 | 17.7 | 21.1 | 24.5 | 27.9 | 31.2 | 34.4 | 81 |
| 83 | | | | | | 6.3 | 9.9 | 13.1 | 16.6 | 20.1 | 23.5 | 26.9 | 30.3 | 33.7 | 83 |
| 85 | | | | | | | 8.5 | 11.9 | 15.5 | 19.0 | 22.6 | 26.0 | 29.5 | 32.9 | 85 |
| 87 | | | | | | | 7.0 | 10.6 | 14.4 | 18.0 | 21.6 | 25.1 | 28.7 | 32.2 | 87 |
| 89 | | | | | | | 5.5 | 9.4 | 13.3 | 17.0 | 20.6 | 24.3 | 27.9 | 31.5 | 89 |
| 91 | | | | | | | | 8.1 | 12.2 | 15.9 | 19.7 | 23.2 | 27.1 | 30.8 | 91 |
| 93 | | | | | | | | 6.8 | 11.1 | 14.9 | 18.7 | 22.5 | 26.3 | 30.1 | 93 |
| 95 | | | | | | | | 5.6 | 10.0 | 13.9 | 17.8 | 21.6 | 25.5 | 29.4 | 95 |
| 97 | | | | | | | | | 8.9 | 12.9 | 16.8 | 20.8 | 24.7 | 28.7 | 97 |
| 99 | | | | | | | | | 7.9 | 11.9 | 15.9 | 19.9 | 24.0 | 28.0 | 99 |
| 101 | | | | | | | | | 6.8 | 10.9 | 15.0 | 19.1 | 23.2 | 27.3 | 101 |
| 103 | | | | | | | | | 5.7 | 9.9 | 14.0 | 18.2 | 22.4 | 26.7 | 103 |
| 105 | | | | | | | | | | 8.8 | 13.1 | 17.4 | 21.7 | 26.0 | 105 |
| 107 | | | | | | | | | | 7.9 | 12.2 | 16.6 | 21.0 | 25.4 | 107 |
| 109 | | | | | | | | | | 6.9 | 11.3 | 15.7 | 20.2 | 24.7 | 109 |
| 111 | | | | | | | | | | 5.9 | 10.4 | 14.9 | 19.5 | 24.1 | 111 |
| 113 | | | | | | | | | | | 9.5 | 14.1 | 18.8 | 23.5 | 113 |
| 115 | | | | | | | | | | | 8.6 | 13.3 | 18.1 | 22.9 | 115 |
| | 50 | 52 | 54 | 56 | 58 | 60 | 62 | 64 | 66 | 68 | 70 | 72 | 74 | 76 | |

Return-air Wetbulb Temperature (RWT) (F)

Figure 22

| Non-TXV % Under Charge at 95°F OAT [a] | Non-TXV EER* Intertek Test [b] | Non-TXV EER* Intertek Impact [c] | Non-TXV Actual Temp. Split (ATS) [d] | Non-TXV EER*$_{TS}$ Calculated Impact [e] |
|---|---|---|---|---|
| NT 0% UC | 7.02 | 0.0% | 17.2 | 0 |
| NT 7.5% UC | 5.55 | -21.0% | 13.3 | -18.9% |
| NT 10% UC | 4.79 | -31.9% | 11.3 | -28.7% |
| NT 20% UC | 4.09 | -41.7% | 9.4 | -38.3% |
| NT 30% UC | 2.42 | -65.5% | 5.6 | -56.7% |
| NT 40% UC | 1.82 | -74.0% | 4.2 | -63.4% |

Figure 23

| Non-TXV % Under Charge at 82°F OAT [a] | Non-TXV EER* Intertek Test [b] | Non-TXV EER* Intertek Impact [c] | Non-TXV Actual Temp Split (ATS) [d] | Non-TXV EER*$_{TS}$ Calculated Impact [e] |
|---|---|---|---|---|
| NT 0% UC | 7.43 | 0.0% | 16.5 | 0 |
| NT 7.5% UC | 6.67 | -10.2% | 14.2 | -11.3% |
| NT 10% UC | 6.33 | -14.8% | 13.4 | -15.8% |
| NT 20% UC | 4.19 | -43.6% | 8.4 | -41.0% |
| NT 30% UC | 3.09 | -58.3% | 6.4 | -51.5% |
| NT 40% UC | 2.17 | -70.8% | 4.2 | -62.4% |

Figure 24

| TXV % Under Charge at 95°F OAT [a] | TXV EER* Intertek Test [b] | TXV EER* Intertek Impact [c] | TXV Actual Temp. Split (ATS) [d] | TXV EER*$_{TS}$ Calculated Impact [e] |
|---|---|---|---|---|
| TXV 0% UC | 7.17 | 0.0% | 18.1 | 0 |
| TXV 7.5% UC | 6.62 | -7.7% | 16.6 | -7.0% |
| TXV 10% UC | 6.42 | -10.4% | 15.9 | -9.9% |
| TXV 20% UC | 5.35 | -25.4% | 12.6 | -25.3% |
| TXV 30% UC | 4.25 | -40.7% | 9.7 | -38.8% |
| TXV 40% UC | 2.38 | -66.9% | 5.4 | -58.9% |

Figure 25

| AC System Fault at 95°F OAT [a] | Non-TXV EER* Intertek Test [b] | Non-TXV EER* Intertek Impact [c] | Non-TXV Actual Temp Split (ATS) [d] | Non-TXV EER*$_{TS}$ Calculated Impact [e] |
|---|---|---|---|---|
| NT Base FC Base | 7.02 | 0.0% | 17.2 | 0.0% |
| NT 20% UC 30% Cond. Blk | 4.02 | -42.7% | 12.2 | -24.6% |
| NT NC 0.3% | 5.76 | -18.0% | 15.3 | -9.3% |
| NT RR | 4.42 | -37.1% | 10.5 | -32.8% |
| NT 22.8% Low Airflow | 6.29 | -10.4% | 23.1 | 28.6% |
| NT 30% Cond Block | 6.03 | -14.2% | 19.6 | 11.9% |

Figure 26

NON-INVASIVE TEMPERATURE-BASED DIAGNOSTIC METHOD

REFERENCE TO RELATED APPLICATIONS

The present application claims the priority of U.S. Provisional Patent Application Ser. No. 63/406,518 filed Sep. 14, 2022, which application is incorporated in its entirety herein by reference.

TECHNICAL FIELD

This patent specification relates to systems, methods, and related computer software products for evaluating the performance of Direct Expansion (DX) Air Conditioning (AC) cooling or Heat Pump (HP) heating and cooling systems to improve cooling and/or heating system capacity and energy efficiency.

BACKGROUND OF THE INVENTION

Buildings are cooled and/or heated by Heating, Ventilating, Air Conditioning (HVAC) systems to maintain comfortable conditions for occupants. Low airflow or low cooling and/or heating capacity reduce thermal comfort and efficiency and increase operating time and energy use. HVAC system manufacturers provide a known weight of refrigerant charge referred to as a Factory Charge (FC). The FC helps achieve a rated cooling capacity for an Air Conditioning (AC) system or a rated heating capacity for a Heat Pump (HP) system. Manufacturers also provide a minimum design airflow across the evaporator or heat exchanger to provide the rated cooling or heating capacity.

Known methods for diagnosing Refrigerant Charge and Airflow (RCA) require measuring volumetric airflow in cubic feet per minute (cfm), return and supply air temperatures in degrees fahrenheit (F), and refrigerant system pressures in pounds per square inch gauge (psig). Measuring refrigerant system pressures requires connecting and disconnecting refrigerant pressure gauges to Schrader valves.

According to the California Air Resources Board (CARB) and the United States (US) Environmental Protection Agency (EPA), installation, maintenance, and end-of-life replacement of air conditioning systems causes the release of about 30 to 80% of the refrigerant FC into the atmosphere. HVAC equipment refrigerant emissions are the fastest growing global warming pollutant. In 2019, California HVAC equipment accounted for approximately 11-million pounds of refrigerant emissions equivalent to the average annual emissions from 1.5 million passenger cars. To address the climate threat from refrigerants, California State Senate Bill (SB) 1383 was passed to reduce R22 HydroFluoroCarbon (HFC) and R410a HydroChloroFluoroCarbon (HCFC) emissions by 40% in 2030 compared to 2013. California SB 1013 (Lara, 2018) was passed shortly after SB 1383 to define rules and provide incentives to reduce HFC and HCFC use to reach the 2030 emissions reduction goal. Refrigerant R-22 has a Global Warming Potential (GWP) of 1810 pounds (lbs) of Carbon Dioxide (CO2) for 100 years, and R-410a has a GWP of 2088 lbs CO2 for 100 years. According to CARB and EPA, refrigerant venting occurs when technicians connect or disconnect pressure gauges to or from systems which causes 2% of total global warming. CARB. 2022. High-GWP Refrigerants (https://ww2.arb.ca.gov/resources/documents/high-gwp-refrigerants). US EPA "Stationary Refrigeration and Air Conditioning" (https://www.epa.gov/section608).

Known methods of measuring return and supply air temperatures provide an indication of whether the HVAC system is providing proper airflow across an evaporator coil in a cooling mode based on a Temperature Split (TS) equal to a Return-air Drybulb Temperature (RDT) minus a Supply-air Drybulb Temperature (SDT). Known TS methods do not provide information about AC system faults such as a low cooling capacity, a refrigerant Undercharge (UC) or Overcharge (OC), Heat exchanger (HX) faults, a refrigerant restriction, or Non-Condensables (NC) such as air, nitrogen, or water vapor in the AC system. Low capacity increases compressor operating time and electricity use, evaporator HX faults, low airflow, and undercharge reduce cooling capacity and increase compressor operating time and electricity use. Refrigerant overcharge, NC, and condenser HX faults increase condenser pressure and compressor power usage.

In order to evaluate refrigerant system faults, technicians connect and disconnect refrigerant gauges to the Schrader valves of an HVAC system during maintenance. This can cause three unresolved problems: 1) venting refrigerant to the atmosphere which contributes to global warming, 2) introducing non-condensable air and water vapor into the system, and 3) contaminating the refrigerant system with incompatible refrigerants, oils, or other materials.

U.S. Pat. No. 6,223,544 (Seem '544) discloses an integrated control and fault detection system using a finite-state machine controller for an air handling system. A fault condition is reported in response to detecting an abrupt change in the residual which is a function of at least two temperature measurements including: outdoor-air, supply-air, return-air, and mixed-air temperatures.

U.S. Pat. No. 6,701,725 B2 (Rossi et al. '725) discloses a process for estimating the capacity and the performance with measurements of condensing temperature, evaporating temperature, and condenser inlet temperature and using compressor manufacturer's performance data. Measurements and indices are used to detect and diagnose faults by means of decision rules.

U.S. Pat. No. 7,079,967 (Rossi et al. '967) discloses an apparatus and method for detecting faults and providing diagnostic information for a refrigeration system using five sensors and four optional sensors. Rossi '967 requires connecting refrigerant pressure gauges and does not disclose methods to determine a refrigerant UC or OC amount.

U.S. Pat. No. 7,500,368 (Mowris '368) discloses a method for diagnosing and correcting refrigerant charge and airflow faults. Mowris (col. 7:20-50) uses a Delta Temperature Split (DTS) temperature to determine a "low capacity check refrigerant charge" fault for a DTS less than −3 degrees fahrenheit (F), and a "low airflow fault" for a DTS greater than +3F. The DTS is equal to an Actual Temperature Split (ATS) minus a Required Temperature Split (RTS). The ATS (also referred to as a TS) equals the RDT minus the SDT. The RTS is based on a lookup table using the RDT and a Return-air Wetbulb Temperature (RWT). The DTS recommendation to "check refrigerant charge" does not indicate a refrigerant overcharge or undercharge. For AC systems with a Thermostatic Expansion Valve (TXV) wherein the Delta Subcooling (DSC) temperature is greater than +3F or less than −3F, Mowris (col. 10:49-67 or col. 11:14-17) recommends removing or adding refrigerant equal to the DSC times a subcooling factory charge coefficient. For AC systems with a Non-TXV (NT), if a Delta Superheat (DSH) temperature is less than −5F or greater than +5F, Mowris (col. 8:48-52 and col. Sep. 25, 1955) recommends removing or adding refrigerant equal to the DSH times a superheat coefficient times factory charge. The subcooling or superheat coefficients are 0.5, 1.0, or other constant depending on factory charge. Mowris '368 requires connecting refrigerant pressure gauges to determine AC system refrigerant charge faults.

Carrier. 1997. HVAC Servicing Procedures. SK29-01A, 020-040 (Carrier 1997). Carrier 1997, page 145-150, describes a "Proper Airflow Method" based on measuring the Temperature Split (TS) across the evaporator coil of an AC system operating in cooling mode (pp. 149-150 or pp. 7-8 of PDF). Page 150 (9 of PDF) FIG. 7-46 indicates "Airflow Correct 400-450 CFM/TON" when a Delta TS (DTS), defined as an Actual TS (ATS) minus a Required TS (RTS), is within "a tolerance of +/−3F. If the DTS is less than 3F (measured evaporator leaving temperature 3F more than required), decrease the blower speed to bring the temperature within the acceptable range. If the DTS is greater than 3F (ATS is 3F greater than RTS), increase the blower speed to reduce the ATS to within the acceptable range. The known TS method is recommended after the known Refrigerant Charge (RC) method is performed based on a Superheat (SH for the FO) or a Subcooling (SC for the TXV) (pp. 145-149). The known TS method was first required in the 2000 California Energy Commission (CEC) Title 24 standards to check Evaporator Airflow (EA). The Carrier 1997, page 145-148, describes "Checking the Refrigerant Charge Using the Superheat Method" for NT systems and "Checking the Refrigerant Charge Using the Subcooling Method" for T×V systems. For the SH method, FIG. 7-38 (p. 147) indicates "Correctly Charged" when DSH is within +/−5F, "Remove refrigerant" when Suction Temperature (ST) is less than −5F below required (DSH is less than −5F), and "Add refrigerant" when ST is greater than +5F above required (DSH is greater than +5F). For the SC method, FIG. 7-41 (p. 148) indicates "Correctly Charged" when DSC is within +/−3F, "Add refrigerant" when Liquid Temperature (LT) is greater than +3F above required (DSC is less than −3F), and "Remove refrigerant" when LT is less than −3F below required (DSC is greater than +3F). The known TS and the known RC methods based on Carrier 1997 are used for the CEC Refrigerant Charge Airflow (RCA) protocol required by the CEC 2008 Residential and Nonresidential Building Energy Efficiency Standards.

California Energy Commission (CEC). 2008. 2008 Residential Appendices for the Building Energy Efficiency Standards for Residential and Nonresidential Buildings. CEC-400-2008-004-CMF, CEC, Sacramento, CA: pp. RA3-9 to RA3-24 (CEC 2008). CEC 2008 standards provide the known TS and the known RC method disclosed in the Carrier 1997 and Appendix RA3 of the CEC 2008. The TS method is used to check minimum EA in cooling mode (pp. RA3-15, Section RA3.2.2.7). The Superheat (SH) method is used to check the RC in cooling mode for fixed metering devices (pp. RA3-9 through RA3-14, Section RA3.2.2). Actual Superheat (ASH or SH) is equal to the Suction Temperature (ST) minus the Evaporator Saturation Temperature (EST) and EST is based on the refrigerant Suction Pressure (SP). The Subcooling (SC) method is used to check the RC in cooling mode for a TXV (pp. RA3-14 to RA3-15, Section RA3.2.2). Actual Subcooling (ASC) is the Condenser Saturation Temperature (CST) minus a Liquid Temperature (LT) and CST is based on the Liquid Pressure (LP). The Required Subcooling (RSC) is provided by the manufacturer or assumed to be 7 to 10F. The CEC provides a Required Temperature Split (RTS) table based on the RDT and the RWT (pp. RA3-19). The CEC provides a Required Superheat (RSH) table based on the Outdoor Air Temperature (OAT) and the RWT (pp. RA3-17 and RA3-18).

Yuill, David P. and Braun, James E., 2012. "Evaluating Fault Detection and Diagnostics Protocols Applied to Air-Cooled Vapor Compression Air-Conditioners." International Refrigeration and Air Conditioning Conference. Paper 1307. http://docs.lib.purdue.edu/iracc/1307. (Yuill 2012). Yuill evaluated the CEC Refrigerant Charge Airflow (RCA) protocol including the known TS method and the known RC method described in Carrier 1997 and Appendix RA3 of the CEC 2008 Standards. Yuill applied the known TS method to AC systems in cooling mode to evaluate EA faults and applied the known RC methods (SH and SC) to evaluate refrigerant overcharge (OC) or undercharge (UC). Yuill reported the known TS method was 100% accurate for diagnosing EA from −50 to −90%, but less than 60% accurate when diagnosing EA from −10 to −30%. Yuill reported 58% accuracy for the known RC method diagnosing-10 to −40% UC and +10 to +40% OC faults.

California Energy Commission. 2012. 2013 Reference Appendices The Building Energy Efficiency Standards for Residential and Nonresidential Buildings. CEC-400-2012-005-CMF-REV3. (CEC 2013). The CEC 2013 does not require the TS method to check EA due to perceived inaccuracy based on Yuill 2012. Instead, the CEC 2013 (pp. RA3-27-28) requires the following methods to measure EA: 1) supply plenum pressure matching (fan flow meter), 2) flow grid (pitot tube array "TrueFlow"), 3) powered-flow capture hood, or 4) traditional flow capture hood (balometer). CEC 2013 Standards require supply plenum pressure measurements at locations shown in Figure RA3.3-1. These holes were previously used to measure the TS.

Measure Quick discloses a Non Invasive System Test (NIST) without currently connecting SP and LP pressure sensors to the AC system but requires a previous connection of SP and LP pressure sensors. The NIST method uses current temperature measurements of RDT, RWT, SDT, OAT, ST, and LT and prior base line pressure measurements of SP and LP to calculate current virtual SP, LP, ASH, and ASC values to evaluate proper operation. If the current virtual values are outside of recommended values, then pressure sensors are connected to evaluate the AC system based on measuring SP, LP, ASH, and ASC. "NIST testing in measureQuick." Aug. 23, 2023. https://www.youtube.com/watch?v=gOzep_Ayyr0&t=3s.

Joe Marchese. Jan. 8, 2007. "Checking For Noncondensables." ACHR News. (https://www.achrnews.com/articles/102428-checking-for-nondensables. (Marchese 2007). Marchese discloses a method for diagnosing non-condensables in an AC system which requires turning off the compressor but leaving the condenser fan operating and connecting three temperature probes to the discharge line, liquid line, and condenser entering air, and a pressure sensor connected to liquid line. When all three temperature probes are at the same temperature, record the pressure and condenser saturation temperature of the refrigerant in the condenser. If the condenser saturation temperature is 2 degrees fahrenheit (F) greater than the three measured temperatures, then non-condensable nitrogen, air, or water vapor are in the refrigerant system and need to be removed. Marchese recommends checking and correcting other causes of high liquid or discharge pressure including a dirty or blocked condenser coil, insufficient airflow across the condenser, condenser fan motor failure, and recirculation of condenser air. Marchese's non-condensable diagnostic method takes more than 30 minutes.

Known diagnostic methods require a clean and dry condenser coil before performing tests. Microchannel condensers retain water and can take 30 minutes to several hours to dry after cleaning due to their geometry. Known RC methods require guess work with technicians adding or removing small charge amounts which wastes time, provides negligible efficiency improvements, and increases refrigerant venting.

Known TS and RC methods take more time, require more measurement equipment, provide inaccurate or incomplete diagnostic information, and cause environmentally harmful refrigerant leakage or venting to the atmosphere when technicians connect or disconnect pressure gauges to or from AC systems.

SUMMARY OF THE INVENTION

The present invention addresses the above and other needs by providing a Non-invasive Temperature-based Diagnostic (NTD) method which resolves the above problems by diagnosing proper Refrigerant Charge and Airflow (RCA) or Air Conditioning (AC) system faults including a refrigerant Undercharge (UC) or an Overcharge (OC) based only on temperature measurements. If no refrigerant system faults are detected, then there is no need to connect refrigerant pressure sensors to the AC system. If AC system faults are detected, then the NTD method provides recommendations to correct the faults to improve cooling capacity and efficiency. Approximately 30 to 50% of HVAC systems have no faults and do not require connecting refrigerant pressure sensors or gauges to test the AC system. Therefore, the NTD method can help reduce HCF (R410a) and HCFC (R22) emissions by 30 to 50% by not connecting refrigerant pressure sensors or gauges to systems that have proper RCA and no faults.

In accordance with one aspect of the invention, there is provided an NTD method based on measurements of a Return-air Drybulb Temperature (RDT), a Return-air Wetbulb Temperature (RWT), a Supply-air Drybulb Temperature (SDT), Outdoor Air Temperature (OAT), a refrigerant Suction Temperature (ST) and a refrigerant Liquid Temperature (LT). The method calculates an Actual Temperature Split (ATS) as the RDT minus the SDT, determines a Required Temperature Split (RTS) based on the RDT and the RWT, calculates a Delta Temperature Split (DTS) based on ATS minus the RTS, and calculates a Liquid Over Ambient (LOA) temperature based on the LT minus the OAT. The NTD method uses the DTS and the LOA to diagnose proper RCA or at least one AC system fault based on the DTS, the ST, and the LOA. The at least one AC system fault is selected from the group consisting of: an Evaporator Airflow (EA) fault or a low airflow fault, a Condenser Heat Exchanger (CHX) fault, an Evaporator Heat Exchanger (EHX) fault, a low cooling capacity, a refrigerant UC or OC fault, a Thermostatic Expansion Valve (TXV) fault, or Non-TXV (NT) fault, a Non-Condensable (NC) fault, and a Refrigerant Restriction (RR) fault. The method uses the DTS to estimate or determine a refrigerant Undercharge (UC) amount to subsequently correct by adding an amount of refrigerant through a suction line without connecting a pressure sensor to a liquid line to reduce refrigerant venting.

The known Temperature Split (TS) method allows AC system testing without connecting pressure gauges but is limited to only checking proper airflow based on DTS within plus or minus (+/−) 3 degrees fahrenheit (F). The known TS method does not use the DTS and the LOA (or the ST or the OAT) to diagnose proper RCA or AC system faults including the refrigerant UC or OC based only on temperature measurements. The known TS method cannot diagnose low airflow, UC, OC, RR, and NC faults since DTS can be within +/−3F for all of these faults. Persons having ordinary skill in the art evaluated the known TS method and reported less than 60% accuracy when diagnosing low airflow from −10 to −30% (Yuill 2012). Intertek laboratory tests indicate the known TS method only provides 16.7% accuracy based on 15 correct tests out of 90 tests. The California Energy Commission (CEC) stopped requiring the known TS method to check low airflow after 2012 (CEC 2012). The known disadvantages of the TS method naturally discouraged the search for using the DTS with the ST, and the LOA to diagnose proper RCA or AC system faults.

Known Refrigerant Charge (RC) methods require connecting refrigerant pressure sensors to diagnose AC system faults which increases refrigerant venting to the atmosphere. The NTD method resolves this problem by diagnosing proper RCA or AC system faults without connecting refrigerant pressure sensors. If AC system faults are detected, then the type and extent of faults are indicated, and recommendations are provided to correct faults and improve cooling capacity and efficiency. The known TS or RC methods do not monitor the AC system temperatures or refrigerant pressures reaching an equilibrium condition before diagnostic testing based on a rate of change of the AC system temperatures or refrigerant pressures with respect to time. Not achieving the equilibrium condition for diagnostic testing can cause misdiagnoses, missed detection, false positive or false negative detection.

In accordance with another aspect of the invention, the NTD method estimates or determines a refrigerant UC amount but does not recommend adding or removing small refrigerant charge amounts which provide small cooling efficiency improvements and may cause refrigerant venting. The NTD method can diagnose multiple faults which is not possible with the known TS or RC methods. The NTD method does not require prior measurements of LP or SP or prior measurements of ASH or ASC to diagnose proper operation or AC system faults.

In accordance with another aspect of the invention the NTD method can be used without cleaning the condenser coil. If no condenser HX faults are detected, then the coil is clean enough to diagnose the AC system faults without cleaning the condenser coil. This can save time waiting for a condenser coil to dry.

In accordance with yet another aspect of the invention, there is provided a Refrigerant System Diagnostic (RSD) method after the NTD method only when necessary. If the NTD method determines a refrigerant UC amount, then charge can be added through the suction line valve without connecting to a liquid line valve which reduces refrigerant venting. If other AC system faults are detected, then measurements of refrigerant pressures and saturation temperatures may be used with the RSD method to further evaluate the AC system faults.

BRIEF DESCRIPTION OF DRAWINGS

The above and other aspects, features and advantages of the present invention will be more apparent from the following brief description of the drawings.

FIG. 4 provides a first set of temperature data from laboratory tests of the AC system with and without faults and diagnostics from the NTD method.

FIG. 5 provides a second set of temperature data from laboratory tests of the AC system with and without faults and diagnostics from the NTD method.

FIG. 16 provides a third set of temperature data from laboratory tests of the AC system with and without faults and diagnostics from the RSD method.

FIG. 17 provides a fourth set of temperature data from laboratory tests of the AC system with and without faults and diagnostics from the RSD method.

FIG. 18 provides a fifth set of data comparing the Intertek tests and the NTD and the RSD methods to the known Temperature Split (TS) method and the known Refrigerant Charge (RC) method.

FIG. 19 provides a sixth set of data comparing the Intertek tests and the NTD and the RSD methods to the known TS method and the known RC method.

FIG. 21 provides a lookup table of a Required Temperature Split (RTS) temperature (F) based on a Return-air Wetbulb Temperature (RWT) and a Return-air Drybulb Temperature (RDT).

FIG. 22 provides a lookup table of the Required Superheat (RSH) temperature (F) based on the OAT and the RWT.

FIG. 23 provides non-TXV application energy efficiency ratio (EER*) values at 95° F. OAT based on Intertek tests from 0 to 40 percent (%) under charge (UC) per original equipment manufacturer (OEM) factory charge, Intertek measured EER* impacts, Actual Temperature Split (ATS) across the evaporator for each Intertek test, and calculated EER* impacts.

FIG. 24 provides non-TXV application EER* values at 82° F. OAT based on Intertek tests from 0 to 40% UC per OEM factory charge, Intertek measured EER* impacts, ATS across the evaporator for each Intertek test, and calculated EER* impacts.

FIG. 25 provides TXV application EER* values at 95° F. OAT based on Intertek tests from 0 to 40% UC per OEM factory charge, Intertek measured EER* impacts, ATS across the evaporator for each Intertek test, and calculated EER* impacts.

FIG. 26 provides non-TXV application EER* values at 95° F. OAT based on Intertek tests for a base case (no fault) and AC system faults, Intertek measured EER* impacts, ATS across the evaporator for each Intertek test, and calculated EER* impacts.

Corresponding reference characters indicate corresponding components throughout several views of the drawings.

DETAILED DESCRIPTION OF THE INVENTION

The following description is of the best mode presently contemplated for implementing the Non-intrusive Temperature-based Diagnostic (NTD) method. This description is not to be taken in a limiting sense but is made merely for the purpose of describing one or more preferred embodiments of the invention. The scope of the invention should be determined with reference to the claims. Where the terms "about" or "generally" are associated with an element of the invention, it is intended to describe a feature's appearance to the human eye or human perception, and not a precise measurement, for example within plus or minus 5%. The NTD method is described using logic equations or functions with argument lists of independent variables. The logic equations or functions can be implemented on a computer, mobile, or web-based software application such as Microsoft Excel, Apple Numbers, Google Sheets, or Wordperfect Office Suite Quatro Pro. The logic equations or functions can be implemented in programming languages such as Swift, Android, Visual Basic, C++, Python, Java, TypeScript, Python, C #, Ruby, PHP, or other language.

Figure 1:
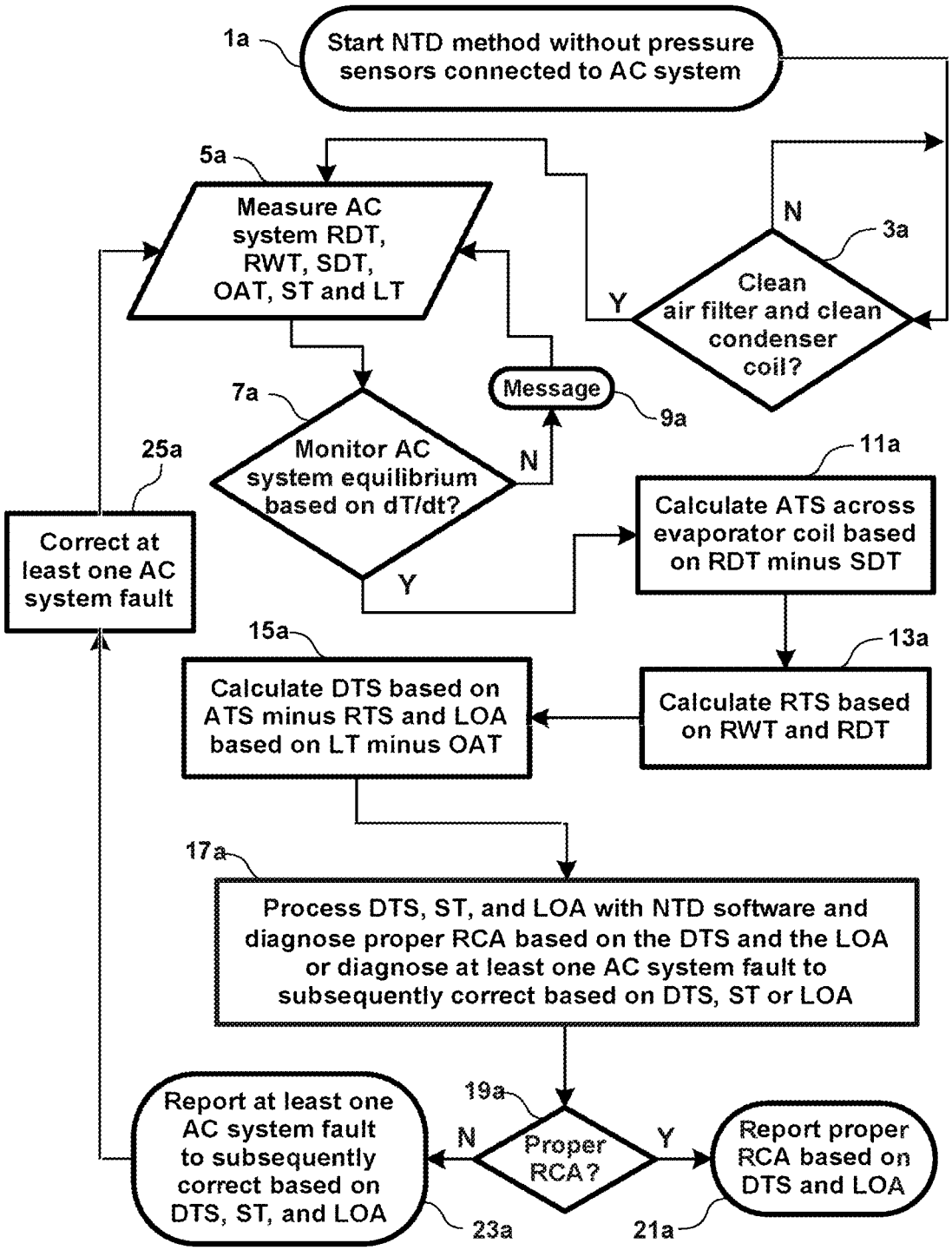
FIG. 1 provides flow chart of an embodiment of the Non-invasive Temperature-based Diagnostic (NTD) method for an air conditioning (AC) system.

FIG. 1 provides a flow chart of an embodiment of the Non-invasive Temperature-based Diagnostic (NTD) method for an Air Conditioning (AC) system in cooling mode. At step 1*a*, the NTD method starts without connecting refrigerant pressure sensors to reduce refrigerant venting by at least 50%. Known superheat or subcooling diagnostic methods vent refrigerant by connecting pressure sensors to suction Schrader valves to check superheat or liquid Schrader valves to check subcooling. The NTD method reduces venting since at least 50% of AC systems have correct refrigerant charge and do not require checking refrigerant superheat or subcooling. Step 3*a* checks for a clean air filter and a clean condenser coil. Step 5*a* measures the AC system temperatures comprising a Return Drybulb Temperature (RDT), a Return Wetbulb Temperature (RWT), and a Supply Drybulb Temperature (SDT), an Outdoor Air Temperature (OAT), a Suction Temperature (ST) and a Liquid Temperature (LT). Air temperatures are measured in degrees fahrenheit (F) or in degrees Celsius.

The AC system temperatures are entered into a processor memory with the processor performing processing step 7*a* through step 23*a*. In one embodiment, the processor may automatically correct the at least one AC system fault in step 25*a*. In Step 7*a*, the processor monitors the AC system equilibrium condition based on the rate of change of the AC system temperatures with respect to time (dT/dt). As the rate of change of AC system temperatures decreases and approaches zero, equilibrium is reached. Step 7*a* avoids diagnosing and reporting a false positive or a false negative result. If step 7*a* is No (N), then the method goes to step 9*a* and the processor provides an optional message "AC system pending equilibrium, please verify clean air filter, clean and dry CC, and the AC system is operating for at least 10 minutes to reach equilibrium." Pending equilibrium means the AC system has not reached the equilibrium condition for diagnostic testing. If AC system equilibrium is not reached in 15 to 20 minutes, the message might provide another optional message "AC system faults check airflow, blocked or dirty air filter, blocked or dirty evaporator, failed fan relay, blocked or dirty condenser, check for refrigerant leaks with an electronic leak detector (or soap solution) at Schrader valves, condenser, evaporator, or line set, check expansion valve or heat pump reversing valve faults, check AC compressor faults such as failed capacitor or contactor, or other faults." For a packaged AC system with an air-side economizer, the method may report a message: "Check economizer supply-air dampers are fully closed (or temporarily sealed) and return-air dampers are fully open to reduce economizer outdoor airflow" based on OAT greater than a threshold value (e.g., 95F).

After 9a, the method goes to step 5*a* and the processor continues measuring the AC system temperatures. If step 7*a* is Yes (Y), the method goes to step 11*a*. At step 11*a* the processor calculates an Actual Temperature Split (ATS) across the evaporator coil based on the RDT minus the SDT. At step 13*a* the processor calculates a Required Temperature Split (RTS) based on the RWT and the RDT. Step 15*a* calculates a Delta Temperature Split (DTS) based on the ATS minus the RTS and Liquid Over Ambient (LOA) temperature based on an LT minus an OAT.

Step 17*a* processes and analyzes the DTS, the ST, and the LOA with Non-invasive Temperature Diagnostic (NTD) software and diagnoses proper Refrigerant Charge and Airflow (RCA) based on the DTS and the LOA or diagnoses at least one AC system fault based on the DTS, the ST, and the LOA wherein the at least one AC system fault is selected from the group consisting of: an Evaporator Airflow (EA) or a low airflow fault, an Evaporator Heat Exchanger (EHX) fault, a Condenser Heat Exchanger (CHX) fault, a low cooling capacity, an expansion valve fault for a Thermostatic Expansion Valve (TXV) or a Non-TXV (NT), a Heat Pump (HP) reversing (REV) valve fault, a Non-Condensable (NC) fault, a Refrigerant Restriction (RR), a refrigerant Undercharge (UC), and a refrigerant Overcharge (OC). Step 19*a* the processor diagnoses proper RCA. If step 19*a* is Yes (Y), then the method goes to Step 21*a* and the processor reports proper RCA based on the DTS and the LOA. If step 19*a* is No (N), then the method goes to step 23*a* and the processor reports at least one AC system fault to subsequently correct based on the DTS, the ST, and the LOA with information to enable repair of the at least one AC system fault. At step 23*a*, the processor may report a refrigerant undercharge fault and the refrigerant undercharge amount to add to the AC system to correct the refrigerant undercharge fault. A qualified technician may correct the at least one AC fault or the processor may be enabled to automatically correct the at least one AC system fault. After step 25*a*, the method returns to step 5*a* to measure the AC system temperatures and continues through the process until the processor diagnoses a proper RCA at step 19*a* and step 21*a* reports the proper RCA indicating acceptable AC system performance based on the DTS and the LOA.

Figure 2:
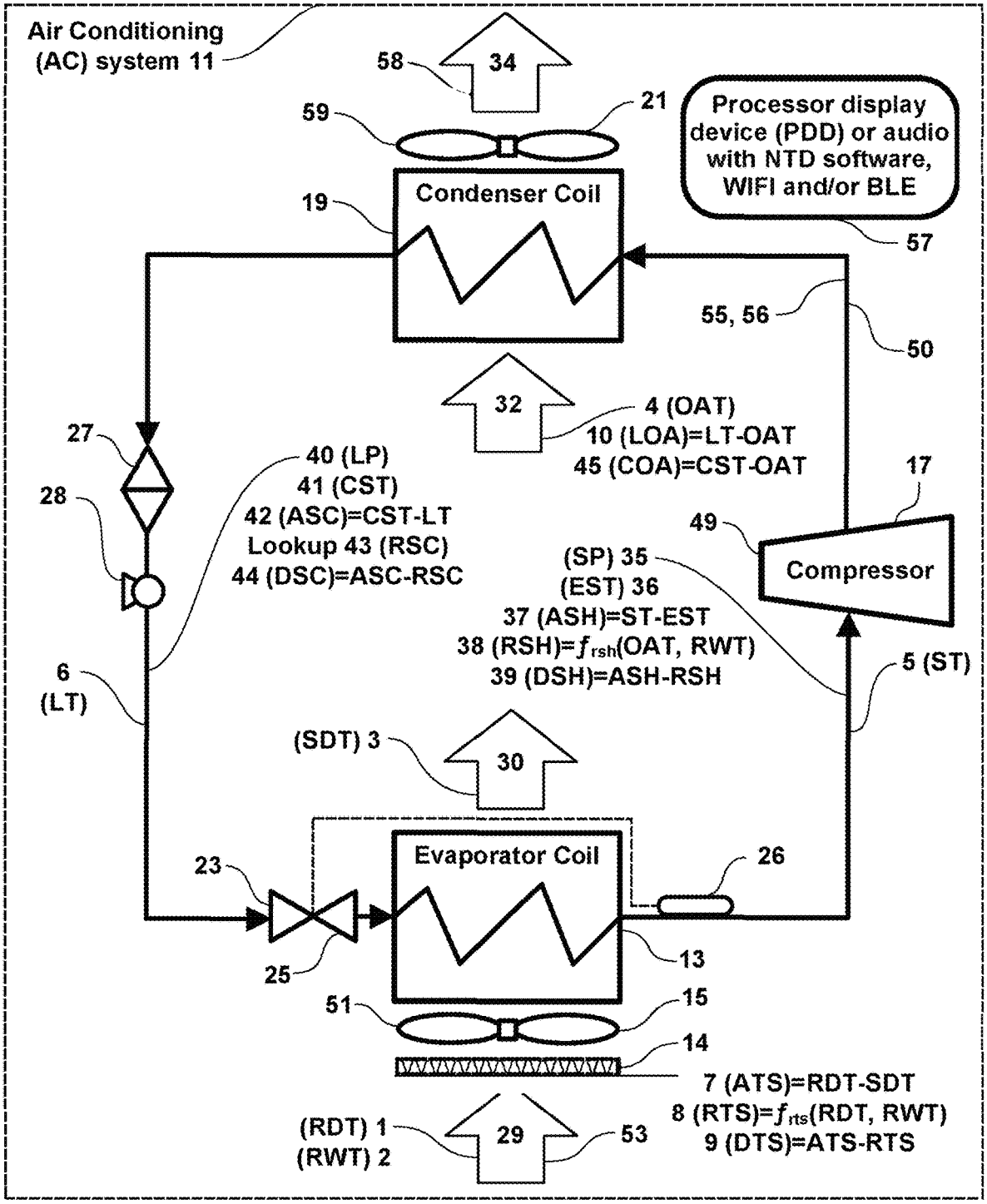
FIG. 2 shows a schematic diagram of the AC system.

FIG. 2 shows a schematic diagram of a known AC system 11 with components comprising an Evaporator Coil (EC) 13, an air filter 14, a blower fan 15, a compressor 17, a Condenser Coil (CC) 19, a condenser fan 21, an NT 23, a TXV 25, a TXV sensing bulb 26, a filter dryer 27, and a sight glass 28. The AC system 11 will have the NO or the TXV, but not both. FIG. 2 does not show a heat pump reversing valve which controls the direction of refrigerant flow to switch the evaporator to a condenser and the condenser to an evaporator for heating mode which requires another expansion device (e.g., NT 23 or TXV 25).

FIG. 2 shows locations to measure temperatures to perform the NTD method including a RDT 1, a RWT 2, a SDT 3, an OAT 4, a ST 5, an LT 6. The NTD method calculates an ATS 7 across the EC 13 based on the RDT 1 minus the SDT 3 and calculates a Required Temperature Split (RTS) 8 as a function of the RWT 2 and RDT 1 (RTS=frts (RWT, RDT) see FIG. 21). The NTD method calculates a DTS 9 equal to the ATS 7 minus the RTS 8. An LOA 10 temperature is equal to the LT 6 minus the OAT 4. The NTD method uses the DTS 7, the OAT 4, the ST 5, and the LT 6 to evaluate AC system faults including a refrigerant OC or a refrigerant UC.

FIG. 2 shows locations to measure pressures and refrigerant saturation temperatures to perform the Refrigerant System Diagnostic (RSD) method including a Suction Pressure (SP) 35, an Evaporator Saturation Temperature (EST) 36, a Liquid Pressure (LP) 40, a Condenser Saturation Temperature (CST) 41. The RSD method calculates an Actual Superheat (ASH) 37 equal to the ST 5 minus the EST 36, a Required Superheat (RSH) 38 as a function of the OAT 4 and the RWT 3 (RSH=$f_{rsh}$ (OAT, RWT) see FIG. 22), and a Delta Superheat (DSH) 39 equal to the ASH 37 minus the RSH 38. The RSD method calculates an Actual Subcooling (ASC) 42 equal to the CST 41 minus the LT 6, a Required Subcooling (RSC) 43 based on a manufacturer value or a default of 7 to 10F, and a Delta Subcooling (DSC) 44 equal to the ASC 42 minus the RSC 43.

FIG. 2 also shows locations to measure a Discharge Pressure (DP) 55, a Discharge Saturation Temperature (DST) 56, and a Discharge Temperature (DT) 50, a compressor power 49, a fan power 51, a condenser fan power 59, an Evaporator Airflow (EA) 53, and a Condenser Airflow (CA) 58 equal to an inlet airflow 32 or an outlet airflow 34. The EA 53 consists of a return airflow 29 and a supply airflow 30 providing conditioned air to a space controlled by a thermostat. FIG. 2 shows a PDD 57 comprising a Processor and Display Device (PDD) or Processor and Audio Device with NTD software WIFI and/or Bluetooth Low Energy (BLE) wireless or wired communication. The PDD 57 may include a Visual Device or an Audio Device to output diagnostic reporting information. The PDD 57 may include data entry (software keyboard) or wireless data entry (WIFI or BLE data entry from measurement instruments), and memory to store data. The PDD 57 is used to process and communicate diagnostic information with an NTD software application for a computer, mobile phone, smart thermostat, smart HVAC diagnostic system, building energy management system or other device. The NTD method may use machine learning or Artificial Intelligence (AI) algorithms designed to make decisions using real-time data.

Figure 3:
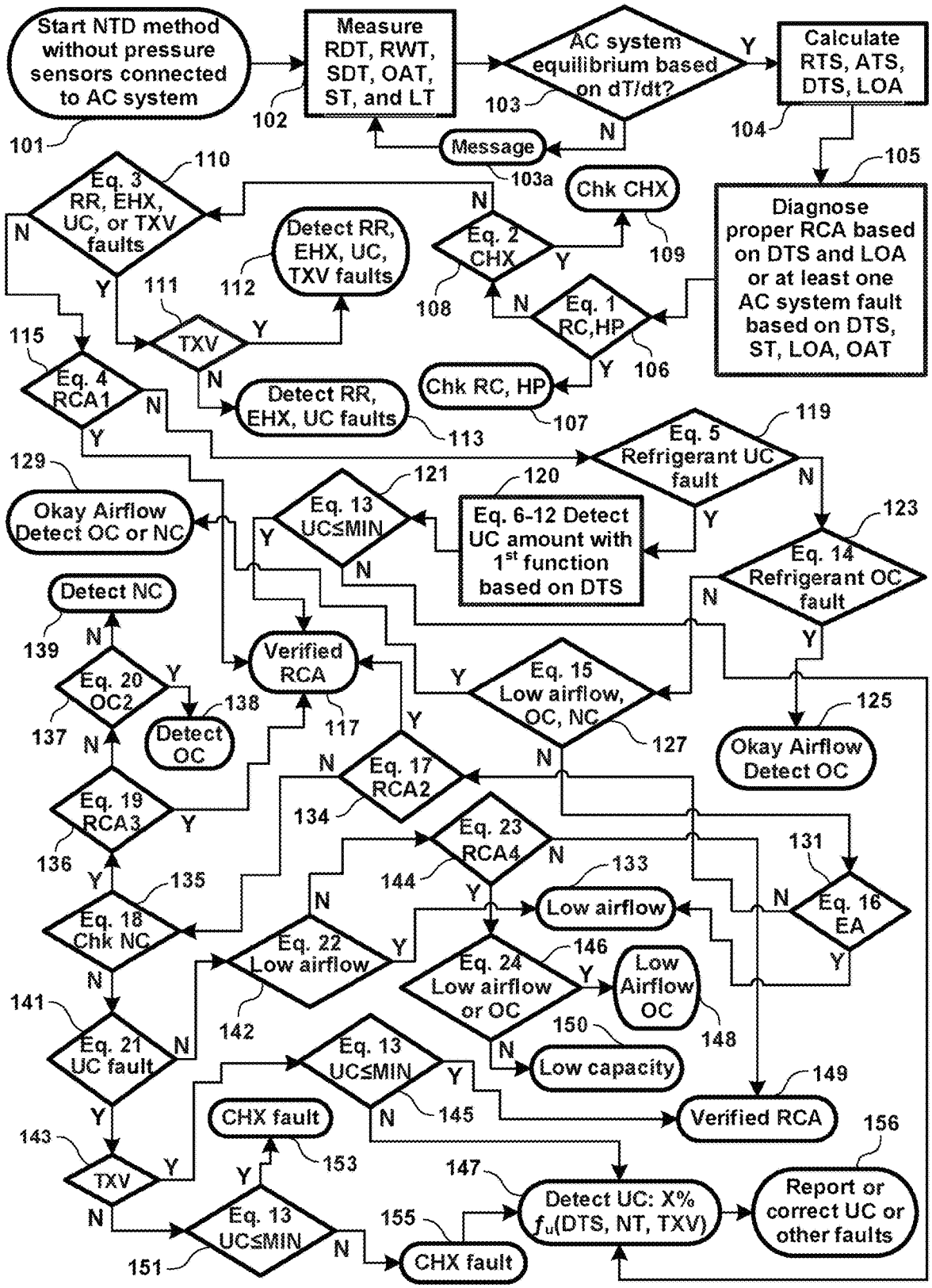
FIG. 3 Provides another flow chart of the NTD method for the AC system.

FIG. 3 provides a detailed flow chart of the NTD method starting at step 101. The NTD method diagnoses proper Refrigerant Charge and Airflow (RCA) based on the DTS and the LOA or at least one AC system fault based on the DTS, the ST, the LOA, and the OAT, without connecting pressure sensors or prior pressure measurements. The NTD method measures, enters, and/or captures AC system temperatures into a processor and performs the following processing steps. Step 102 measures the following AC system temperatures: RDT, RWT, SDT, OAT, ST, and LT and determines the RTS based on RWT and RDT (see FIG. 21). Step 103 monitors the AC system reaching an equilibrium condition based on the AC system temperatures measured in step 102 reaching an equilibrium based on the rate of change of the AC system temperatures with respect to time (dT/dt). As the rate of change of AC system temperatures decreases and approaches zero, equilibrium is reached. Step 103 avoids diagnosing and reporting a false positive or a false negative result. If step 103 is No (N), then the method goes to step 103*a* to provide an optional message "AC system pending equilibrium, please verify clean air filter, clean and dry CC, and the AC system is operating for at least 10 minutes to reach equilibrium." If AC system equilibrium is not reached in 15 to 20 minutes, the message might provide another optional message "AC system faults check airflow, blocked air filter, EHX or CHX faults, refrigerant leaks, expansion valve (or heat pump reversing valve) faults, AC compressor faults, or other faults." For a packaged AC system with an air-side economizer, the method may report a message: "Check economizer supply-air dampers are fully closed (or temporarily sealed) and return-air dampers are fully open to reduce economizer outdoor airflow" based on OAT greater than a threshold value (e.g., 95F). After 103*a*, the method goes to step 102 to measure the AC system temperatures. If step 103 is Yes (Y), the method goes to step 104.

Step 104 calculates the RTS based on the RDT minus the SDT, calculates the DTS based on the ATS minus the RTS, and calculates the LOA based on the LT minus the OAT. Step 105 diagnoses proper RCA based on the DTS and the LOA or diagnoses at least one AC system fault based on the DTS, the ST, the LOA, and the OAT. The at least one AC system fault is selected from the group consisting of: a low airflow, an Evaporator Heat Exchanger (EHX) fault, a Condenser Heat Exchanger (CHX) fault, a low cooling capacity, an expansion valve fault, a heat pump reversing valve fault, a Non-Condensable (NC) fault, a Refrigerant Restriction (RR), a refrigerant UC, and a refrigerant OC. The low airflow fault is also referred to as an Evaporator Airflow (EA) fault or an EHX fault.

Step 106 evaluates a low cooling capacity or a Refrigerant Charge (RC) fault due to a due to a refrigerant leak or a Heat Pump (HP) reversing valve fault or a compressor failure based on at least one first condition selected from the group consisting of: the DTS is negative, and the ST is greater than the RDT, based on the SDT, RDT, DTS, and ST per the following example equation.

IF(OR(SDT>=RDT,DTS<−15,ST>84), is Yes (*Y*) go to step 107, otherwise go to step 108. Eq. 1

Other variables may be used in the above equation depending on machine learning. If step 106 is Yes (Y), then the method goes to step 107 to report "Check a RC or a HP fault" abbreviated for "Check refrigerant charge leaks or check HP reversing valve." If SDT is greater than or equal to RDT, then the AC system has lost refrigerant charge. Or for a HP, the HP reversing valve might be energized incorrectly, stuck in heating position (solenoid fault), or leaking refrigerant. If step 106 is No (N) the method proceeds to step 108.

Step 108 evaluates the CHX fault based on at least one second condition selected from the group consisting of: the number of compressors (#C), the ST, the DTS, and the LOA per the following example equation.

IF(OR(AND(IF(OR(#*C*>1,OAT>100),ST<60,ST<55), DTS<−0.5,LOA>9)) is Yes (*Y*) go to step 109, otherwise go to step 110. Eq. 2

Where, #C=number of compressors, ST=Suction Temperature (F), DTS=Delta Temperature Split (F)=ATS minus RTS, and LOA=LT-OAT (F). The LT-OAT may be substituted for the LOA in each of the following steps.

If step 108 is Yes (Y) and the CHX fault is detected, then the method reports "Detect CHX fault" at step 109. After correcting the CHX fault (e.g., cleaning the CC), the method goes to step 103 and waits until the CC is clean and dry before proceeding. A wet CC will influence refrigerant temperature and pressure so the CC must be dry before starting the method. Condensers may require 15 minutes or longer to dry. The NTD method can be used without cleaning the CC, and if no CHX faults are detected, then the CC is clean enough to diagnose the AC system faults without cleaning the CC. If step 108 does not detect a CC fault, then the method proceeds to step 110.

At step 110, the method checks for a Refrigerant Restriction (RR), an EHX fault, a UC, or a TXV fault based on at least one third condition per the following example equation.

IF(AND(−11<DTS<−6,ST>SDT,IF(OAT>95, LOA<5.2,LOA<4.5)) is Yes (*Y*), then go to step 111, otherwise go to step 115. Eq. 3

Measuring a temperature drop across each device (e.g., filter dryer, expansion device, liquid line, kink, bend, or valve) while the AC system is operating will help locate the RR. If the OAT is greater than 95F then the ST lower limit is 5.2F instead of 4.5F. If step 110 is Yes (Y), then the NTD method proceeds to step 111 to check for a TXV device. If step 111 is Yes (Y), the method goes to step 112 and reports "Detect RR, EHX, UC, or TXV faults." If step 111 is No (N), the method goes to step 113 and reports "Detect RR, EHX, or UC faults." If step 110 is No (N), the method goes to step 115.

At step 115, the NTD method evaluates proper Refrigerant Charge and Airflow (RCA) with a first RCA test (RCA1) based on at least one fourth condition per the following example equation.

IF(OR(AND(49<ST<=61,−0.1<=DTS<2, 4<=LOA<10), AND(−2<DTS<2, 4<LOA<10), ST>49)) is Yes (*Y*) go to step 117. Otherwise go to step 119. Alternatively, the following example equation may be used to diagnose proper RCA based only on DTS and LOA and report "Verified RCA."

IF(AND(−2<DTS<2, 4<,LOA<10)). Eq. 4

The two sets of ST, DTS, and LOA (LT-OAT) temperature limits are used. If step 115 is Yes (Y), wherein the ST, the DTS, and the LOA pass, then the method proceeds to step 117 and reports "Verified RCA." About 30 to 50% of AC systems do not have any faults and can be diagnosed with the NTD method to save time and avoid connecting refrigerant sensors to liquid or suction Schrader valves and venting refrigerant to the atmosphere.

If step 115 is No (N), the method proceeds to step 119 to check a refrigerant UC based on at least one fifth condition per the following example equation.

IF(OR(AND(72<ST<85, 3<LOA<10), AND (69<ST<79,LOA>5,DTS<−4), AND(DTS<−15, LOA>5), AND(72<ST<85,−3<=DTS<=3))) is Yes (*Y*) go to step 120, otherwise go to step 123. Eq. 5

If step 119 is Yes (Y) and ST, LOA, DTS indicate a UC fault, then the method goes to step 120 to detect or determine the UC amount using the following example equation referred to as a first mathematical function ($f_u$) (or $1^{st}$ function) with DTS as an independent variable. The simplest embodiment uses DTS as an independent variable. The $1^{st}$ function may also vary based on the expansion device, or the OAT. For a packaged unit, the $1^{st}$ function may also vary based on the number of AC compressors or whether an air economizer is installed.

$$1^{st}\text{ Function}=UC=f_u(DTS)\text{ or }f_u(DTS,NT,TXV) \quad \text{Eq. 6}$$

Figure 6:
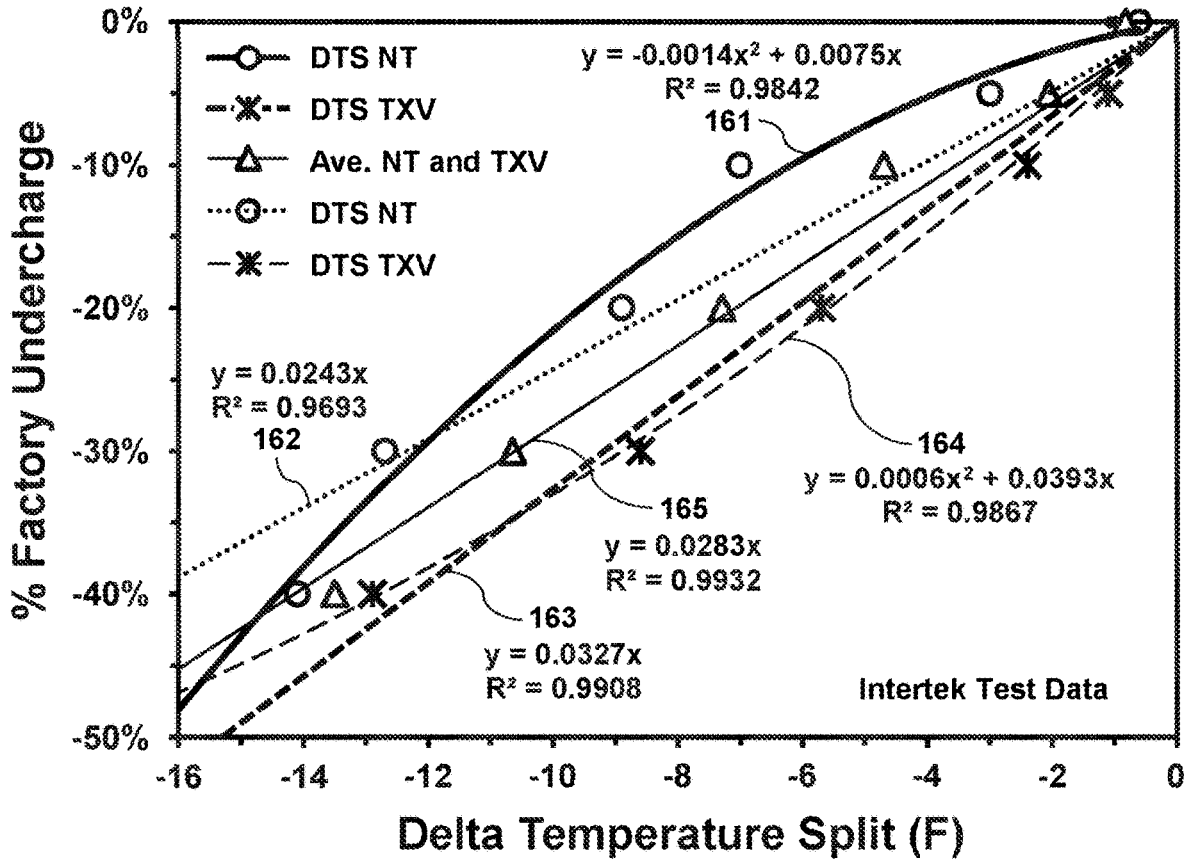
FIG. 6 provides laboratory tests of an AC system with a Thermostatic Expansion Valve (TXV) and a Non-TXV (NT) for tests performed with 0 to −50% Factory Under Charge (UC) or 100% to 50% Factory Charge (FC) versus Delta Temperature Split (DTS) in degrees fahrenheit (F).

For a split AC system with the NT the $1^{st}$ function ($f_u$) may use the following equation (curve 161 polynomial or curve 162 linear) as shown in FIG. 6.

$$f_u(DTS,NT)=y_{nt}=-0.0014*x^2+0.0075*x$$

$$\text{or } y_{nt}=0.0243*x \quad \text{Eq. 7}$$

Where, $y_{nt}$=% UC with the NT, and x=Delta Temperature Split (DTS) (F).

For a split AC system with the TXV the method may use a different UC function ($f_u$), for example (curve 163, curve 164 or curve 165 for NT and TXV) as shown in FIG. 6.

$$f_u(DTS,TXV)=y_{txv}=0.0327*x$$

$$\text{or } y_{txv}=0.0006*x^2+0.0393*x$$

$$\text{or } y_{ave}=0.0283*x \quad \text{Eq. 8}$$

Where, $y_{txv}$=% UC with the TXV, and x=DTS (F).

Figure 10:
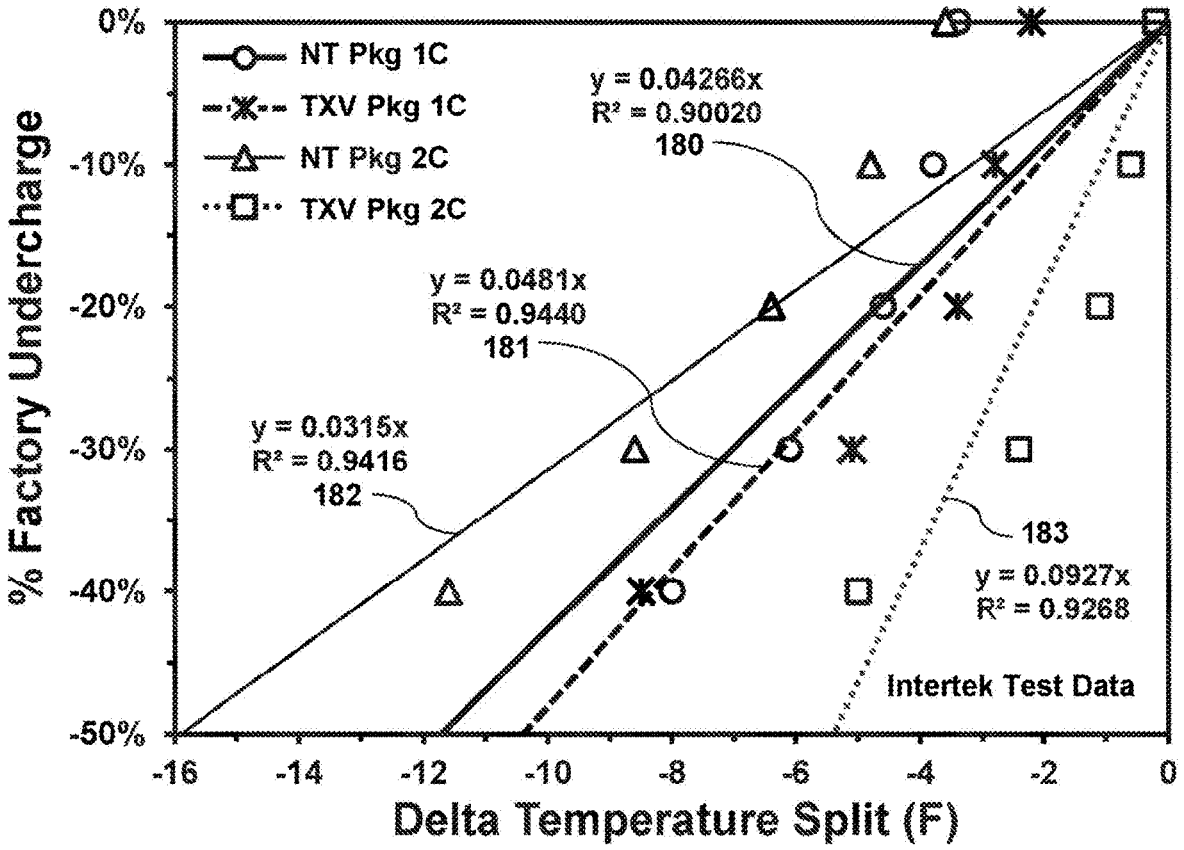
FIG. 10 provides laboratory test data of two packaged AC systems with one compressor (1C) and two packaged AC systems with two compressors (2C) with the NT and the TXV and 0% to −50% factory UC versus the DTS temperature (F).

For a single compressor packaged AC system with the NT the method may use the following example UC function ($f_u$) (curve 180) as shown in FIG. 10.

$$f_u(DTS,NT)=y_{nt}=0.04266*x \quad \text{Eq. 9}$$

Where, $y_{nt}$=% UC with the NT, and x=DTS (F).

For a single compressor packaged split AC system with the TXV the method may use a different example UC function ($f_u$) (curve 181) as shown in FIG. 10.

$$f_u(DTS,TXV)=y_{txv}=0.0481*x \quad \text{Eq. 10}$$

Where, $y_{txv}$=% UC for the TXV, and x=DTS (F).

For a multiple compressor packaged AC system with the NT the method may use the following example UC function ($f_u$) (curve 182) as shown in FIG. 10.

$$f_u(DTS,NT)=y_{nt}=0.0315*x \quad \text{Eq. 11}$$

Where, $y_{nt}$=% UC for the NT, and x=DTS (F).

For a multiple compressor packaged split AC system with the TXV the method may use a different example UC function ($f_u$) (curve 183) as shown in FIG. 10.

$$f_u(DTS,TXV)=y_{txv}=0.0927*x \quad \text{Eq. 12}$$

Where, $y_{txv}$=% UC for the TXV, and x=DTS (F).

An average UC function versus DTS for a single compressor AC system with an NT or a TXV may also be used (curve 165 FIG. 6). In one embodiment, the maximum calculated value of the UC function, $f_u$(DTS,NT,TXV, OAT), might default to 0.4+/−0.1 or be set by a user. Original Equipment Manufacturers may provide UC functions versus DTS for each AC system for use with the NTD method. The UC functions may vary depending on whether an air economizer is installed on the AC system and damper position or outdoor airflow which may impact the DTS measurements. Therefore, instructions may be provided to close the economizer damper to reduce outdoor airflow when performing the NTD method.

At step 121 the method checks if the absolute value of the UC amount is less than or equal to a Minimum (MIN) value (UC<=MIN) or approximately 5 to 7.5% of factory charge (FC) using the $1^{st}$ function described above.

IF(ABS($f_u$(DTS,NT,TXV))<=MIN) is Yes (*Y*) go to step 117, otherwise go to step 147. Eq. 13

If the undercharge is less than the minimum (MIN), then the method reports "Verified RCA" at step 117 to avoid small charge adjustments. If step 121 determines that the undercharge is greater than or equal to the MIN, then the method goes to step 147 and reports "Detect UC: X %" per the $1^{st}$ function. Leak detection is recommended for all UC faults. To add a known weight of refrigerant only requires connecting one hose to the suction line Schrader valve without connecting to the liquid line valve. This may reduce refrigerant venting by 30 to 50%. After adding refrigerant by weight based on the NTD recommended percent of Factory UC, the method may be used to perform a final verification measurement. At step 156, the method reports or corrects UC, OC, or other AC system faults. After step 156, the method goes to step 103 to continue.

If step 119 is No (N), then the method goes to step 123 to perform a refrigerant OC fault test based on at least one sixth condition per the following example equation.

IF(OR(AND(OR(ST<52,AND(ST<=53,LOA>5)), DTS<=0,DTS>−4,0<LOA<8) is Yes (*Y*) go to step 125, otherwise go to step 127. Eq. 14

If step 123 is Yes (Y), the method goes to step 125 to report "Okay Airflow detect OC." If step 123 is No (N), then the method goes to step 127 to check other faults including "OC or NC faults" using the following example equation.

IF(AND(ST<53,−1.7<=DTS<−0.6,LOA<4)) is Yes (*Y*) go to step 129, otherwise go to step 131. Eq. 15

Figure 15:
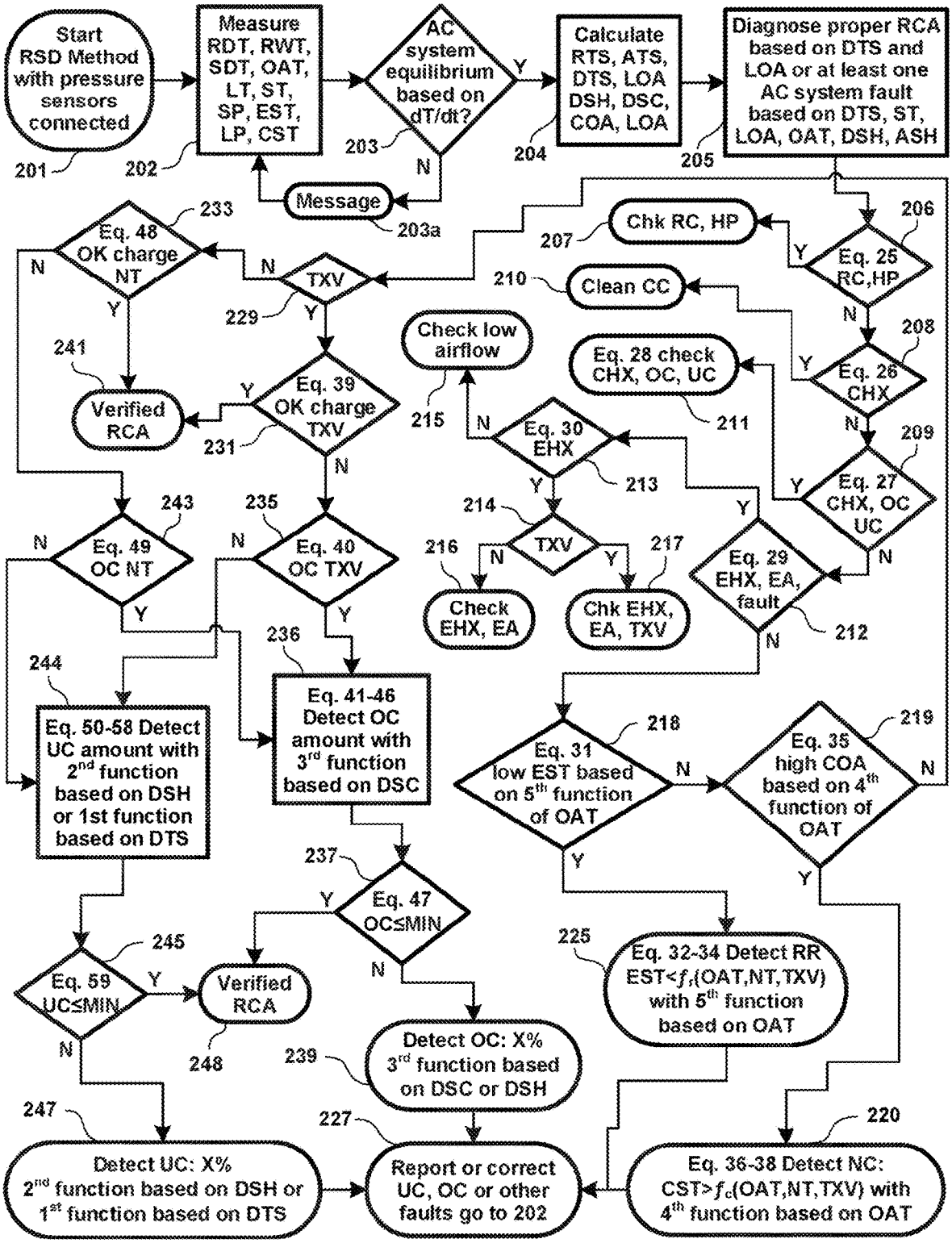
FIG. 15 provides a flow chart of an embodiment of the Refrigerant System Diagnostic (RSD) method according to the present invention, for the AC system.

If step 127 is Yes (Y), the method goes to step 129 and reports "Detect OC or NC." Checking OC and/or NC requires measurements of refrigerant pressures and saturation temperatures and the Refrigerant System Diagnostic (RSD) method per FIG. 15. If step 127 is No (N), the method goes to step 131 to check Evaporator Airflow (EA) or other EHX faults based on at least one eighth condition per the following equation.

IF(AND(ST<=50,DTS>=2)) is Yes (*Y*), then go to step 133, otherwise go to step 134. Eq. 16

Repairing low airflow fault may include installing a clean air filter, cleaning a blocked, dirty, or iced evaporator coil, repairing ducts, increasing fan speed, increasing the plenum or duct dimensions to reduce static pressure, or other repairs to increase airflow. Based on laboratory tests, the NTD method can diagnose EA faults for airflow less than 360 cubic feet per minute per ton (cfm/ton) of rated cooling capacity. One ton equals 12,000 British thermal units per hour (Btu/h). This is 10% less than a nominal rated airflow of 400 cfm/ton.

If step 131 is Yes (Y), the method goes to step 133 and reports "Low Airflow." If step 131 is No (N), the method goes to step 134 to perform a second RCA fault test (RCA2) using the following example equation.

IF(AND(ST>49,−2<DTS<2.5, LOA<8.6,IF(OAT<90, LOA>2.5, LOA>4))) is Yes (*Y*) go to step 117, otherwise go to step 135. Eq. 17

The method for the second RCA fault test is different than the first test in step 115 which uses tighter tolerances and does not include OAT. The NTD method may comprise different UC or OC tests based on age of equipment and machine learning.

If step 134 is Yes (Y), the method goes to step 117 and reports "Verified RCA." If step 134 is No (N), the method goes step 135 to check NC and other faults causing low cooling capacity based on at least one seventh condition per the following example equation.

IF(AND(DTS>=−9,ST>52,IF(OAT>95,LOA<5.8, LOA<5.1))) is Yes (*Y*) go to step 136, otherwise go to step 141. Alternatively, the following example equation may be used to go directly to step 139 and report "Detect NC."

IF(AND(IF(OAT<80,AND(−9<DTS<1),AND(−10<DTS<−1)),52<ST<76,0<LOA<6)). Eq. 18

If step 135 is Yes (Y), the method goes to step 136 to perform a third RCA fault test (RCA3) using the following equation.

IF(AND(ST>62,DTS>−3,DTS<0,LOA>4)), is Yes (*Y*) go to step 117, otherwise go to step 137. Eq. 19

If Step 136 is Yes (Y), the method goes to step 117 and reports "Verified RCA." If step 136 is No (N) the method goes to step 137 to check refrigerant OC or NC per the following example equation (OC2).

IF(OR(AND(IF(OAT<80,AND(−1<DTS<0.4),AND(−1<DTS<0.5)),−1<LOA<11,ST<57),AND(62<ST<66,−5<DTS<−1,0<LOA<4))) is Yes (*Y*) go to step 138, otherwise go to step 139. Eq. 20

If step 137 is Yes (Y), the method goes to step 138 and reports "Detect OC." If step 137 is No (N), the method goes to step 139 and reports "Detect NC."

If step 135 is No (N), the method goes to step 141 to perform a second refrigerant UC fault test using the following example equation or similar equation.

IF(AND(DTS<1.5,LOA>10)) is Yes (*Y*) go to step 143, otherwise go to step 142. Eq. 21

If step 141 is No (N), the method goes to step 142 and checks for low airflow again using the following example equation or similar equation.

IF(DTS>2.7) is Yes (*Y*), go to step 133, otherwise go to step 144. Eq. 22

If step 142 is Yes (Y), the method goes to step 133 and reports "Low airflow." Step 144 performs a fourth RCA fault test (RCA4) with the following example equation.

IF(DTS<−3), is Yes (*Y*) go to step 146 otherwise go to step 149. Eq. 23

If step 144 is No (N), the method goes to step 149 and reports "Verified RCA." If step 144 is Yes (Y), the method goes to step 146 to check low airflow and OC based on the at least one eighth condition per the following example equation or similar equation.

IF(AND(DTS>3,ST<53)), is Yes (*Y*) go to step 148, otherwise go to step 150. Eq. 24

At step 148, the method reports "Low airflow OC." At step 150 the method reports "Low capacity."

If step 141 is Yes (Y) the method goes to step 143 and checks if the AC system includes a TXV. If step 143 is Yes (Y), the method goes to step 145 and checks if the absolute value of the UC is less than or equal to the minimum using the 1$^{st}$ function (Eq. 13). If step 145 is Yes (Y), the method goes to step 149 and reports "Verified RCA."

If step 145 is No (N), the method goes to step 147 and reports "Detect UC: X %" per the 1$^{st}$ function based on the DTS. Leak detection is recommended for all UC faults. If step 143 is No (N), and the AC system has a NT, then the method goes to step 151 to check for CHX faults. At step 151, the method checks if the absolute value of the UC is less than or equal to the minimum (MIN) value using the 1$^{st}$ function based on the DTS. If step 151 is Yes (Y) wherein the UC≤ MIN, then the method goes to step 153 and reports "CHX fault." If step 151 is No (N) wherein the UC>MIN, then the method goes to step 155 and reports a "CHX fault" and goes to step 147 and reports "Detect UC: X %" per the 1$^{st}$ function (described above). The NTD method may detect and report multiple faults. Steps 155 and 147 report "Check CC, Detect UC: X %" per test 359 and test 360 as shown in FIG. 5. At step 156 the NTD method reports or corrects the UC or other faults based on the DTS, the OAT, and at least one refrigerant temperature selected from: the ST and the LT (e.g., LOA=LT-OAT). After step 156, the method goes to step 103 to continue.

The NTD method can be performed using the above equations with or without measuring OAT. The DTS, ST, and LT provide sufficient information about the refrigerant system performance for the NTD method to process, analyze, and diagnose proper RCA or at least one AC system fault selected from the group consisting of: a low airflow, an evaporator heat exchanger fault, a condenser heat exchanger fault, a low cooling capacity, an expansion valve fault, a heat pump reversing valve fault, a non-condensable fault, a refrigerant restriction, a refrigerant undercharge, and a refrigerant overcharge.

FIG. 4 provides a first set of temperature data from Intertek laboratory tests of an AC system with a Non-TXV (NT) and a TXV and information provided by the NTD method. The NTD method provides accurate recommendations for each laboratory test within +/−2% of the NT UC fault tests 308 through 312 and the TXV UC fault tests 323 through 327. The method correctly diagnoses all OC tests but is unable to determine the extent of the overcharge based only on temperature data for tests 302 through 306 and tests 317 through 321. For AC systems with OC faults, the Refrigerant System Diagnostic (RSD) method provides accurate recommendations for removing charge to improve efficiency (see FIG. 15). FIG. 4 shows the NTD method properly diagnoses low airflow for tests 313 through 315 and tests 329 and 330. The NTD method properly diagnoses RR tests 332 through 335 reporting "Detect RR, EHX, UC faults." The NTD method also properly identifies NC for tests 336 through 345.

FIG. 5 provides a second set of temperature data from laboratory tests of the AC system with an NT and TXV and information provided by the NTD method. For tests 346 through 353, the NTD method properly identifies RR. The NTD method also properly identifies CC blockage per test 354 through test 360. For tests 361 through 366, the NTD method properly identifies UC within +/−3%. The NTD method properly identifies OC for tests 367 and 370 but cannot determine the OC amount based on temperature data. For the NT packaged single compressor (1C) tests 371 through 375, the NTD method identifies all UC faults including test 372 with low airflow and OC. The test 371 base with factory charge has slightly low −3.4F DTS indicating low capacity. For the TXV 1C per test 376 through test 380, the base FC and UC tests are properly identified. For the TXV two compressors (2C) per test 381 through test 390, the base and all UC fault tests are properly identified. Due to economizer outdoor airflow, the NTD method is less accurate in detecting the UC faults by 4 to 10%.

FIG. 6 provides laboratory test data of the AC system with the NT and the TXV with 0 to −50% Factory UC (100% to 50% FC). Curve 161 provides a $1^{st}$ function of UC with respect to the DTS (F) for the NT with a polynomial curve fit. Curve 162 provides the $1^{st}$ function of UC with respect to the DTS for the NT with a linear curve fit. Curve 163 provides the $1^{st}$ function of UC with respect to the DTS for the TXV with a linear curve fit. Curve 164 provides the $1^{st}$ function of UC with respect to the DTS for the TXV with a polynomial curve fit. Curve 165 provides the $1^{st}$ function of UC with respect to the DTS for both NT and TXV device with a linear curve fit. Other $1^{st}$ functions involving DTS, OAT or other variables may also be used.

Figure 7:
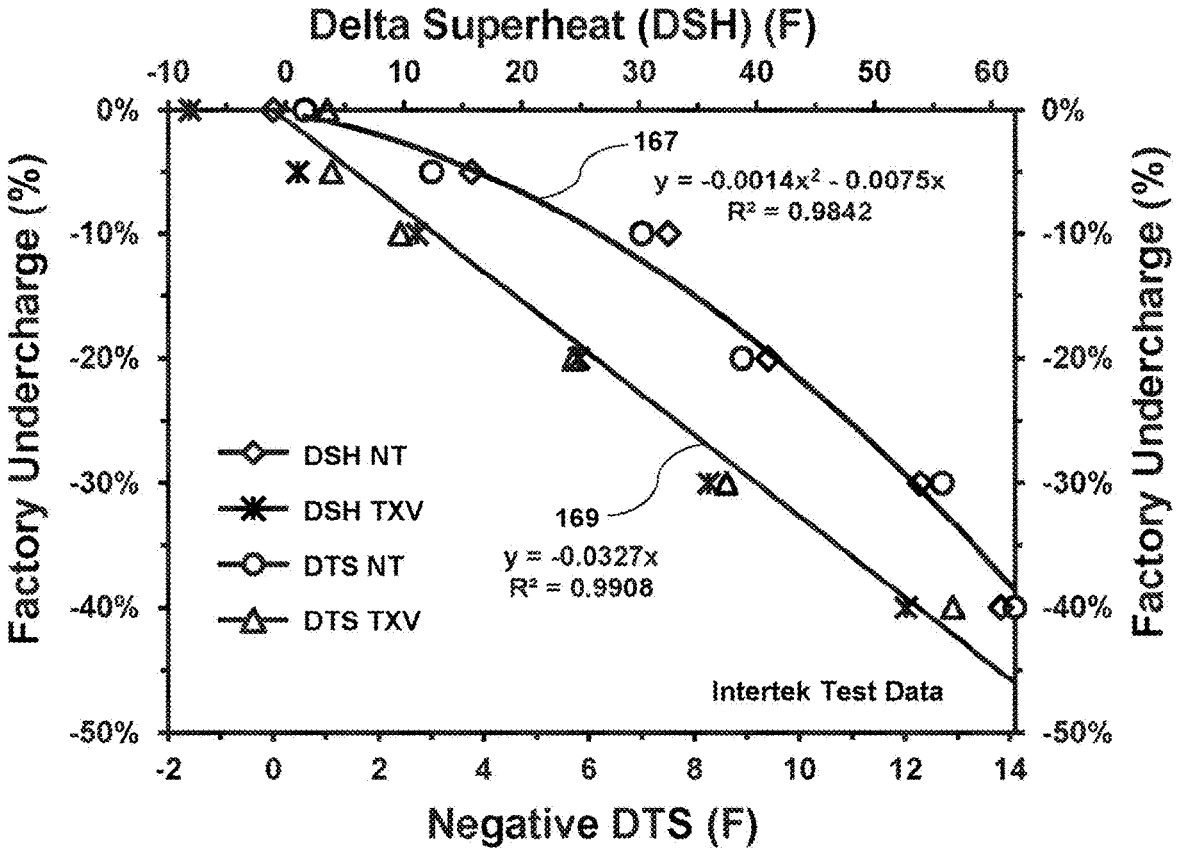
FIG. 7 provides laboratory test data of the AC system with the NT and the TXV with 0% to −50% factory UC versus a negative DTS and a Delta Superheat (DSH) (F).

FIG. 7 provides laboratory test data of the AC system with an NT and a TXV with 0 to −50% factory UC versus Negative DTS and Delta Superheat (DSH) (F). Curve 167 provides the 2nd function of UC with respect to the negative DTS for the NT. Curve 169 provides the $2^{nd}$ function of UC with respect to the negative DTS for the TXV. DTS and DSH provide similar results. Other 2nd functions with respect to DTS or DSH, OAT, or other variables may also be used.

Figure 8:
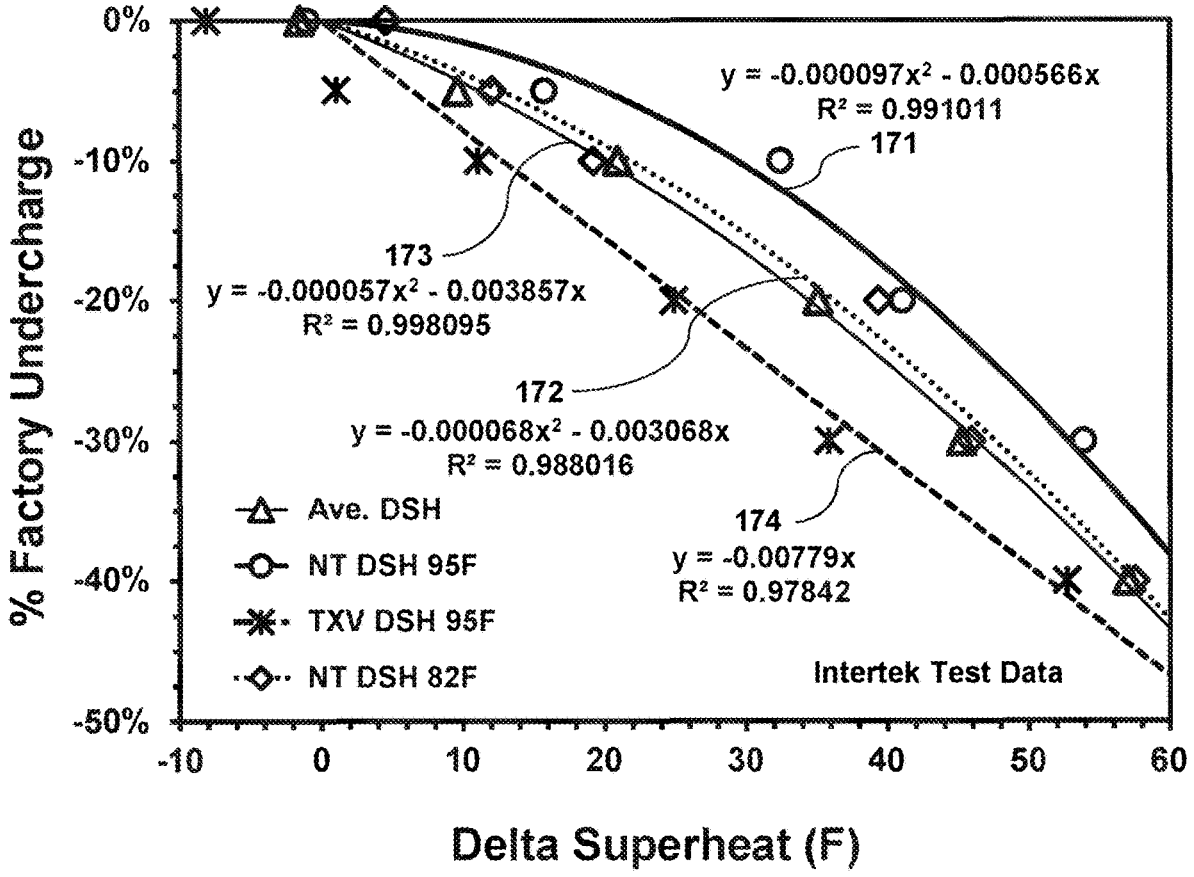
FIG. 8 provides laboratory test data of the AC system with the NT and the TXV with 0% to −50% factory UC versus the DSH temperature (F).

FIG. 8 provides laboratory test data of the AC system with an NT and a TXV with 0 to −50% factory UC versus DSH (F). Curve 171 provides the $2^{nd}$ function of UC with respect to the DSH for the NT at 95F OAT. Curve 172 provides the $2^{nd}$ function of UC with respect to DSH for the NT at 82F OAT. Curve 174 provides the $2^{nd}$ function of UC with respect to DSH for the TXV at 95F OAT. Curve 173 provides the $2^{nd}$ function of UC with respect to DSH for the NT and TXV averaged over 82 and 95F OAT.

Figure 9:
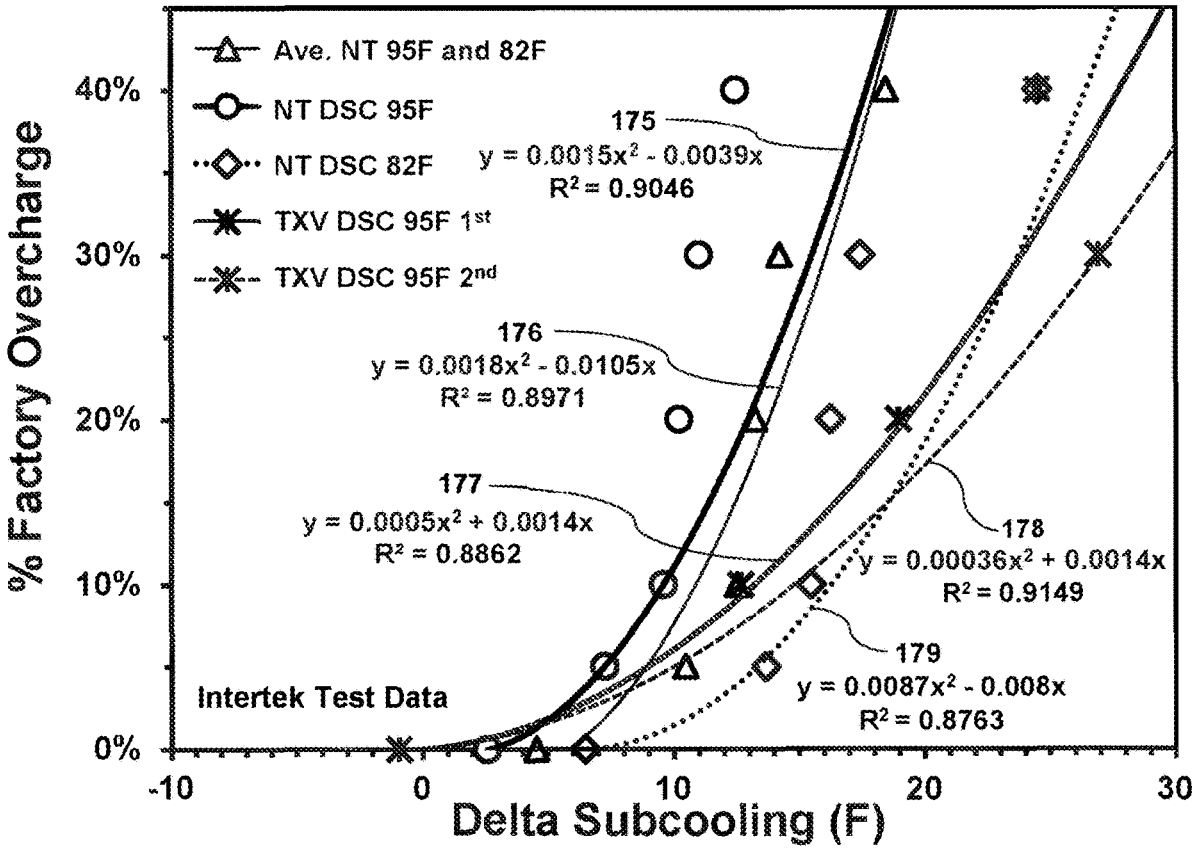
FIG. 9 provides laboratory test data of the AC system with the NT and the TXV with 0% to +40% Factory Overcharge (OC) versus a Delta Subcooling (DSC) temperature (F).

FIG. 9 provides laboratory test data for the AC system with an NT and a TXV for tests with 0 to +40% factory OC versus DSC (F). Curve 175 provides the $3^{rd}$ function of OC with respect to the DSC for the NT at 95F OAT. Curve 179 provides the $3^{rd}$ function of OC with respect to the DSC for the NT at 82F OAT. Curve 176 provides the $3^{rd}$ function of OC with respect to the DSC for the NT averaged over 82 and 95F. Curve 177 provides the $3^{rd}$ function of OC with respect to the DSC for the TXV at 95F OAT. Curve 178 provides a more conservative $3^{rd}$ function of OC with respect to the DSC for the TXV at 95F OAT. The $3^{rd}$ function provides lower values to avoid removing too much refrigerant. Other $3^{rd}$ functions of OC with respect to DSC may also be used.

FIG. 10 provides laboratory test data of two packaged AC systems with a single compressor (1C) with the NT and the TXV and two different packaged AC systems with two compressors (2C) with the NT and the TXV with 0 to −50% factory UC versus the DTS temperature. Curve 180 provides the $1^{st}$ function of UC with respect to the DTS for the NT packaged 1C system at 95F OAT with economizer damper closed and 23.5% outdoor airflow. Curve 181 provides the $1^{st}$ function of UC with respect to the DTS for the TXV packaged 1C system at 95F OAT with economizer damper closed and 19.9% outdoor airflow. Curve 182 provides the $1^{st}$ function of UC with respect to the DTS for the NT packaged 2C system at 95F OAT with economizer damper closed and 16% outdoor airflow. Curve 183 provides the $1^{st}$ function of UC with respect to the DTS for the TXV packaged 2C system at 95F OAT with economizer damper closed and 12.7% outdoor airflow. Other $1^{st}$ functions of UC with respect to the DTS for single or multiple compressor AC systems may be used.

Figure 11:
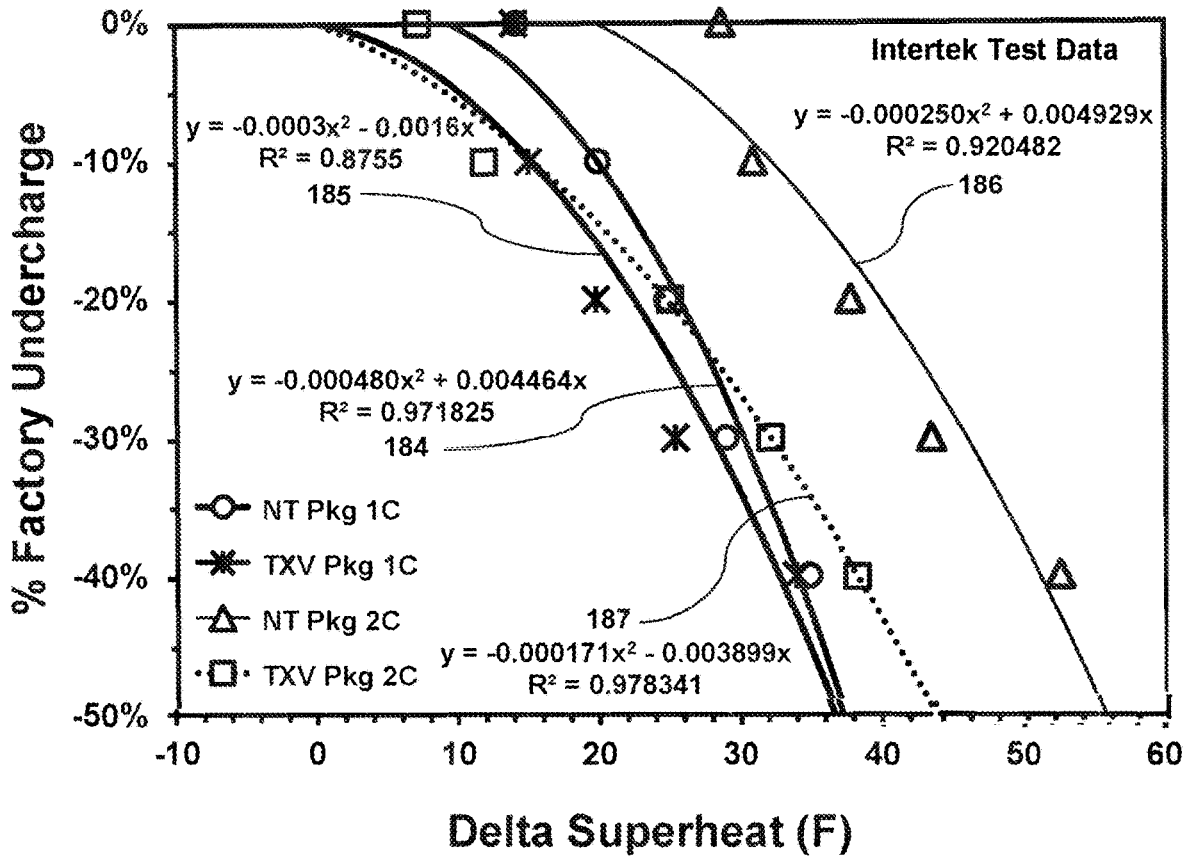
FIG. 11 provides laboratory test data of two packaged AC systems with one compressor (1C) and two packaged AC systems with two compressors (2C) with the NT and the TXV and 0% to −50% Factory UC versus the DSH (F).

FIG. 11 provides laboratory test data of two packaged AC systems with a single compressor (1C) with the NT and the TXV and two different packaged AC systems with two compressors (2C) with the NT and the TXV with 0 to 50% factory UC versus the DSH. Curve 184 provides the $2^{nd}$ function of UC with respect to the DSH for the NT packaged 1C system at 95F OAT with economizer damper closed and 23.5% outdoor airflow. Curve 185 provides the $2^{nd}$ function of UC with respect to the DSH for the TXV packaged 1C system at 95F OAT with economizer damper closed and 19.9% outdoor airflow. Curve 186 provides the $2^{nd}$ function of UC with respect to the DSH for the NT packaged 2C system at 95F OAT with economizer damper closed and 16% outdoor airflow. Curve 187 provides the $2^{nd}$ function of UC with respect to the DSH for the TXV packaged 2C system at 95F OAT with economizer damper closed and 12.7% outdoor airflow. Specific DSH versus UC curves for single or multiple compressor AC systems may be provided. Other $2^{nd}$ functions of UC with respect to the DSH for single or multiple compressor AC systems may be used.

Figure 12:
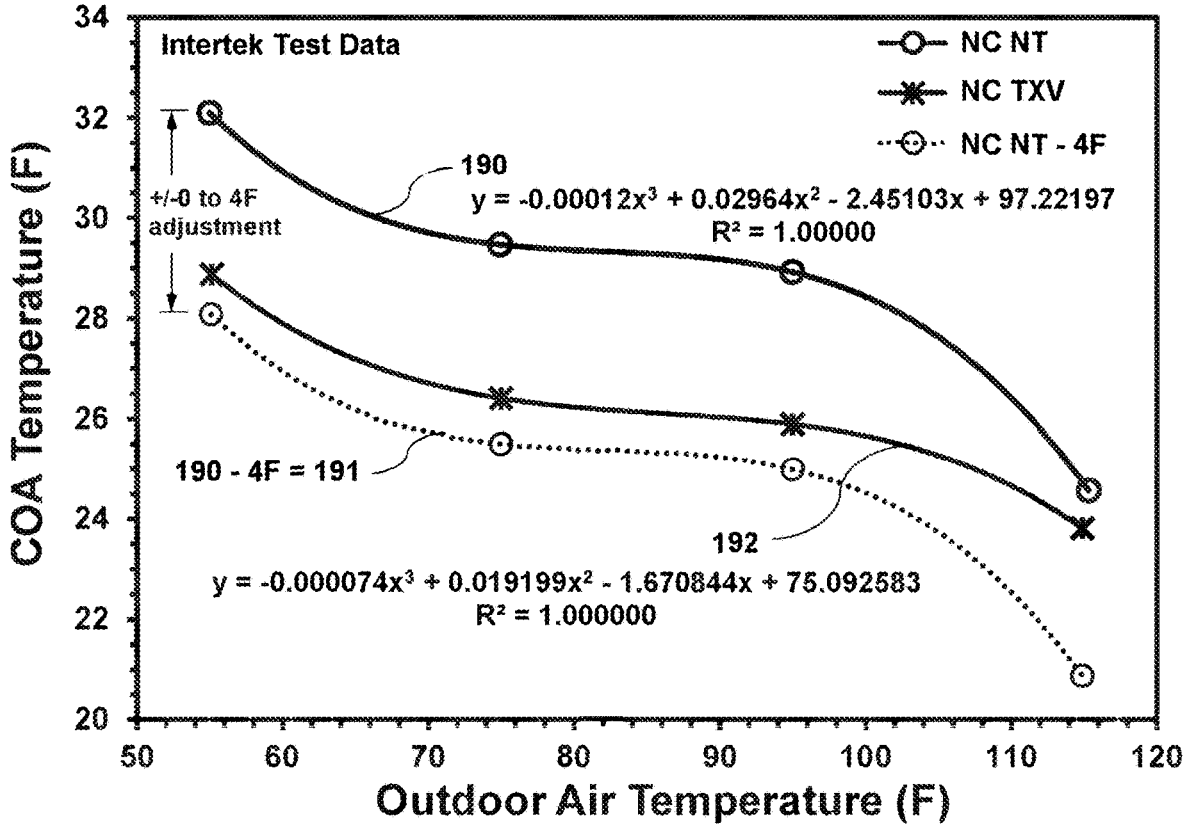
FIG. 12 provides laboratory test data of the AC system with the NT and the TXV with FC and 0.3% Non-Condensables (NC) providing a Condenser Over Ambient (COA) temperature (F) versus an Outdoor Air Temperature (OAT) (F).

FIG. 12 provides laboratory test data of the AC system with an NT and a TXV for tests performed with 0.3% Non-Condensables (NC) by weight per FC providing the Condenser Over Ambient (COA) temperature (F) versus OAT (F). Curve 190 provides the $4^{th}$ function of COA with respect to the OAT for the NT from 55 to 115F OAT. Curve 191 provides the same $4^{th}$ function as curve 190 minus 4F showing how the method may adjust the functional relationship by +/−0 to 4F depending on conditions such as first, intermediate, or final measurement, age of equipment, measurement error, and user inputs. Curve 192 provides the $4^{th}$ function of COA with respect to the OAT for the TXV from 55 to 115F OAT. Other $4^{th}$ functions may be used.

Figure 13:
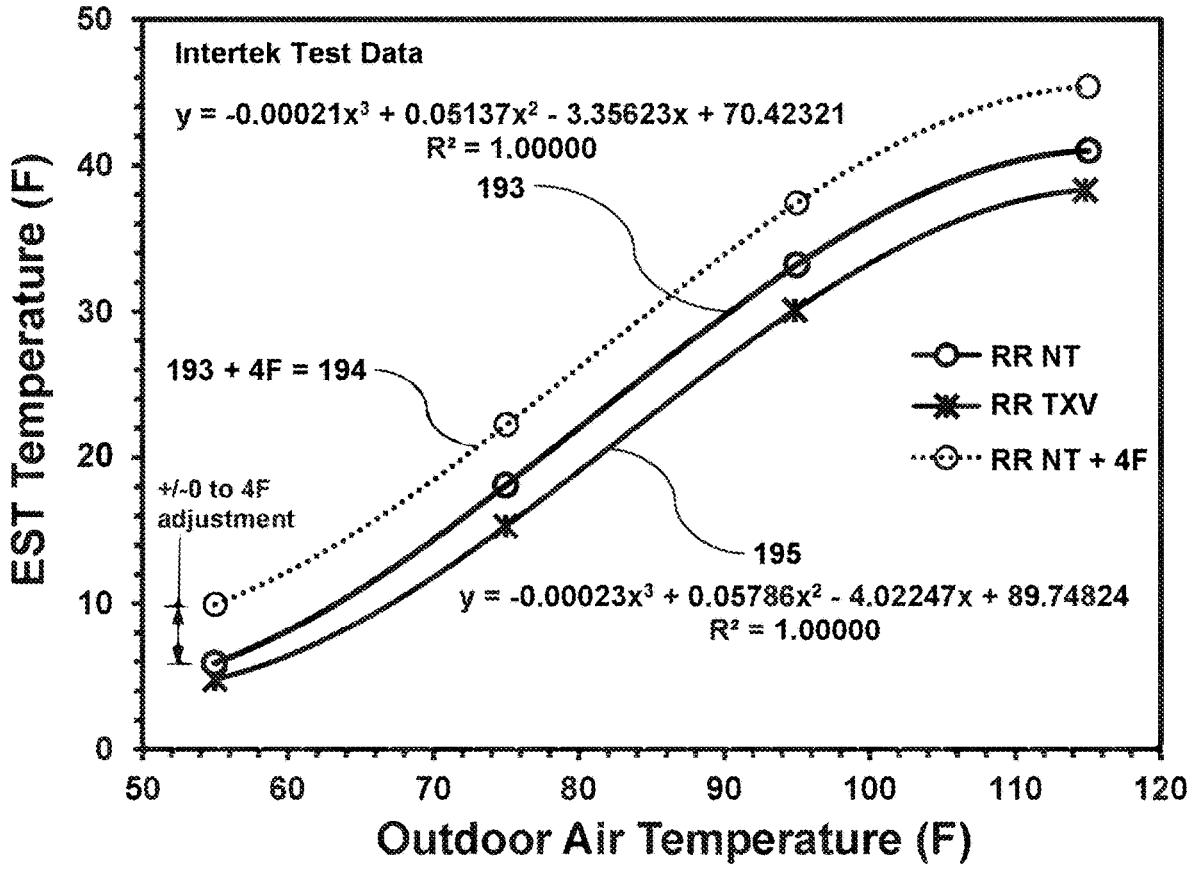
FIG. 13 provides laboratory test data of the AC system with an NT and a TXV for tests performed with the FC and a Refrigerant Restriction (RR) providing Evaporator Saturation Temperature (EST) versus the OAT (F).

FIG. 13 provides laboratory test data of the AC system with an NT and a TXV for tests performed with the FC and a Refrigerant Restriction (RR) providing EST versus OAT (F). Curve 193 provides the $5^{th}$ function of EST with respect to the OAT for the NT expansion from 55 to 115F OAT. Curve 194 provides the same $5^{th}$ function as curve 193 plus 4F showing how the method may adjust the $5^{th}$ function by +/−0 to 4F depending on conditions such as first, intermediate, or final measurement, age of equipment, measurement error, and user inputs. Curve 195 provides the $5^{th}$ function of EST with respect to the OAT for the TXV from 55 to 115F OAT. Other functions may be used.

Figure 14:
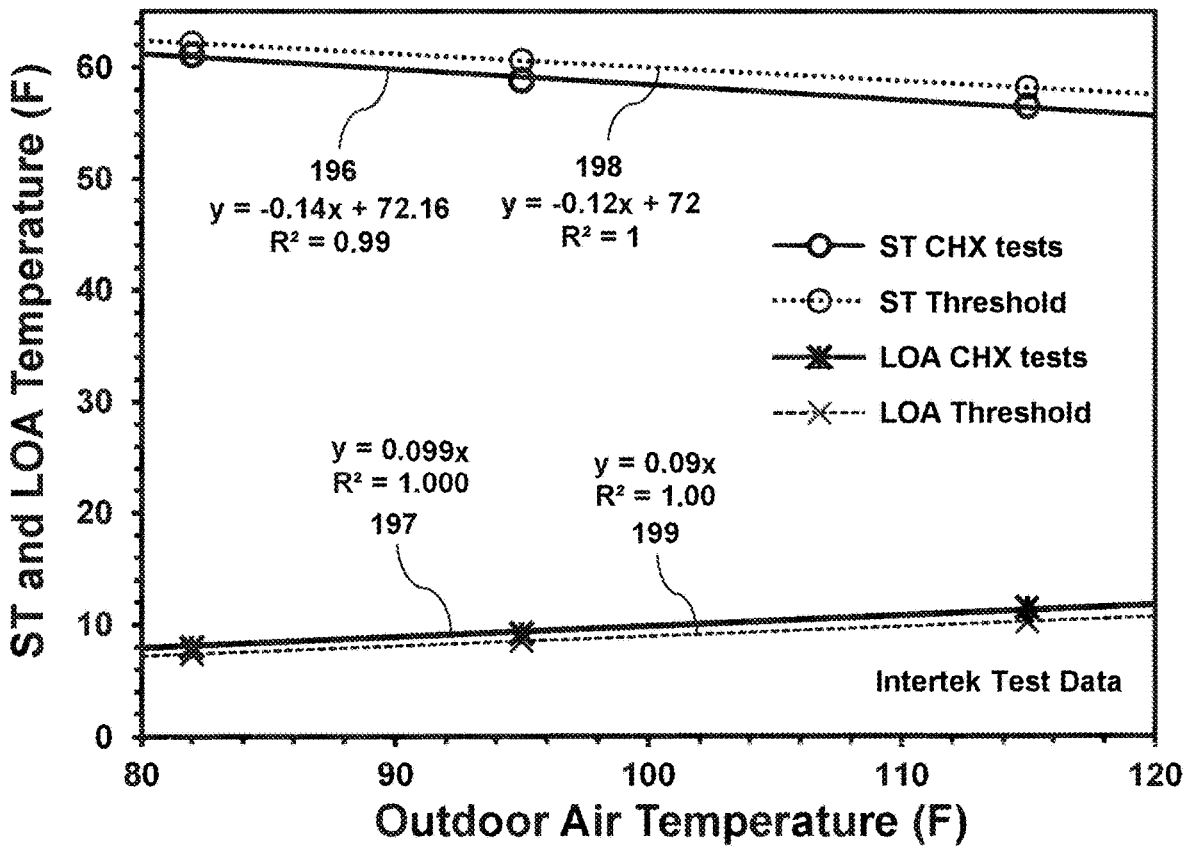
FIG. 14 provides laboratory test data of the AC system with the NT and a Condenser Heat Exchanger (CHX) fault with a 10% coil blockage providing Suction Temperature (ST) and Liquid Over Ambient (LOA) temperature versus OAT (F).

FIG. 14 provides laboratory test data of the AC system with an NT for tests performed with the FC and CHX faults with 10% coil blockage reducing condenser airflow providing. Coil blockage impacts are tested in the laboratory by placing a hood over the condenser discharge to reduce airflow or by blocking intake airflow with corrugated plastic sheeting. FIG. 14 provides Suction Temperature (ST) and Liquid Over Ambient (LOA) temperature versus OAT at 82F, 95F, and 115F for 10% coil blockage. Curve 196 provides the functional relationship between the OAT and the ST. Curve 198 provides a ST Threshold based on curve 196 plus 1 to 1.5F. The ST Threshold is used to diagnose a CHX fault based on the ST and the OAT. The method may adjust the functional relationship depending on conditions such as first, intermediate, or final measurement, age of equipment, measurement error, expansion device, number of compressors, economizer outdoor airflow, and user inputs. Curve 197 provides the functional relationship between the OAT and the LOA. Curve 199 provides an LOA Threshold based on curve 197 minus 0.6 to 1.5F. The LOA Threshold is used to diagnose a CHX fault based on the LOA and the OAT. The 10% coil blockage reduced sensible efficiency by 3%, increased the COA by about 3F, and increased condenser pressure and compressor power by 4%. Dirty or blocked condenser coils can cause false alarm diagnostics of refrigerant over charge or non-condensables.

FIG. 15 provides a flow chart of an embodiment of the Refrigerant System Diagnostic (RSD) method starting at step 201. At step 202, the method measures the following temperatures and pressures: RDT, RWT, SDT, OAT, LT, ST, SP, EST, LP, and CST. For packaged systems, an LP Schrader valve might not be available so a Discharge Pressure (DP) will be measured. At step 203, the method monitors the AC system reaching an equilibrium condition based on the AC system temperatures and pressures measured in step 202 reaching an equilibrium based on the rate of change of the AC system temperatures with respect to time (dT/dt) or the rate of change of refrigerant pressure (SP, LP or DP) with respect to time (dP/dt not shown). The rate of change the temperature (dT/dt) of the EST based on SP and the CST based on LP or DP may also be used to check equilibrium with the RSD method. Step 203 avoids diagnosing and reporting a false positive or a false negative result. If step 203 is No (N), then the method goes to step 203*a* to provide an optional message "AC system pending equilibrium, please verify clean air filter, clean and dry CC, and the AC system is operating for at least 10 minutes to reach equilibrium." If AC system equilibrium is not reached in 15 to 20 minutes, the message might provide another optional message "AC system faults check airflow, blocked air filter, EHX or CHX faults, refrigerant leaks, expansion valve (or heat pump reversing valve) faults, AC compressor faults, or other faults." For a packaged AC system with an air-side economizer, the method may report a message: "Check economizer supply-air dampers are fully closed (or temporarily sealed) and return-air dampers are fully open to reduce economizer outdoor airflow" based on OAT greater than a threshold value (e.g., 95F). After step 203*a*, the method goes to step 202 to continue measuring AC system temperatures. If step 203 is Yes (Y), the method goes to step 204.

At step 204, the method calculates ATS based on RTD minus SDT, RTS based on RDT and RWT, DTS based on ATS minus RTS, DSH based on ASH minus RSH, DSC based on ASC minus RSC, COA based on CST minus OAT, and LOA based on LT minus OAT. At step 205, the method processes the AC system temperatures and diagnoses proper Refrigerant Charge and Airflow (RCA) based on DTS and LOA or the at least one AC system fault based on DTS, ST, LOA, OAT, DSH, and ASH.

Step 206 evaluates an RC, or an HP fault based on the SDT greater than or equal to RDT per the following example equation.

IF(OR(SDB>=RDB,DTS<−15,ST>84), is Yes (*Y*) go to step 207, otherwise go to step 208. Eq. 25

Other variables may be used in the above equation depending on machine learning. If step 206 is Yes (Y) the method goes to step 207 to report "Check RC or HP" abbreviated for "Check refrigerant charge leaks or HP check reversing valve." If step 206 is No (N) the method goes to step 208.

Step 208 evaluates a CHX fault based on the ST, the DTS, the LOA, and the COA per the following example equation wherein the ST threshold varies based on OAT (per curve 198 and curve 199 in FIG. 14), and number of compressors (#C).

IF(AND(IF(OR(#*C*>1,OAT>100),ST<(−0.12*OAT+75),ST<(−0.12*OAT+72)),DTS<=1.5,LOA>(0.09*OAT),COA>15) is Yes (*Y*) go to step 209, otherwise go to step 210. Eq. 26

If step 208 is Yes (Y) the method goes to step 210 to report "Check CHX or clean CC." If step 208 is No (N), the method goes to step 209.

At step 209, the method evaluates multiple faults comprising at least the CHX, the OC, and the UC per the following example equation. Other faults identified by the NTD method from FIG. 3 will also be reported.

IF(AND(ST>72,LOA>11), is Yes (*Y*) go to step 211, otherwise go to step 212. Eq. 27

If step 209 is Yes (Y), the method goes to step 211 and performs additional fault detection regarding CHX, OC, and UC faults using the following example equation based on Eq. 42 (curve 178) and Eq. 52 (curve 174) for TXV and Eq. 43 (curve 175) and Eq. 53 (curve 171) for NT.

IF(AND("TXV",ABS(DSC)<3), "Clean CC", IF("TXV",IF(OR(DSC>3,DSH<0),CONCATENATE("Clean CC, Remove Chg:",(ABS(0.00036*DSC^2+0.0014*DSC), "0%")),CONCATENATE("Clean CC, Add Chg:",(ABS(0.00779*DSH), "0%"))), IF(ABS(DSH)<=5, "Clean CC",IF(DSH<5, CONCATENATE("Clean CC, Remove Chg:", ABS(0.0015*DSC^2-0.0039*DSC), "0%")),CONCATENATE("Clean CC, Add Chg:", ABS(−0.000097*DSH^2-0.000566*DSH), "0%")))))). Eq. 28

At step 211 the method reports "Check CHX, OC, or UC faults" or "Clean CC, Remove Charge: X %, or Clean CC, Add Charge: X %" based on expansion device (NT or TXV). The refrigerant charge recommendation may be provided if greater than a minimum (5 to 7.5% UC). From step 211, the method may go to step 210 and loop back to step 202 or go to step 229 and continue. If step 209 is No (N), the method goes to step 212.

Step 212 evaluates an EHX or EA fault (low airflow) based on the ST, the DTS, the LOA, and the ASC per the following example equation.

IF(AND(ASC<18,OR(AND(ST<=50,DTS>=2),OR(DTS>2,AND(DTS>0.1,DTS<1.5)))) is Yes (*Y*) then go to step 213, otherwise go to step 214. Eq. 29

If step 212 is Yes (Y), the method goes to step 213 and checks for EHX faults using the following example equation.

IF(AND(DSH<−5, DSC>3) is Yes (*Y*) then go to step 214, otherwise go to step 215. Eq. 30

If step 213 is Yes (Y), the method goes to step 214 and checks for a TXV (based on user entry). If step 214 is Yes (Y), the method goes to step 217 and reports "Check EHX, EA, or TXV." If step 214 is No (N) the method goes to step 216 and reports "Check EHX or EA." If step 213 is No (N), the method goes to step 215 and reports "Check low airflow." If Step 212 is No (N), the method goes to step 218.

At step 218, the method checks the ASC and the DSH and compares the EST to an EST threshold ($EST_t$) based on the following example equation.

IF(AND(ASC>7,DSH>30*F*), EST<$EST_t$) is Yes (*Y*) go to step 225, otherwise go to step 219. Eq. 31

Where, EST: is based on a fifth mathematical function ($f_r$) (or $5^{th}$ function) with the OAT as the independent variable which may vary based on the expansion device (i.e., NT or TXV).

$$5^{th}\text{ Function EST threshold}=EST_t=f_r(OAT,NT,TXV) \quad \text{Eq. 32}$$

The following example equations from FIG. 13 may be used to calculate the EST; and check if the EST indicates RR, EHX, or other faults. For the NT, the following $5^{th}$ function ($f_r$) (curve 193 in FIG. 13) may be used.

$$f_r(OAT,FO)=-0.00021*x^3+0.05137*x^2-3.35623*x+70.42321 \quad \text{Eq. 33}$$

Where, $f_r$(OAT,FO)=EST, lower limit based on Intertek laboratory tests of RR for an NT and the coefficient 70.42321 may be adjusted by +/−0 to 4F depending on conditions (F), and x=OAT (F).

For a TXV the method may use a different $f_r$ function (curve 195 in FIG. 13).

$$f_r(OAT,TXV)=-0.00023*x^3+0.05786*x^2-4.02247*x+89.74824 \quad \text{Eq. 34}$$

Where, $f_r$(OAT,TXV)=EST, lower limit based on Intertek laboratory tests of RR for a TXV wherein the $4^{th}$ coefficient 89.74824 may be adjusted by +/−0 to 4F depending on conditions (F), and x=OAT (F).

If step 218 is Yes (Y), the method goes to step 225 and reports "Detect RR: EST<$f_r$(OAT,NT,TXV)." Other messages may include: "locate RR, recover refrigerant, remove RR, evacuate to 500 microns and hold at 500 microns or less for at least 15 minutes, and recharge with clean refrigerant per EPA 608." The low EST may involve an EHX or TXV issue. The RR may be detected by measuring a temperature drop across an expansion device, kinked liquid line, or plugged filter drier. After step 225, the method then goes to step 227 to report or correct the RR or other faults and returns to step 203 to continue. If step 218 is No (N), the method goes to step 219.

Step 219 checks the ST, the LOA, the ASC, and the DSH and compares the COA to a COA threshold ($COA_t$) based on the following example equation.

IF(AND(OR(ST>55,AND(ST>=52.5,LOA<=5)), ASC>18,DSH>−13),COA>$f_c$(OAT,NT,TXV)) is Yes (*Y*) go to step 220, otherwise go to step 229. Eq. 35

Where, $COA_t$ is based on a fourth mathematical function ($f_c$) (or $4^{th}$ function) with the OAT as the independent variable which may vary based on the expansion device (i.e., NT or TXV).

$$4^{th}\text{ Function COA threshold}=COA_t=f_c(OAT,NT,TXV) \quad \text{Eq. 36}$$

The following example equations from FIG. 12 may be used to check if the COA is high enough to indicate the CHX or the NC fault. For the NT the following function ($f_c$) (curve 190 from FIG. 12) may be used. Other equations may be used.

$$f_c(OAT,FO)=-0.00012*x^3+0.02964*x^2-2.45103*x+97.22197 \quad \text{Eq. 37}$$

Where, $f_c$ (OAT,FO)=$COA_t$ upper limit based on Intertek laboratory tests of NC for an NT wherein the $4^{th}$ coefficient 97.22197 may be adjusted by +/−0 to 4F depending on conditions (curve 191 reduces the $4^{th}$ coefficient to 93.22197), and x=OAT (F).

For a TXV the method may use a different $f_c$ function (curve 192 from FIG. 12).

$$f_c(OAT,TXV)=-0.000074*x^3+0.01920*x^2-1.67084*x+75.09258 \quad \text{Eq. 38}$$

Where, $f_c$ (OAT,TXV)=$COA_t$ upper limit based on Intertek lab tests of NC for a TXV wherein the $4^{th}$ coefficient 75.09258 may be adjusted by +/−0 to 4F depending on conditions, and x=OAT (F).

If step 219 is Yes (Y), then the method proceeds to step 220 to report "Detect NC: CST>$f_c$(OAT,NT,TXV)." Other messages may include: "clean CC, repair HX issues, recover refrigerant, evacuate to 500 microns and hold at 500 microns or less for at least 15 minutes, recharge with clean refrigerant per EPA 608." Some After step 220 the method goes to step 227 to report or correct the NC or other faults and returns to step 203 to continue.

If step 219 is No (N), the method goes to step 229 to check other faults. If step 229 is Yes (Y), a TXV is installed (based on user entry), the method goes to step 231 to check RC, if the DSC is within +/−3F using the following example equation.

IF(ABS(DSC)<=3*F*) is Yes (*Y*) go to step 241, otherwise go to step 235. Eq. 39

If step 231 is Yes (Y), the method goes to step 241 and reports "Verified RCA." If step 231 is No (N), the method goes to step 235 and checks OC using the following example equation.

IF(OR(DSC>3,DSH<−1) is Yes (*Y*) go to step 236, otherwise go to step 244. Eq. 40

If step 235 is Yes (Y), the method goes to step 236 to detect the OC amount using the following third mathematical equation ($f_o$) (or $3^{rd}$ function) with DSC as the independent variable. The $3^{rd}$ function varies based on the DSC and may also vary based on the OAT and the expansion device (i.e., NT or TXV).

$$3^{rd}\text{ Function}=UC=f_o(DSC,OAT,NT,TXV). \quad \text{Eq. 41}$$

For a TXV, the following $3^{rd}$ function of OC with respect to DSC at 95F OAT (curve 177 shown in FIG. 9) may be used.

$$f_o(DSC,TXV)=y_{txv}=0.0005*x^2+0.0014*x \quad \text{Eq. 42}$$

Where, $y_{txv}$=% OC for a TXV device, and x=Delta Subcooling (DSC) (F).

For the TXV, curve 178 shown in FIG. 9 provides a more conservative $3^{rd}$ function of OC with respect to the DSC at 95F OAT.

$$f_o(DSC,TXV)=y_{txv}=0.00036*x^2+0.0014*x \quad \text{Eq. 43}$$

Where, $y_{txv}$=% OC for a TXV device, and x=DSC (F). Other functions of DSC may also be used.

For the NT, the method may use a different $3^{rd}$ function of OC with respect to DSC. For OAT greater than or equal to 90F, the following $3^{rd}$ function (curve 175 in FIG. 9) may be used.

$$f_o(DSC,NT)=y_{nt}=0.0015*x^2-0.0039*x \quad \text{Eq. 44}$$

Where, $y_{nt}$=% OC for an NT device for OAT greater than or equal to 90F, and x=DSC (F).

For OAT less than 90F, the following $3^{rd}$ function (curve 179 in FIG. 9) may be used for NT.

$$f_o(DSC,NT)=y_{nt}=0.00087*x^2-0.008*x \quad \text{Eq. 45}$$

Where, $y_{nt}$=% OC for an NT device at OAT less than 90F, and x=DSC (F).

For the NT, the $3^{rd}$ function of OC with respect to the DSC may be averaged over 82F and 95F OAT (curve 176 in FIG. 9).

$$f_o(\text{DSC,NT})=y_{nt}=0.0018*x^2-0.0105*x \quad \text{Eq. 46}$$

Where, $y_{nt}$=% OC for an NT device for OAT ranging from 80F to greater than 95F, and x=DSC (F).

In one embodiment, the maximum value of the OC function, $f_o$(DSC,OAT,NT,TXV), might default to 0.4+/−0.1 or 1.0 (for flat leaking systems requiring evacuation) or set by a user. The OC functions may also vary for packaged AC systems, the number of compressors, and whether an air economizer is installed which may impact the DSC measurements.

After step 236, the method proceeds to step 237 to check if the absolute value of the OC is less than or equal to a minimum (MIN) value (e.g., 5 to 7.5% of factory charge) based on the $3^{rd}$ function.

IF(ABS($f_o$(DSC,OAT,NT,TXV))<=MIN) is Yes (*Y*) go to step 248, otherwise go to step 239. Eq. 47

If step 237 is Yes (Y), the method goes to step 248 and reports "Verified RCA." If step 237 is No (N), the method goes to step 239 and reports "Detect OC: X %" based on the $3^{rd}$ function. The method then goes to step 227 to report or correct the OC or other faults and returns to step 203 to continue.

If step 229 is No (N), (for an NT and not a TXV) the method goes to step 233 to check OC or UC faults using the following example equation to check DSH.

IF(ABS(DSH)<=5) is Yes (*Y*) go to step 241, otherwise go to step 243. Eq. 48

If step 233 determines the absolute value of DSH is less than or equal to 5F, the method proceeds to step 241 and reports "Verified RCA." If step 233 determines the absolute value of DSH is greater than 5F, then the method proceeds to step 243 to determine if DSH is less than −5F and/or DSC is greater than +3F indicating an OC using the following example equation. For overcharged packaged units with economizers and split systems with a TXV, the DSC will be greater than 3F, but the DSH might be zero to less than 5F. Overcharged AC systems with NT devices will typically have DSH less than −5F.

IF(OR(AND(DSH<−5,DSC>3),DSH<5,DSC>3)) is Yes (*Y*) go to step 236, otherwise go to step 244. Eq. 49

If step 243 determines the DSH is less than −5F or less than 5F and the DSC is greater than 3F indicating an OC fault, then the method goes to step 236 to check if the OC is less than or equal to a minimum (MIN) value (e.g., 5 to 7.5%) using the $3^{rd}$ function described above ($f_o$). Known RC methods only identify OC if the DSH is less than −5F for NT devices or the DSC is greater than +3F for TXV devices.

If step 243 is No (N), then the DSH is greater than +5F indicating a UC fault for the NT and the method goes to step 244. For the TXV, if step 235 is No (N), then the DSC is less than −3F indicating a UC fault and the method goes to step 244.

At step 244 the method detects the UC amount using the following second (2nd) mathematical equation ($f_u$) (or $2^{nd}$ function) with DSH as the independent variable. The 2nd function varies based on the DSH and may also vary based on the OAT, number of compressors (#C), and expansion device (e.g., the NT or the TXV).

$$2^{nd}\ \text{Function}=\text{UC}=f_u(\text{DSH,OAT,NT,TXV}) \quad \text{Eq. 50}$$

For a split AC system with TXV, the following $2^{nd}$ function (curve 174) shown in FIG. 8 may be used. Other functions of DSH may also be used.

$$f_u(\text{DSH,TXV})=y_{txv}=-0.00779*x \quad \text{Eq. 51}$$

Where, $y_{txv}$=% UC for a TXV device, and x=Delta Superheat (DSH) (F).

For a split AC system with NT, the method may use a different $2^{nd}$ function. For OAT greater than or equal to 90F, the following example function (curve 171) shown in FIG. 8 may be used. Other functions with DSH or DTS as independent variables may also be used. Functions with DSC may be used, but DSC is relatively constant for UC as shown in FIG. 16 and FIG. 17.

$$f_u(\text{DSH,NT})=y_{nt}=-0.000097*x^2-0.000566*x \quad \text{Eq. 52}$$

Where, $y_{nt}$=% UC for an NT device for OAT greater than or equal to 90F, and x=DSH (F).

For a split AC system with the NT and OAT less than 90F, the following example 2nd function is curve 172 shown in FIG. 8 may be used.

$$f_u(\text{DSH,NT})=y_{nt}=-0.000068*x^2-0.003068*x \quad \text{Eq. 53}$$

Where, $y_{nt}$=% UC for an NT device at OAT less than 90F, and x=DSH (F).

For the NT, the $2^{nd}$ function of UC with respect to the DSH may be averaged over 82F and 95F OAT per curve 173 shown in FIG. 8.

$$f_u(\text{DSH,NT})=y_{nt}=-0.000057*x^2-0.003857*x \quad \text{Eq. 54}$$

Where, $y_{nt}$=% UC for an NT device at OAT ranging from 80F to greater than 95F, and x=DSC (F).

For a single compressor packaged AC system with the NT, the method may use the following example $2^{nd}$ function ($f_u$) (curve 184) as shown in FIG. 11.

$$f_u(\text{DSH},1C,\text{NT})=y_{nt}=-0.000480*x^2+0.004464*x \quad \text{Eq. 55}$$

Where, $y_{nt}$=% UC with the NT, and x=DSH (F).

For a single compressor packaged split AC system with the TXV the method may use a different example $2^{nd}$ function ($f_u$) (curve 185) as shown in FIG. 11.

$$f_u(\text{DSH},1C,\text{TXV})=y_{txv}=-0.0003*x^2-0.0016*x \quad \text{Eq. 56}$$

Where, $y_{txv}$=% UC for the TXV, and x=DSH (F).

For a multiple compressor packaged AC system with the NT the method may use the following example $2^{nd}$ function ($f_u$) (curve 186) as shown in FIG. 11.

$$f_u(\text{DSH},\#C,\text{NT})=y_{nt}=-0.000250*x^2+0.004929*x \quad \text{Eq. 57}$$

Where, $y_{nt}$=% UC for the NT, and x=DSH (F).

For a multiple compressor packaged split AC system with the TXV the method may use a different example $2^{nd}$ function ($f_u$) (curve 187) as shown in FIG. 11.

$$f_u(\text{DSH},\#C,\text{TXV})=y_{txv}=-0.000171*x^2-0.003899*x \quad \text{Eq. 58}$$

Where, $y_{txv}$=% UC for the TXV, and x=DSH (F).

In one embodiment, the maximum calculated value of the $2^{nd}$ function for UC, $f_u$(DSH,OAT, #C,NT,TXV), might default to 0.4+/−0.1 or 1.0 (for flat leaking systems requiring evacuation) or be set by a user. As described above, other functions may also be used depending on whether an air-side economizer is installed on a packaged AC system which may impact the measurements. Therefore, the method may comprise instructions to close the economizer outdoor air damper and fully open the return air damper to reduce outdoor airflow when performing the method.

At step 245 the method checks if the absolute value of the UC is less than or equal to a minimum (MIN) value (e.g., 5 to 7.5% of factory charge) using the $2^{nd}$ function based on the DSH. The $1^{st}$ function based on the DTS may also be used to determine the UC amount.

IF(ABS($f_u$(DSH,OAT,#C,NT,TXV))<=MIN) is Yes (Y) go to step 248, otherwise go to step 247. Eq. 59

If step 245 is Yes (Y) (the UC is less than or equal to the MIN), then the method proceeds to step 248 and reports "Verified RCA." If step 245 is No (N), then the method goes to step 247 and reports "Detect UC: X %." The method then goes to step 227 to report or correct the UC or other faults and returns to step 203 to continue.

FIG. 16 provides a third set of data from Intertek laboratory tests of the AC system with the NT or the TXV and information provided by the Refrigerant System Diagnostic (RSD) method. The RSD method uses DSC to provide accurate recommendations for the NT OC per test 402 and test 403 and TXV OC per test 418 through test 420. The RSD method detects less than the actual OC for test 404 through test 406, and test 421. The method provides accurate UC recommendations for the NT UC per test 409 through test 412 and TXV UC test 424 through test 427. The RSD method correctly identifies low airflow for test 413 through test 415, test 429, and test 430. The RSD method correctly identifies RR for test 432 through test 435 and correctly identifies NC for NT per test 436 through test 440 and TXV per test 441 through test 445. FIG. 15 shows the RSD method which uses DSH to diagnose UC and provides similar recommendations to the NTD method shown in FIG. 4. FIG. 16 shows the RSD method using DSH to diagnose UC is within +/−1% of the NTD method using DTS to diagnose UC as shown in FIG. 4.

FIG. 16 shows DSC is relatively constant for UC tests and does not provide a useful diagnostic signal. The manufacturer Required Subcooling (RSC) is 7F for the TXV unit tested. For NT UC per test 409 through test 412, the DSC ranges from −3.5 to −7.8 and for TXV UC test 424 through test 427, the DSC ranges from −6.9 to −7.7F. However, for the NT OC per test 402 through test 406, the DSH is almost constant from −10.1 to −10.7F while the DSC ranges from 7.3 to 12.4F indicating DSC is a better indicator to diagnose OC than the other measurements. For TXV OC per test 417 through test 421, the DSH is almost constant from −8.3 to −10.4F while the DSC ranges from −5.1 to 24.5F indicating DSC is more useful for diagnosing OC faults.

FIG. 17 provides a fourth set of data from Intertek laboratory tests of AC systems with the NT and the TXV and information provided by the RSD method. The RSD method correctly identifies RR for TXV test 446 through test 449 and correctly identifies NC for TXV tests 450 through 453. The RSD method correctly identifies CC blockage for test 455 through test 460. The RSD method also correctly identifies the UC for test 463 through test 466 and identifies the OC for test 467. However, the RSD detects less than the actual OC for test 468 through test 470. It is much more difficult to detect OC above 10% overcharge due to DSH and DSC being relatively constant above 10% OC. For the NT packaged single compressor (1C) test 471 through test 475, the RSD method properly identifies the base FC and all UC faults including test 472 with low airflow and OC. Due to low airflow, only 12% OC is reported instead of 20% OC. For the TXV packaged single compressor (1C) test 476 through test 480, the base FC and UC tests are properly identified. For the TXV packaged two compressor (2C) tests the base FC and all UC fault tests are properly identified. Due to economizer outdoor airflow, the RSD method is less accurate detecting the UC faults by 5 to 7%.

FIG. 17 shows the RSD method using DSH to diagnose UC provides similar recommendations to the NTD method using DTS as shown in FIG. 5. The RSD and the NTD method are within +/−2% of each other. FIG. 17 shows DSC is relatively constant for UC tests and does not provide a useful signal. The NT UC the DSC ranges from −8.3 to +2.5F for test 463 through test 466 at 82F OAT and the DSH ranges from 12.1 to 57.4F for the same tests. However, for the NT OC test 467 through test 470, the DSH is almost constant from −17 to −17.9F while the DSC ranges from 15.5 to 24.5F indicating DSC is a better indicator to diagnose OC than any other measurement.

FIG. 18 provides a fifth set of data comparing 45 Intertek tests with the NTD method, the RSD method, the known TS method, and known RC method. The NTD and RSD methods properly diagnose all 45 Intertek tests including test 501 through test 545. The known TS method is accurate for the 100% charge tests including test 501, test 507, test 516, test 522, test 528, test 531, and test 541. The TS method is also accurate for the 22.8% low airflow test 514 and the 36.1% low airflow test. However, the known TS method is only correct for 11 out of 45 tests in FIG. 18. The known RC method provides the correct RC information for test 501 through test 512, test 516, and test 518 through test 528, test 531, and test 541. However, the known RC method does not provide information about the amount of UC or OC or other faults such as the low airflow test 513 through test 515, the low airflow test 529 and test 530, or the RR test 532 through test 535 or the NC test 536 through test 545.

FIG. 19 provides a sixth set of data comparing 45 Intertek tests with the NTD method, the RSD method, the known TS method, and the known RC method. The NTD and RSD methods properly diagnose Intertek tests including test 546 through test 590. The known TS method correctly diagnoses the base test 550, test 554, test 561, test 576, test 581, and test 582. All other tests are misdiagnosed or misdetected as "airflow correct" or "decrease fan speed." The known RC method correctly diagnoses test 554 (base), test 560 (NT-20% charge 30% coil blockage), test 562 through test 566 (NT UC), test 567 through test 570 (NT OC), test 573 through test 580, and test 582 through test 590. However, the known RC method does not provide information about the amount of UC or OC, and other faults are misdiagnosed or misdetected.

Based on 90 Intertek tests in FIG. 18 and FIG. 19, the known TS method provides 16.7% accuracy based on 15 correct tests out of 90. The known RC method provides 63.3% accuracy based on 57 correct tests out of 90. Known methods do not provide the amount of UC or OC and RR, NC, EHX, and CHX faults are misdiagnosed or misdetected. The RC method requires connecting refrigerant pressure gauges to diagnose AC system faults which causes venting of refrigerant to the atmosphere.

Figure 20:
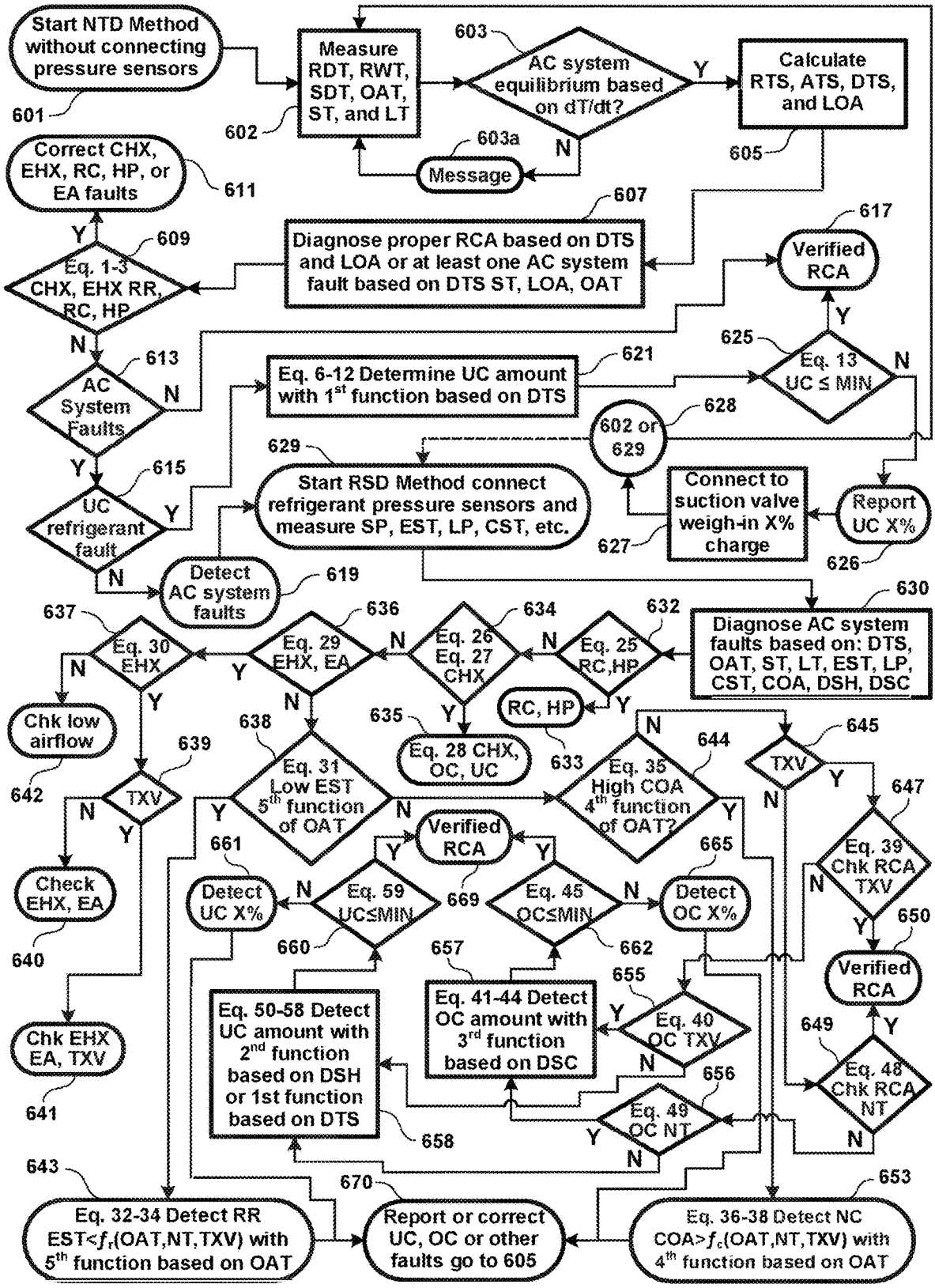
FIG. 20 provides a flow chart of an embodiment of the NTD method and the RSD method according to the present invention.

FIG. 20 provides a flow chart of an embodiment of both the NTD method and the RSD method. Due to lack of space, the NTD method is abbreviated, and would report the faults for each step based on FIG. 3. At step 602, the method measures the following AC system temperatures: the RDT, the RWT, the SDT, the OAT, the ST, and the LT. The method determines the RTS based on the RWT and the RDT (see FIG. 21), calculates DTS equal to ATS minus RTS, and calculates LOA equal to LT minus OAT.

Step 603 monitors the AC system reaching an equilibrium condition based on the AC system temperatures measured in step 602 reaching an equilibrium based on the rate of change of the AC system temperatures with respect to time (dT/dt). Step 603 avoids diagnosing and reporting a false positive or a false negative result. If step 603 is No (N), then the method goes to step 603*a* to provide an optional message "AC system pending equilibrium, please verify clean air filter, clean and dry CC, and the AC system is operating for at least 10 minutes to reach equilibrium." If AC system equilibrium is not reached in 15 to 20 minutes, the message might provide another optional message "AC system faults check airflow, blocked air filter, EHX or CHX faults, refrigerant leaks, expansion valve (or heat pump reversing valve) faults, AC compressor faults, or other faults." For a packaged AC system with an air-side economizer, the method may report a message: "Check economizer supply-air dampers are fully closed (or temporarily sealed) and return-air dampers are fully open to reduce economizer outdoor airflow" based on OAT greater than a threshold value (e.g., 95F). After step 603*a*, the method goes to step 602 measure the AC system temperatures. If step 603 is Yes (Y), the method goes to step 604.

Step 605 calculates the RTS based on the RDT minus the SDT, calculates the DTS based on the ATS minus the RTS, and calculates the LOA based on the LT minus the OAT. Step 607 diagnoses proper RCA based on the DTS and the LOA or diagnoses at least one AC system fault based on the DTS and at least one temperature selected from the group consisting of: the ST, the LOA, and the OAT. The at least one AC system fault is selected from the group consisting of: an EA or a low airflow fault, an EHX fault, a CHX fault, a TXV or NT fault, a HP reversing valve fault, an NC fault, and an RR fault (see FIG. 3). If SDT is greater than or equal to RDT, then the AC system has lost refrigerant charge or severely undercharged due to a leak, or the HP reversing valve is energized incorrectly, stuck in heating position (solenoid fault), or leaking refrigerant internally.

If step 609 is Yes (Y), the method reports "Correct CHX, EHX, RC, HP, or EA faults" and goes to step 602 to collect AC system temperature measurements with user input of correcting the AC system faults. If step 609 is No (N), the method goes to step 613 to check AC system faults. If step 613 is No (N), then the method goes to step 617 to report "Verified RCA" which ends the method without connecting refrigerant pressure gauges. If step 613 is Yes (Y), then at least one AC system fault might be present and the method goes to step 615 to check UC.

If step 615 is No (N), the method goes to step 619 and reports "Detect AC system faults" and indicates which faults are diagnosed. Insufficient space is available to show all steps of the NTD method (see FIG. 3). If step 615 is Yes (Y), then the method goes to step 621 to determine the UC amount based on the $1^{st}$ function with DTS as an independent variable (see FIG. 3). At step 625, the method checks if the absolute value of the UC is less than or equal to a minimum (MIN) UC value (e.g., 5 to 7.5% of factory charge). If step 625 is Yes (Y), the method goes to step 617 to report "Verified RCA." If step 625 is No (N), the method goes to step 626 and reports "Detect Undercharge X %." After step 626, the method proceeds to step 627 to connect a refrigerant manifold hose to a refrigerant tank on a scale and connect to the suction Schrader valve to weigh-in X % refrigerant charge and go to step 628. At step 628 the method may go to step 602 or step 629. The NTD method will go to step 602 to perform final AC system temperature measurements from step 603 through step 617 (Verified RCA). Otherwise, go to step 629 to start the RSD method.

The RSD method starts at step 629 by connecting refrigerant pressure gauges to the suction and liquid Schrader valves to measure SP 39, EST 40, LP 41, and CST 42. The method looks up RSH 46, and RSC 50 and calculates DSH 48 equal to ASH 44 minus RSH 45, DSC 52 equal to ASC 43 minus RSC 50, and COA 57 as CST 42 minus OAT 35. The steps for measuring and checking the temperature measurement equilibrium (dT/dt) and/or the pressure measurement equilibrium (dP/dt) of the AC system between step 629 and step 630 are not shown.

At step 630, the method may diagnose at least one AC system fault selected from the group consisting of: a CHX fault, an EHX fault, a low airflow EA fault, a TXV fault, a RR fault, an NC fault, UC, OC, or other faults based on the NTD or the RSD method. At step 632, the method checks if SDT is greater than or equal to RDT which was checked at step 609. Step 632 is for a stand-alone RSD method and redundant if NTD is performed. If step 632 is Yes (Y), the method goes to step 633 and reports "Check RC or HP" (discussed above). If step 632 is No (N) the method goes to step 634.

At step 634 the method checks for CHX faults (see FIG. 15). If step 634 is Yes (Y), the method goes to step 635 to report "Check CHX, OC, or UC." The OC or UC recommendation will be made if greater than a minimum. From step 635, the method may continue to step 639. If step 634 is No (N), the method goes to step 636.

At step 636, the method diagnoses an EHX or EA fault. If step 636 is Yes (Y) the method goes to step 637 and checks for EHX faults. If step 637 is No (N), the method goes to step 642 and reports "Check low airflow." If step 637 is Yes (Y), the method goes to step 639 and checks for a TXV (based on user entry). If step 639 is Yes (Y), the method goes to step 641 and reports "Check EHX, EA, or TXV." If step 639 is No (N) the method goes to step 640 and reports "Check EHX or EA." If step 636 is No (N), the method goes to step 638.

At step 638, the method checks EST based on the $5^{th}$ function with OAT as the independent variable. If step 638 is Yes (Y), the method goes to step 643 and reports "Detect RR: EST<$f_r$(OAT,NT,TXV)." The method then goes to step 670 and to report or subsequently correct the RR, UC, OC or other faults and returns to step 602 for AC system temperature measurements or continue.

If step 638 is No (N), the method goes to step 644 and checks for COA greater than a COA threshold ($COA_t$) based on the $4^{th}$ function with OAT as the independent variable. If step 644 is Yes (Y), the method goes to step 653 and reports "Detect NC: COA>$f_c$ (OAT,NT,TXV)" (discussed above). The method then goes to step 670 and to report or subsequently correct NC, UC, OC or other faults and returns to step 602 for AC system temperature measurements or continue. If step 644 is No (N), the method goes to step 645 to check for a TXV.

If step 645 is Yes (Y), the method goes to step 647 to check RCA for the TXV. If step 647 is Yes (Y), the method goes to step 650 and reports "Verified RCA." If step 647 is No (N), the method goes to step 655 to diagnose an OC for the TXV. If step 655 is No (N) for the TXV, the method goes to step 658 to determine the UC amount based on the $2^{nd}$ function or the $1^{st}$ function (discussed above). After step 658, the method goes to step 660 to check if the UC is less than or equal to a minimum (MIN) UC value. If step 660 is Yes (Y), the method goes to step 669 to report "Verified RCA." If step 658 is No (N), the method goes to step 661 to report "Detect UC: X %." The method then goes to step 670 and to report or subsequently correct UC, OC or other faults and returns to step 602 for AC system temperature measurements or continue.

If step 655 is Yes (Y) for the TXV, the method goes to step 657 to determine the OC amount based on the $3^{rd}$ function (discussed above). After step 657, the method goes to step 662 to check if the OC is less than or equal to a minimum (MIN) OC value. If step 662 is Yes (Y), the method goes to step 669 to report "Verified RCA." If step 662 is No (N), the method goes to step 665 and reports "Detect OC: X %." The method then goes to step 670 and to report or correct OC, UC, or other faults and returns to step 602 for AC system temperature measurements or continue.

If step 645 regarding the TXV is No (N), the method goes to step 649 to check RCA for the NT. If step 649 is Yes (Y), the method goes to step 650 and reports "Verified RCA." If step 649 is No (N), the method goes to step 656 to diagnose an OC for the NT. If step 656 is No (N) for the NT, the method goes to step 658 to determine the UC amount based on the $2^{nd}$ function or the $1^{st}$ function. After step 658, the method goes to step 660 to check if the UC is less than or equal to a minimum (MIN) UC value. If step 660 is Yes (Y), the method goes to step 669 to report "Verified RCA." If step 658 is No (N), the method goes to step 661 and reports "Detect UC: X %." The method then goes to step 670 and to report or correct UC, OC or other faults and returns to step 602 for AC system temperature measurements or continue.

If step 656 is Yes (Y) for the NT, the method goes to step 657 to determine the OC amount based on the $3^{rd}$ function. After step 657, the method goes to step 662 to check if the OC is less than or equal to a minimum (MIN) OC value. If step 662 is Yes (Y), the method goes to step 669 to report "Verified RCA." If step 662 is No (N), the method goes to step 665 and reports "Detect OC: X %." The method then goes to step 670 and to report or correct OC, UC, or other faults and returns to step 602 for AC system temperature measurements or continue.

FIG. 21 shows a lookup table of the Required Temperature Split (RTS) temperature (F) difference across the evaporator based on the RDT and the RWT. Due to space limitations a partial table of values are shown. The RTS is used to calculate the DTS wherein the DTS equals the ATS minus the RST and the ATS equals the RDT minus the SDT.

FIG. 22 shows a lookup table of the Required Superheat (RSH) temperature (F) based on the OAT and the RWT. Due to space limitations, only the odd numbered rows and even numbered columns are shown. The RSH is used to calculate the DSH wherein the DSH equals the ASH minus the RSH, wherein the ASH equals the ST minus the EST, and the EST is based on the SP.

The NTD method provides verification and quality control (QC) data for units with a minimum UC (e.g., 7.5%) of factory charge based on test-in and test-out measurements of an ATS or TS across the evaporator coil which is proportional to the sensible cooling capacity used to calculate the application sensible energy efficiency (EER*) impact. The ATS or TS is equal to the return air temperature minus the supply air temperature across the evaporator coil.

FIG. 23, FIG. 24, and FIG. 25 provide Intertek laboratory test data indicating that the EER* impact is equivalent to the $EER^*_{TS}$ impact based on TS or ATS measurements for UC faults. For UC faults, the $EER^*_{TS}$ impact of correcting UC greater than or equal to a minimum UC (e.g., 7.5%) provides confidence that energy efficiency is improved and ensures corrections are performed successfully. The EER* impact for UC faults is calculated using the following equation based on Intertek test of sensible cooling capacity (Btu) and total system power (Watts or W).

$$EER^*Impact = EER^*_{min\ \%}/EER^*_{100\%} - 1 \qquad \text{Eq. 2}$$

Where, $EER^*_{min\ \%}$=EER* at a minimum % UC (e.g., ≥7.5%), $EER^*_{100\%}$=EER* at 100% factory charge (FC) or 0% UC.

The $EER^*_{TS}$ impact is calculated using the following equation based on measurements of the TS or ATS including an ATS test-in ($ATS_{in}$ or $TS_{in}$) and an ATS test-out ($ATS_{out}$ or $TS_{out}$).

$$EER^*_{TS}\ Impact = (TS_{in}/TS_{out} - 1)*C_{EER} + = (ATS_{in}/ATS_{out} - 1)*C_{EER}^* \qquad \text{Eq. 3}$$

Where, $TS_{in}$ or $ATS_{in}$=RDT minus SDT in ° F. at test-in before correcting an AC system fault, $TS_{out}$ or $ATS_{out}$=RDT minus SDT in ° F. at test-out after correcting an AC system fault, $C_{EER}^*$=a coefficient less than 1.0 and more preferably 0.84 to convert the TS impact to $EER^*_{TS}$ impact (dimensionless).

FIG. 23 provides non-TXV (NT) application Energy Efficiency Ratio (EER*) values at 95° F. OAT based on Intertek tests for a 3-ton AC from 0 to 40 percent (%) UC per original equipment manufacturer (OEM) factory charge, Intertek measured EER* impacts, ATS across the evaporator for each Intertek test, and calculated $EER^*_{TS}$ impacts. For 7.5 to 40% UC, the NT EER* impacts range from −21 to −74% and non-TXV $EER^*_{TS}$ impacts range from −18.9% to −63.4%.

FIG. 24 provides NT EER*, EER* impacts, ATS, and calculated $EER^*_{TS}$ impacts at 82° F. OAT based on Intertek tests from 0 to 40% UC per OEM factory charge for a 3-ton AC. For 7.5 to 40% UC, the non-TXV EER* impacts range from −10.2 to −70.8% and the non-TXV $EER^*_{TS}$ impacts range from −11.3% to −62.4%.

FIG. 25 provides TXV EER*, EER* impacts, ATS, and calculated $EER^*_{TS}$ impacts at 95° F. OAT based on Intertek tests from 0 to 40% UC per OEM factory charge for a 3-ton AC. For 7.5 to 40% UC, the TXV EER* impacts range from −7.7 to −66.9% and the TXV EER* TS impacts range from −7% to −58.9%.

For undercharge, the accuracy of the $EER^*_{TS}$ impact calculation method is evaluated using the Pearson product-moment correlation coefficient (or Pearson coefficient, r) which measures the strength of a linear association between two variables. The Pearson product-moment correlation attempts to draw a line of best fit through the data of two variables, and the Pearson correlation coefficient, r, indicates how far away all these data points are to this line of best fit (i.e., how well the data points fit this model line of best fit). A Pearson product-moment correlation coefficient close to +1 indicates a strong correlation. For the EER* Intertek impact (x-variable) and $EER^*_{TS}$ calculated impact (y-variable) the Pearson coefficient is 0.996 for the Non-TXV EER* at 95° F., 0.997 for the Non-TXV at 82° F., and 0.998 for the TXV EER* at 95° F. indicating a strong correlation. The Pearson coefficient is calculated using the following equation.

$$r = \frac{\sum (x_i - \bar{x})(y_i - \bar{y})}{\sqrt{\sum (x_i - \bar{x})^2 (y_i - \bar{y})^2}} \qquad \text{Eq. 4}$$

r=Pearson product-moment correlation coefficient (close to +1 is high correlation), $x_i$=x-variable in a sample of n values (EER* Intertek impact col. c), $\bar{x}$=mean of x-variables in the sample, $y_i$=the y-variable ($EER^*_{TS}$ calculated impact, col. e), and $\bar{y}$=mean of y-variables in the sample.

FIG. 26 provides non-TXV application EER* values at 95° F. OAT based on Intertek laboratory tests for a base case (no fault) and AC system faults, Intertek measured EER* impacts, ATS across the evaporator for each test, and calculated EER* impacts. The Intertek tests indicate that the EER* impact is equivalent to the $EER^*_{TS}$ impact based on ATS measurements for UC, NC, and RR faults but not for low airflow and condenser coil blockage in which the efficiency decreases but the TS increases. The non-TXV EER* impacts range from −10.4 to −42.7% and the TXV EER* TS impacts range from −32.8% to +28.6%. NTD method diagnoses low airflow with DTS greater than 2F. NTD method diagnoses condenser coil blockage when DTS is negative and LOA (LT-OAT) is greater than 9F. RSD method diagnoses condenser coil blockage when COA is greater than 19 to 23F (COA threshold varies based on OAT see FIG. 12).

The NTD method diagnoses an Air Conditioning (AC) system in cooling mode by measuring AC system temperatures comprising a Return-air Drybulb Temperature (RDT), a Return-air Wetbulb Temperature (RWT), a Supply-air Drybulb Temperature (SDT), an Outdoor Air Temperature (OAT), a refrigerant Suction Temperature (ST), and a refrigerant Liquid Temperature (LT). The method enters or captures the AC system temperatures into a processor memory and performs the following processing steps. Monitoring the AC system temperatures reaching an equilibrium condition based on a rate of change of the AC system temperatures with respect to time. Calculating an Actual Temperature Split (ATS) across an evaporator coil based on the RDT minus the SDT. Calculating a Required Temperature Split (RTS) based on the RWT and the RDT. Calculating a Delta Temperature Split (DTS) based on the ATS minus the RTS. Calculating a Liquid Over Ambient (LOA) temperature based on the LT minus the OAT. Diagnosing a proper Refrigerant Charge and Airflow (RCA) based on the DTS and the LOA or diagnosing at least one AC system fault based on the DTS, the ST, and the LOA wherein the at least one AC system fault comprises a refrigerant undercharge fault with the processor estimating a refrigerant undercharge amount based on the DTS when the refrigerant undercharge fault is diagnosed. The method also diagnoses AC system faults based on the type of refrigerant expansion device (NT or TXV). For packaged AC systems, the method diagnoses AC system faults based on the number of AC compressors.

The method reports at least one message to a display on a mobile phone, a tablet computer, or other display, or audible technology. The at least one message is selected from the group consisting of: the AC system has not reached the equilibrium condition for diagnostic testing, verifying the proper RCA indicting acceptable AC system performance operating within tolerances, reporting the at least one AC system fault with information to enable repair of the at least one AC system fault and subsequently verifying the proper RCA, and reporting the refrigerant undercharge fault and the refrigerant undercharge amount to add to the AC system to correct the refrigerant undercharge fault and subsequently verifying the proper RCA.

The NTD method may further include at least one message when the AC system has not reached the equilibrium condition for the diagnostic testing wherein the at least one message is selected from the group consisting of: check and repair the AC system to achieve the equilibrium condition for the diagnostic testing, check for proper airflow, check a fan relay, check or replace an air filter, check or clean the evaporator coil, check or clean a condenser coil, check for refrigerant leaks with an electronic leak detector or soap solution, check an expansion valve or a heat pump reversing valve, check for a refrigerant restriction, check for non-condensable nitrogen, air, water vapor in the AC system, check AC compressor faults such as a failed capacitor or a failed contactor, or check other faults.

The NTD method includes processing and analyzing the DTS and the at least one refrigerant temperature with NTD software and diagnosing proper RCA based on the DTS and the LOA or diagnosing at least one AC system fault to subsequently correct based on the DTS and the at least one refrigerant temperature. The at least one AC system fault is selected from the group consisting of: a low cooling capacity fault, a condenser heat exchanger fault, a refrigerant restriction fault, an evaporator heat exchanger fault, the proper RCA, the refrigerant undercharge, a refrigerant overcharge, a non-condensable fault, and a low airflow fault. The low cooling capacity fault comprises an expansion valve fault, a heat pump reversing valve fault, an AC compressor fault, a condenser fan fault, or other faults that reduce cooling capacity such as a refrigerant leak. The method includes a processor diagnosing the proper RCA based on the DTS and the LOA, or diagnosing the at least one AC system fault based on the DTS, the OAT, the ST, and the LOA comprising at least one diagnosing step selected from the group consisting of: diagnosing a low cooling capacity fault, diagnosing a condenser heat exchanger fault, diagnosing a refrigerant restriction fault, diagnosing an evaporator heat exchanger fault, diagnosing the proper RCA, diagnosing the refrigerant undercharge, diagnosing a refrigerant overcharge, diagnosing a non-condensable fault, and diagnosing a low airflow fault. When more than one of the diagnosing steps is performed, the steps are in a processing order comprising: diagnosing a low cooling capacity fault, diagnosing a condenser heat exchanger fault, diagnosing a refrigerant restriction fault, diagnosing an evaporator heat exchanger fault, diagnosing the proper RCA, diagnosing the refrigerant undercharge, diagnosing a refrigerant overcharge, diagnosing a non-condensable fault, and diagnosing a low airflow fault. When no faults are present the method diagnoses the proper RCA or the Verified RCA.

The NTD method comprises processing and analyzing the DTS, the ST, and the LOA, and diagnosing proper RCA or at least one AC system fault to subsequently correct based on at least one diagnostic. Diagnosing a low cooling capacity based on a first diagnostic wherein the DTS is negative and the SDT is greater than the RDT. Diagnosing a condenser heat exchanger fault based on at least one second diagnostic selected from the group consisting of: the DTS is less than minus 0.5 (−0.5) degrees fahrenheit (F) when the LOA is greater than 9F, the ST is less than 55F when the OAT is less than or equal to 100F, and the ST is less than 60F when the OAT is greater than 100F. Diagnosing a refrigerant restriction or an evaporator heat exchanger fault based on at least one third diagnostic selected from the group consisting of: the DTS is between −11F and −6F, the ST is greater than the SDT, and the LOA is less than 6F. Diagnosing a proper RCA based on at least one fourth diagnostic selected from the group consisting of: the DTS is between −2F and 2F when the LOA is between 4F and 10F, and the estimated refrigerant undercharge based on the DTS is less than a minimum threshold such as 5% to 7.5% of a factory charge. Diagnosing the refrigerant undercharge based on at least one fifth diagnostic selected from the group consisting of: the DTS is less than or equal to −2F when the ST is greater than the SDT, and the LOA is greater than 3F. Diagnosing a refrigerant overcharge based on at least one sixth diagnostic selected from the group consisting of: the DTS is between −4F and OF when the LOA is between 0F and 8F and the ST is less than 53F, the DTS is between −1F and 0.5F when the LOA is between −1F and 11F and the ST is less than 57F, and the DTS is between −5F and −1F when the LOA is between 0F and 4F and the ST is between 62F and 66F. Diagnosing a non-condensable fault based on at least one seventh diagnostic selected from the group consisting of: the DTS is between −9F and 1F when the OAT is less than 80F, the DTS is between −10F and −1F when the OAT is greater than or equal to 80F, the ST is between 52F and 76F, and the LOA is between 0F and 6F. Diagnosing a low airflow based on at least one eighth diagnostic selected from the group consisting of: the DTS is greater than 2F when the ST is less than 50F, and the DTS is greater than 3F when the ST is less than 53F.

The method comprises a processor reporting the proper RCA or the at least one AC system fault based on the at least one diagnostic or reporting the at least one AC system fault to subsequently correct based on the at least one diagnostic. The method comprises providing at least one message from the processor to a visual display or an audible device, wherein the at least one message is selected from the group consisting of: verifying the proper RCA indicting acceptable AC system performance, reporting the at least one AC system fault with information to enable repair of the at least one AC system fault, and reporting the refrigerant undercharge fault and the refrigerant undercharge amount to add to the AC system to correct the refrigerant undercharge fault.

The NTD method further includes estimating a refrigerant UC amount using a first or second order equation with the DTS as an independent variable. The proper RCA is based on a fourth condition wherein the DTS is within +/−2F. Known TS methods only check a proper airflow when the DTS is within +/−3F, but the larger range misses other faults and does not diagnose other AC system faults. Known TS methods do not include the ST or the LOA which indicate whether or not other faults are present.

The NTD method does not use prior measurements of LP or SP or prior measurements of ASH or ASC to diagnose proper RCA or AC system faults. The NTD method can be performed with or without measuring OAT. The DTS, ST, and LT provide sufficient information about the refrigerant system performance for the NTD method to process, analyze, and diagnose proper operation of the AC system or the at least one AC system fault.

The NTD method comprises diagnosing the refrigerant undercharge and estimating or determining a refrigerant undercharge amount based on a first mathematical function with the DTS as an independent variable. The method estimates or determines a refrigerant undercharge amount to be subsequently corrected based on the DTS. The method diagnoses proper RCA or at least one AC system fault without currently connecting refrigerant pressure sensors to the AC system or obtaining or prior pressure measurements to reduce refrigerant venting by at least 50 percent. The method comprises diagnosing the refrigerant undercharge and further includes correcting the refrigerant undercharge by adding an amount of refrigerant through a suction line without connecting a pressure sensor to a liquid line to reduce refrigerant venting. The method reports proper RCA or reports or corrects the at least one AC system fault based on the DTS and the at least one refrigerant temperature. The method calculates an application energy efficiency ratio (EER*) improvement of the AC system in cooling mode based on a ratio of the ATS measured before correcting the refrigerant undercharge to the ATS measured after correcting the refrigerant undercharge. The EER* improvement may also be based on the ratio of ATS measured before and after correcting non-condensables or refrigerant restrictions.

The method diagnoses the non-condensable fault based on the DTS, the ST, and the LOA and further diagnoses the non-condensable fault based on a Condenser Over Ambient (COA) temperature being greater than a calculated COA threshold temperature wherein the COA is equal to a Condenser Saturation Temperature (CST) minus the OAT and the CST, based on a Liquid Pressure (LP) measurement. The method diagnoses the refrigerant restriction based on the DTS, the ST, the SDT, and the LOA and diagnosing the refrigerant restriction further based on an Evaporator Saturation Temperature (EST) being less than a calculated EST threshold temperature and the EST, based on a Suction Pressure (SP) measurement. The method diagnoses the refrigerant undercharge based on the DTS, the ST, and the LOA and further estimates a refrigerant undercharge amount based on a Delta Superheat (DSH) temperature wherein the DSH is based on a difference between an Actual Superheat (ASH) temperature minus a Required Superheat (RSH) temperature and the ASH is equal to the ST minus an Evaporator Saturation Temperature (EST) wherein the EST is based on a Suction Pressure (SP) measurement and the RSH is based on the OAT and the RWT. The method diagnoses the refrigerant overcharge based on the DTS, the ST, and the LOA and estimates a refrigerant overcharge amount based on a Delta Subcooling (DSC) temperature wherein the DSC is based on an Actual Subcooling (ASC) temperature minus a Required Subcooling (RSC) temperature and the ASC is equal to a Condenser Saturation Temperature (CST) minus the LT and the CST is based on a Liquid Pressure (LP) measurement, wherein the RSC is provided by a manufacturer or is a default value.

The method diagnoses the refrigerant undercharge and estimates a refrigerant undercharge amount based on a second mathematical function with a Delta Superheat (DSH) temperature as an independent variable wherein the DSH is based on a difference between an Actual Superheat (ASH) temperature minus a Required Superheat (RSH) temperature and the ASH is equal to a Suction Temperature (ST) minus an Evaporator Saturation Temperature (EST) wherein the EST is based on a Suction Pressure (SP) measurement and the RSH is based on the OAT and the RWT.

The method diagnoses the refrigerant overcharge and estimates or determines a refrigerant overcharge amount based on a third mathematical function with a Delta Subcooling (DSC) temperature as an independent variable wherein the DSC is based on an Actual Subcooling (ASC) temperature minus a Required Subcooling (RSC) temperature wherein the ASC is equal to a Condenser Saturation Temperature (CST) minus a Liquid Temperature (LT) and the CST is based on a Liquid Pressure (LP) measurement and the RSC is provided by a manufacturer or is a default value.

The method diagnoses the non-condensable fault based on a Condenser Over Ambient (COA) temperature being greater than a calculated COA threshold ($COA_t$) temperature based on a fourth mathematical function with the OAT as an independent variable wherein the COA is equal to a Condenser Saturation Temperature (CST) minus the OAT and the CST is based on a Liquid Pressure (LP) measurement.

The method diagnoses the refrigerant restriction based on an Evaporator Saturation Temperature (EST) being less than a calculated EST threshold temperature based on a fifth mathematical function with the OAT as an independent variable wherein the EST is based on a Suction Pressure (SP) measurement.

While the invention herein disclosed has been described by means of embodiments and applications thereof, numerous modifications and variations could be made thereto by those skilled in the art without departing from the scope of the invention set forth in the claims.

The invention claimed is:

1. A Non-invasive Temperature-based Diagnostic (NTD) method for an Air Conditioning (AC) system in cooling mode, the method comprising:

measuring AC system temperatures comprising a Return-air Drybulb Temperature (RDT), a Return-air Wetbulb Temperature (RWT), a Supply-air Drybulb Temperature (SDT), an Outdoor Air Temperature (OAT), a refrigerant Suction Temperature (ST), and a refrigerant Liquid Temperature (LT); and entering the AC system temperatures into a processor memory and the processor performing processing steps comprising:

calculating an Actual Temperature Split (ATS) across an evaporator coil based on the RDT minus the SDT;

calculating a Required Temperature Split (RTS) based on the RWT and the RDT;

calculating a Delta Temperature Split (DTS) based on the ATS minus the RTS;

calculating a Liquid Over Ambient (LOA) temperature based on the LT minus the OAT;

diagnosing a proper Refrigerant Charge and Airflow (RCA) based on the DTS and the LOA or diagnosing at least one AC system fault based on the DTS, the ST, and the LOA wherein the at least one AC system fault comprises a refrigerant undercharge fault with the processor estimating a refrigerant undercharge amount based on the DTS when the refrigerant undercharge fault is diagnosed; and providing at least one message from the processor to a visual display or an audible device, wherein the at least one message is selected from the group consisting of:

verifying the proper RCA indicting acceptable AC system performance, reporting the at least one AC system fault with information to enable repair of the at least one AC system fault, and reporting the refrigerant undercharge fault and the refrigerant undercharge amount to add to the AC system to correct the refrigerant undercharge fault.

2. The method of claim 1, wherein diagnosing the proper RCA or diagnosing the at least one AC system fault is performed without currently connecting refrigerant pressure sensors to the AC system or obtaining prior pressure measurements of the AC system.

3. The method of claim 1, wherein the diagnosing the proper RCA or diagnosing the at least one AC system fault is based on at least one diagnosing selected from the group consisting of:

diagnosing a low cooling capacity based on a first diagnostic wherein the DTS is negative and the SDT is greater than the RDT, diagnosing a condenser heat exchanger fault based on at least one second diagnostic selected from the group consisting of: the DTS is less than minus 0.5 (−0.5) degrees fahrenheit (F) when the LOA is greater than 9F, the ST is less than 55F when the OAT is less than or equal to 100F, and the ST is less than 60F when the OAT is greater than 100F, diagnosing a refrigerant restriction or an evaporator heat exchanger fault based on at least one third diagnostic selected from the group consisting of: the DTS is between −11F and −6F, the ST is greater than the SDT, and the LOA is less than 6F, diagnosing the proper RCA based on at least one fourth diagnostic selected from the group consisting of: the DTS is between −2F and 2F when the LOA is between 4F and 10F, and the estimated refrigerant undercharge based on the DTS is less than a minimum threshold, diagnosing the refrigerant undercharge based on at least one fifth diagnostic selected from the group consisting of: the DTS is less than or equal to −2F when the ST is greater than the SDT, and the LOA is greater than 3F, diagnosing a refrigerant overcharge based on at least one sixth diagnostic selected from the group consisting of: the DTS is between −4F and OF when the LOA is between 0F and 8F and the ST is less than 53F, the DTS is between −1F and 0.5F when the LOA is between −1F and 11F and the ST is less than 57F, and the DTS is between −5F and −1F when the LOA is between 0F and 4F and the ST is between 62F and 66F, diagnosing a non-condensable fault based on at least one seventh diagnostic selected from the group consisting of: the DTS is between −9F and 1F when the OAT is less than 80F, the DTS is between −10F and −1F when the OAT is greater than or equal to 80F, the ST is between 52F and 76F, and the LOA is between 0F and 6F, and diagnosing a low airflow based on at least one eighth diagnostic selected from the group consisting of: the DTS is greater than 2F when the ST is less than 50F, and the DTS is greater than 3F when the ST is less than 53F.

4. The method of claim 1, further including the processor calculating an energy efficiency improvement of the AC system based on a ratio of the ATS measured before correcting the refrigerant undercharge to the ATS measured after correcting the refrigerant undercharge.

5. The method of claim 1, further including the processor diagnosing the proper RCA based on the DTS and the LOA, or diagnosing the at least one AC system fault based on the DTS, the ST, and the LOA, comprising at least one diagnosing step selected from the group consisting of: diagnosing a low cooling capacity, diagnosing a condenser heat exchanger fault, diagnosing a refrigerant restriction, diagnosing evaporator heat exchanger fault, diagnosing the proper RCA, diagnosing the refrigerant undercharge, diagnosing a refrigerant overcharge, diagnosing a non-condensable fault, and diagnosing a low airflow, wherein the diagnosing steps performed are performed in an order comprising: diagnosing a low cooling capacity, diagnosing a condenser heat exchanger fault, diagnosing a refrigerant restriction, diagnosing evaporator heat exchanger fault, diagnosing the proper RCA, diagnosing the refrigerant undercharge, diagnosing a refrigerant overcharge, diagnosing a non-condensable fault, and diagnosing a low airflow.

6. A Non-invasive Temperature-based Diagnostic (NTD) method for an Air Conditioning (AC) system in cooling mode, the method comprising:

measuring AC system temperatures comprising a Return Drybulb Temperature (RDT), a Return Wetbulb Temperature (RWT), a Supply Drybulb Temperature (SDT), an Outdoor Air Temperature (OAT), a Suction Temperature (ST), and a refrigerant Liquid Temperature (LT); and entering the AC system temperatures into a processor memory and the processor performing processing steps comprising:

monitoring the AC system temperatures reaching an equilibrium condition based on a rate of change of the AC system temperatures with respect to time;

calculating an Actual Temperature Split (ATS) across an evaporator coil based on the RDT minus the SDT;

determining a Required Temperature Split (RTS) based on the RWT and the RDT;

calculating a Delta Temperature Split (DTS) based on the ATS minus the RTS;

calculating a Liquid Over Ambient (LOA) temperature based on the LT minus the OAT;

diagnosing proper Refrigerant Charge and Airflow (RCA) based on the DTS and the LOA or diagnosing at least one AC system fault based on the DTS, the OAT, the ST, and the LOA wherein the at least one AC system fault comprises a refrigerant undercharge with the processor estimating a refrigerant undercharge amount based on the DTS when the refrigerant undercharge fault is diagnosed; and reporting at least one message from the processor to a visual display or audible device, wherein the at least one message is selected from the group consisting of:

the AC system has not reached the equilibrium condition for diagnostic testing, the proper RCA indicting the AC system is operating properly, the at least one AC system fault with information to enable repair of the at least one AC system fault, and the refrigerant undercharge fault and the refrigerant undercharge amount to add to the AC system to correct the refrigerant undercharge fault.

7. The method of claim 6, wherein diagnosing the proper RCA or diagnosing the at least one AC system fault is performed without currently connecting refrigerant pressure sensors to the AC system or obtaining prior refrigerant pressure measurements of the AC system.

8. The method of claim 6, further including the at least one message when the AC system has not reached the equilibrium condition for the diagnostic testing wherein the at least one message is selected from the group consisting of: check and repair the AC system to achieve the equilibrium condition for the diagnostic testing, check for proper airflow, check a fan relay, check or replace an air filter, check or clean the evaporator coil, check or clean a condenser coil, check for refrigerant leaks with an electronic leak detector or soap solution, check an expansion valve or a heat pump reversing valve, check for a refrigerant restriction, check for non-condensable nitrogen, air, water vapor in the AC system, check AC compressor faults such as a failed capacitor or a failed contactor, or check other faults.

9. The method of claim 6, wherein diagnosing and estimating the refrigerant undercharge amount further includes subsequently correcting the refrigerant undercharge by adding an amount of refrigerant through a suction line without connecting a pressure sensor to a liquid line to reduce refrigerant venting.

10. The method of claim 6, further including the processor diagnosing the proper RCA based on the DTS and the LOA, or the processor diagnosing the at least one AC system fault based on the DTS, the OAT, the ST, and the LOA in a processing order comprising: diagnosing a low cooling capacity, diagnosing a condenser heat exchanger fault, diagnosing a refrigerant restriction, diagnosing an evaporator heat exchanger fault, diagnosing the proper RCA, diagnosing the refrigerant undercharge, diagnosing a refrigerant overcharge, a non-condensable fault, and diagnosing a low airflow.

11. The method of claim 10, further including calculating an energy efficiency improvement of the AC system based on a ratio of the ATS measured before correcting the refrigerant undercharge, the non-condensable fault, or the refrigerant restriction to the ATS measured after correcting the refrigerant undercharge, the non-condensable fault, or the refrigerant restriction.

12. A Non-invasive Temperature-based Diagnostic (NTD) method for an Air Conditioning (AC) system in cooling mode, the method comprising:

measuring AC system temperatures comprising a Return-air Drybulb Temperature (RDT), a Return-air Wetbulb Temperature (RWT), a Supply-air Drybulb Temperature (SDT), an Outdoor Air Temperature (OAT), a refrigerant Suction Temperature (ST), and a refrigerant Liquid Temperature (LT); and entering the AC system temperatures into a processor memory and the processor performing processing steps comprising:

calculating an Actual Temperature Split (ATS) across an evaporator coil based on the RDT minus the SDT;

determining a Required Temperature Split (RTS) based on the RWT and the RDT;

calculating a Delta Temperature Split (DTS) based on the ATS minus the RTS;

calculating a Liquid Over Ambient (LOA) temperature based on the LT minus the OAT; and diagnosing a proper Refrigerant Charge and Airflow (RCA) or diagnosing at least one AC system fault to subsequently correct based on at least one diagnostic wherein the at least one diagnostic for the proper RCA is based on the DTS and the LOA and the at least one diagnostic for the at least one AC system fault is based on the DTS, the ST, and the LOA when the at least one AC system fault is diagnosed;

reporting at least one message to a visual display or an audible device wherein the at least one message is selected from the group consisting of:

verifying the proper RCA indicting the AC system is operating properly, and reporting the at least one AC system fault with information to enable repair of the at least one AC system fault.

13. The method of claim 12, further including diagnosing the at least one AC system fault comprising a refrigerant undercharge fault based on the DTS, the ST, and the LOA and estimating a refrigerant undercharge amount based on the DTS.

14. The method of claim 13, further including correcting the refrigerant undercharge fault by adding an amount of refrigerant through a suction line without connecting a pressure sensor to a liquid line to reduce refrigerant venting.

15. The method of claim 14, further including calculating an energy efficiency improvement of the AC system based on a ratio of the ATS measured before correcting the refrigerant undercharge fault to the ATS measured after correcting the refrigerant undercharge fault.

16. The method of claim 12, wherein diagnosing the proper RCA or the at least one AC system fault is based on the at least one diagnosing selected from the group consisting of:

diagnosing a low cooling capacity based on a first diagnostic wherein the DTS is negative and the SDT is greater than the RDT, diagnosing a condenser heat exchanger fault based on at least one second diagnostic selected from the group consisting of: the DTS is less than minus 0.5 (−0.5) degrees fahrenheit (F) when the LOA is greater than 9F, the ST is less than 55F when the OAT is less than or equal to 100F, and the ST is less than 60F when the OAT is greater than 100F, diagnosing a refrigerant restriction or an evaporator heat exchanger fault based on at least one third diagnostic selected from the group consisting of: the DTS is between −11F and −6F, the ST is greater than the SDT, and the LOA is less than 6F, diagnosing the proper RCA based on at least one fourth diagnostic selected from the group consisting of: the DTS is between −2F and 2F when the LOA is between 4F and 10F, and an estimated refrigerant undercharge based on the DTS is less than 5% to 7.5% of a factory charge, diagnosing a refrigerant undercharge based on at least one fifth diagnostic selected from the group consisting of: the DTS is less than or equal to −2F when the ST is greater than the SDT, and the LOA is greater than 3F, diagnosing a refrigerant overcharge based on at least one sixth diagnostic selected from the group consisting of: the DTS is between −4F and OF when the LOA is between 0F and 8F and the ST is less than 53F, the DTS is between −1F and 0.5F when the LOA is between −1F and 11F and the ST is less than 57F, and the DTS is between −5F and −1F when the LOA is between 0F and 4F and the ST is between 62F and 66F, diagnosing a non-condensable fault based on at least one seventh diagnostic selected from the group consisting of: the DTS is between −9F and 1F when the OAT is less than 80F, the DTS is between −10F and −1F when the OAT is greater than or equal to 80F, the ST is between 52F and 76F, and the LOA is between 0F and 6F, and diagnosing a low airflow based on at least one eighth diagnostic selected from the group consisting of: the DTS is greater than 2F when the ST is less than 50F, and the DTS is greater than 3F when the ST is less than 53F.

17. The method of claim 12, further including;

diagnosing the at least one AC system fault comprising a refrigerant undercharge based on the DTS, the ST, and the LOA;

estimating a refrigerant undercharge amount based on a Delta Superheat (DSH) temperature wherein the DSH is based on an Actual Superheat (ASH) minus a Required Superheat (RSH) temperature and the ASH equals the ST minus an Evaporator Saturation Temperature (EST) and the EST is based on a Suction Pressure (SP) measurement and the RSH is based on the OAT and the RWT; and reporting the at least one AC system fault and indicating the refrigerant undercharge amount.

18. The method of claim 12, further including:

diagnosing the at least one AC system fault comprising a non-condensable fault based on the DTS, the ST, and the LOA;

diagnosing the non-condensable fault further based on a Condenser Over Ambient (COA) temperature being greater than a calculated COA threshold temperature wherein the COA is based on the OAT and the COA is equal to a Condenser Saturation Temperature (CST) minus the OAT and the CST is based on a Liquid Pressure (LP) measurement; and reporting the at least one AC system fault indicating the non-condensable fault.

19. The method of claim 12, further including:

diagnosing the at least one AC system fault comprising a refrigerant restriction based on the DTS, the ST, the SDT, and the LOA;

diagnosing the refrigerant restriction further based on an Evaporator Saturation Temperature (EST) being less than a calculated EST threshold temperature and the EST is based on a Suction Pressure (SP) measurement; and reporting the at least one AC system fault indicating the refrigerant restriction fault.

20. The method of claim 12, further including:

diagnosing the at least one AC system fault comprising a refrigerant overcharge based on the DTS, the ST, and the LOA;

estimating a refrigerant overcharge amount based on a Delta Subcooling (DSC) temperature wherein the DSC is based on an Actual Subcooling (ASC) temperature minus a Required Subcooling (RSC) temperature and the ASC is equal to a Condenser Saturation Temperature (CST) minus the LT and the CST is based on a Liquid Pressure (LP), wherein the RSC provided by a manufacturer or is a default value; and reporting the at least one AC system fault indicating the refrigerant overcharge amount.

* * * * *